US012408809B2

(12) United States Patent
Kim

(10) Patent No.: US 12,408,809 B2
(45) Date of Patent: Sep. 9, 2025

(54) DISHWASHER

(71) Applicant: LG Electronics Inc., Seoul (KR)

(72) Inventor: Sung Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 397 days.

(21) Appl. No.: 17/989,953

(22) Filed: Nov. 18, 2022

(65) Prior Publication Data

US 2023/0148827 A1 May 18, 2023

(30) Foreign Application Priority Data

Nov. 18, 2021 (KR) ..... 10-2021-0159661
Mar. 4, 2022 (KR) ..... 10-2022-0028085

(51) Int. Cl.
*A47L 15/00* (2006.01)
*A47L 15/42* (2006.01)
*A47L 15/48* (2006.01)

(52) U.S. Cl.
CPC ..... *A47L 15/0049* (2013.01); *A47L 15/4221* (2013.01); *A47L 15/486* (2013.01); *A47L 15/4246* (2013.01); *A47L 15/4251* (2013.01); *A47L 15/4272* (2013.01); *A47L 15/48* (2013.01)

(58) Field of Classification Search
CPC .. A47L 15/0049; A47L 15/4246; A47L 15/48; A47L 15/4221; A47L 15/486; A47L 15/4272; A47L 15/4251
See application file for complete search history.

(56) References Cited

U.S. PATENT DOCUMENTS 4,188,732 A 2/1980 Quayle
5,277,210 A * 1/1994 Kim ..... A47L 15/483 134/107
5,337,500 A * 8/1994 Enokizono ..... A47L 15/488 34/233
5,875,802 A * 3/1999 Favaro ..... A47L 15/483 34/235
6,058,620 A * 5/2000 Rolfi ..... A47L 19/00 34/106
7,556,049 B2 * 7/2009 Oakes ..... A47L 15/488 34/235
7,846,270 B2 * 12/2010 Jerg ..... A47L 15/481 134/57 D
9,750,392 B2 * 9/2017 Bewley, Jr. ..... A47L 15/488
(Continued)

FOREIGN PATENT DOCUMENTS

DE 102014215933 3/2016
DE 102015212869 1/2017
(Continued)

OTHER PUBLICATIONS

Machine Translation of KR 20220053419 to Yeong et al., Apr. 2022. (Year: 2022).*

(Continued)

*Primary Examiner* — Benjamin L Osterhout
(74) *Attorney, Agent, or Firm* — Fish & Richardson P.C.

(57) ABSTRACT

A dishwasher minimizes the flow of wash water, being scattered in a washing stage or a rinsing stage, into an airflow guide through a discharge opening and the remaining wash water in the airflow guide, and prevents the reverse inflow of wash water having passed through the airflow guide to a dry air supply part.

20 Claims, 36 Drawing Sheets

(56) References Cited

U.S. PATENT DOCUMENTS

| | | | | |
|---|---|---|---|---|
| 10,024,561 | B2 * | 7/2018 | Olson | F24F 7/007 |
| 2013/0008474 | A1 * | 1/2013 | Thayyullathil | A47L 15/488 34/201 |
| 2013/0319482 | A1 | 12/2013 | Vallejo Noriega et al. | |
| 2017/0150868 | A1 * | 6/2017 | Ryu | E05F 15/70 |
| 2022/0104685 | A1 * | 4/2022 | Wolowicz | A47L 15/486 |

FOREIGN PATENT DOCUMENTS

| | | |
|---|---|---|
| DE | 102015212880 | 1/2017 |
| EP | 3114979 | 8/2019 |
| EP | 3988001 | 4/2022 |

OTHER PUBLICATIONS

Machine Translation of DE 102014215933 to Riedel et al., Mar. 2016 (Year: 2016).*

European Search Report in European Appln. No. 22207692.9, mailed on Mar. 30, 2023, 9 pages.

* cited by examiner

DISHWASHER

CROSS-REFERENCE TO RELATED APPLICATION

This application claims priority to and the benefit of Korean Patent Application No. 10-2021-0159661, filed on Nov. 18, 2021, and 10-2022-0028085, filed on Mar. 4, 2022, the disclosures of which are incorporated herein by reference in its entirety.

TECHNICAL FIELD

Disclosed herein is a dishwasher, and in particular, a dishwasher that can minimize the flow of wash water, being scattered in a washing stage or a rinsing stage, into an airflow guide through a discharge opening, minimize the wash water remaining in the airflow guide, and minimize the scattering of wash water droplets, flowing into the airflow guide through the discharge opening of the airflow guide, toward the inner upper end surface of the airflow guide or toward the upper end of a connection duct part into which dry air is drawn.

BACKGROUND

Dishwashers spray wash water such as water to a wash target such as cooking vessels, cooking tools and the like accommodated in them to wash the wash target. At this time, wash water used for washing a wash target can include detergent.

Ordinarily, dishwashers are comprised of a tub forming a wash space, a storage part accommodating wash targets in the tub, a spray arm spraying wash water to the storage part, and a sump storing water and supplying wash water to the spray arm.

Dishwashers help to reduce time and efforts taken to clean wash targets such as cooking vessels and the like after meals, thereby ensuring improvement in user convenience.

Ordinarily, dishwashers perform a washing process of washing wash targets, a rinsing process of rinsing the wash targets, and a drying process of drying the wash targets after the washing and rinsing processes.

In recent years, the drying stage of dishwashers involves supplying high-temperature dry air into the tub to reduce a drying period and promote the effect of sterilizing wash targets.

As a related art, a dishwasher provided with a hot air supply device that generates and supplies high-temperature dry air after the washing and rinsing stages is disclosed in DE Patent Publication No. 102015212869 (document 001).

In the dishwasher according to document 001, a dry air spray part for spraying dry air generated through a hot air supply device, disposed under of a tub, into the tub is disposed in the tub.

The dry air spray part is provided with a discharge opening from which dry air is discharged, and the discharge opening is open toward the central portion of the tub.

However, the discharge opening of the dry air spray part according to document 001 needs to be open entirely toward a wash space of the tub. Accordingly, wash water, scattered in a washing stage and a rinsing stage through the discharge opening, is highly likely to flow into the dry air spray part.

When reversely drawn wash water stays in the dry air spray part, the wash water can cause a bad smell due to the reproduction of germs.

Additionally, at least a portion of the wash water reversely flowing into the dry air spray part is highly likely to flow into the hot air supply device through a connection pipe, and the drawn wash water can impose damage to electronic components constituting the hot air supply device or cause electric leakage.

PRIOR ART DOCUMENT

[Patent Document]

(Document 001) DE Patent Publication No. 102015212869

SUMMARY

Technical Problems

The first objective of the present disclosure is to provide a dishwasher in which a discharge opening of an airflow guide is formed in a position lower than that of a lower spray arm with respect to an up-down direction, and a blocking rib is disposed around the discharge opening of the airflow guide, such that the flow of wash water, being scattered in a washing stage or a rinsing stage, into the airflow guide through the discharge opening may be minimize.

The second objective of the present disclosure is to provide a dishwasher in which a channel guide minimizing wash water, having passed through the discharge opening and remaining in the airflow guide, and discharging wash water automatically by using gravity is disposed in the airflow guide, such that the amount of wash water remaining in the airflow guide may be minimized.

The third objective of the present disclosure is to provide a dishwasher in which the upper end of a connection duct through which dry air flows into the airflow guide is formed higher than the upper end of the discharge opening with respect to the up-down direction, such that wash water having passed through the airflow guide is prevented from flowing reversely into the dry air supply part, thereby effectively preventing damage and electric leakage of electronic components, caused by the reversely drawn wash water.

The fourth objective of the present disclosure is to provide a dishwasher in which at least one blocking wall extending in a way that blocks the upper portion side of the discharge opening at least partially is disposed in the airflow guide, such that the scattering of droplets of wash water, which is drawn through the discharge opening of the airflow guide, toward the upper end surface inside the airflow guide or the upper end of a connection duct part into which dry air is drawn, is minimized.

The fifth objective of the present disclosure is to provide a dishwasher in which the up-down position of the upper end of the connection duct part to which the airflow guide is coupled and which guide dry airflow into the airflow guide is disposed higher than the up-down position of the upper end of a duct coupling part of the airflow guide, such that wash water is prevented from moving through a gap between the connection duct part and the duct coupling part of the airflow guide and flowing into the duct coupling part because of a capillary phenomenon.

The sixth objective of the present disclosure is to provide a dishwasher in which a blocking wall is formed into a curved surface to serve as a flow guide of dry airflow, such that the flow resistance of dry airflow against the blocking wall maybe minimized.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

A dishwasher according to the present disclosure comprises, a tub accommodating a wash target and having a wash space a front surface of which is open; a dry air supply part being disposed at a lower portion side of the tub, generating dry air for drying the wash target and supplying the dry air into the wash space; a lower rack being disposed in the wash space in a way that is withdrawn from the wash space and allowing the wash target to be mounted on; an airflow guide being disposed between the lower rack and a lower surface of the tub, and having an inner flow space in which a flow direction of the dry air supplied from the dry air supply part is diverted; and a lower spray arm being provided with at least one of nozzles spraying wash water for washing the wash target, and being rotatably disposed between the lower surface of the tub and the lower rack, wherein the airflow guide is provided with a discharge opening from which the dry air sprays, and the discharge opening is formed in a position lower than that of at least one of the nozzles with respect to an up-down direction. Thus, the passage of wash water, scattered in a washing stage or a rinsing stage, through the discharge opening, and the flow of the wash water into the airflow guide may be minimized.

The airflow guide may be disposed outside a rotation range of the lower spray arm.

The discharge opening may be provided in the form of a slit that extends in a front-rear direction.

Additionally, an up-down height of the discharge opening may remain constant.

Further, a position of an upper end edge of the discharge opening may remain constant with respect to the up-down direction, and the upper end edge of the discharge opening may be formed in a position lower than that of the nozzle.

The airflow guide may comprise a lower guide which is coupled to the dry air supply part, and into which dry air generated in the dry air supply part flows; and an upper guide which is coupled to an upper side of the lower guide and has the flow space therein, wherein the upper guide may be provided with a first notch hole forming a front edge, an upper end edge and a rear edge of the discharge opening, and the lower guide may be provided with a reference surface forming a lower end edge of the discharge opening.

The airflow guide may be provided with a blocking rib preventing the wash water from flowing into the inner flow space of the airflow guide through the discharge opening.

The blocking rib may comprise a first rib that is formed around the discharge opening and extends in a shade shape along the discharge opening.

The first rib may extend along the front edge, the upper end edge and the rear edge around the first notch hole, and be integrally formed at the upper guide.

Further, one end portion of the first rib may be formed at the rear edge of the first notch hole, the other end portion of the first rib may be formed at the front edge of the first notch hole, and the first rib may be continuously formed between one end portion and the other end portion thereof.

The first rib may comprise a horizontal rib that extends along the upper end edge of the first notch hole, and the horizontal rib may protrude horizontally past the reference surface of the lower guide.

The blocking rib may further comprise a second rib that extends across an inside of the first notch hole.

Further, a rear end portion of the second rib may integrally connect to the rear edge of the first notch hole, and a front end portion of the second rib may integrally connect to the front edge of the first notch hole.

Further, a cross-sectional shape of the second rib may remain constant from the front end portion to the rear end portion.

The second rib may have a cross section a width of which gradually decreases from an inside of the upper guide toward an outside thereof.

The airflow guide may comprise a cylindrical duct coupling part an upper end of which is exposed to the inner flow space and a lower end of which connects to the dry air supply part, and the upper end of the duct coupling part, through which the dry air passes, may be formed in a position higher than that of the discharge opening with respect to the up-down direction.

Further, a central axis of the duct coupling part may be disposed further forward than the discharge opening with respect to the front-rear direction.

The airflow guide may comprise a channel guide surface an upper end of which is formed in a position higher than that of the upper end edge of the discharge opening with respect to the up-down direction and a lower end of which connects to the reference surface.

The upper end of the channel guide surface may have the same height as the upper end of the duct coupling part with respect to the up-down direction.

The channel guide surface may extend in a curved surface shape or an inclined surface shape a height of which gradually decreases from an upper end toward a lower end thereof.

The airflow guide may further comprise a blocking wall that is disposed in the inner flow space and extends in a way that blocks an upper portion side of the discharge opening at least partially.

The airflow guide may comprise a lower guide which is coupled to the dry air supply part, and into which dry air generated in the dry air supply part flows; and an upper guide which is coupled to an upper side of the lower guide and has the flow space therein, wherein the upper guide may be provided with a first notch hole forming a front edge, an upper end edge and a rear edge of the discharge opening, the lower guide may be provided with a reference surface forming a lower end edge of the discharge opening, an upper end of the blocking wall may connect to the upper guide, and an up-down position of a lower end of the blocking wall may be between the upper end edge of the notch hole and the reference surface.

The blocking wall may comprise a first blocking wall being formed into a curved surface that is convex in a direction farther from the notch hole from one end edge thereof toward the other end edge thereof.

Further, one end edge of the first blocking wall may integrally connect to the front edge of the notch hole.

The first blocking wall may have a thickness that remains uniform from one end edge to the other end edge thereof.

An up-down position of a lower end edge of the first blocking wall may vary from one end edge to the other end edge thereof.

The lower end edge of the first blocking wall may comprise a first edge an up-down position of which remains in a first position; and a second edge an up-down position of which remains in a second position, wherein the first edge may be formed closer to one end edge of the first blocking wall than the second edge.

The blocking wall may further comprise a second blocking wall being formed into a curved surface which is convex in a direction father from the notch hole, from one end edge to the other end edge thereof, and is disposed in a position farther from the notch hole than the first blocking wall.

Further, an up-down position of a lower end edge of the second blocking wall may be higher that the up-down position of the lower end edge of the first blocking wall.

The up-down position of the lower end edge of the second blocking wall may remain constant from one end edge to the other end edge of the second blocking wall.

The second blocking wall may have a thickness that remains uniform from one end edge to the other end edge thereof.

The other end edge of the second blocking wall may be disposed closer to the rear edge of the notch hole than the other end edge of the first blocking wall, with respect to the front-rear direction.

The lower guide may comprise: a duct coupling part which connects to the dry air supply part an upper end of which is exposed to the inner flow space and which has a cylindrical shape; and a channel guide surface that guides dry air having passed through the duct coupling part toward the discharge opening, wherein the lower end edge of the first blocking wall and the lower end edge of the second blocking wall may extend toward the channel guide surface.

The lower guide may further comprise a division wall that protrudes upward from an upper end of the duct coupling part, and an up-down position of the division wall may remain constant.

The up-down position of the lower end edge of the second blocking wall may be lower than the up-down position of of the upper end of the division wall.

Advantageous Effects

A dishwasher according to the present disclosure has the effects of distributing dry air evenly and ensuring a period for which dry air remains in a tub sufficiently, thereby improving drying efficiency and decrease a drying period.

The dishwasher according to the present disclosure has the effect of preventing wash water from coming in reversely through a discharge opening that is exposed directly to a wash space.

The dishwasher according to the present disclosure has the effect of preventing wash water flowing into an airflow guide from coming into a dry air supply part.

The dishwasher according to the present disclosure has the effect of simplifying an assembly structure and a fixation structure of the airflow guide spraying dry air, thereby ensuring the simplification of assembly and fixation processes of the dry air supply part.

The dishwasher according to the present disclosure has the effect of preventing a change in a predetermined position of the discharge opening through a means of preventing misassembly between an upper guide and a lower guide that constitute the airflow guide.

The dishwasher according to the present disclosure has the effect of preventing the airflow guide from being released or escaping from a predetermined position after the airflow guide is assembled and fixed to the dry air supply part, through a simple structure.

The dishwasher according to the present disclosure has the effect of preventing the airflow guide from escaping from its right position or being damaged due to an external impact after the airflow guide is assembled and fixed to the dry air supply part.

The dishwasher according to the present disclosure has the effect of preventing wash water from remaining between a fastening nut and the tub by exposing the lower end surface of the fastening nut to the wash space, effectively preventing the corrosion of the tub and a dry air supply hole and preventing the reproduction of germs and the generation of a bad smell between the tub and the fastening nut.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
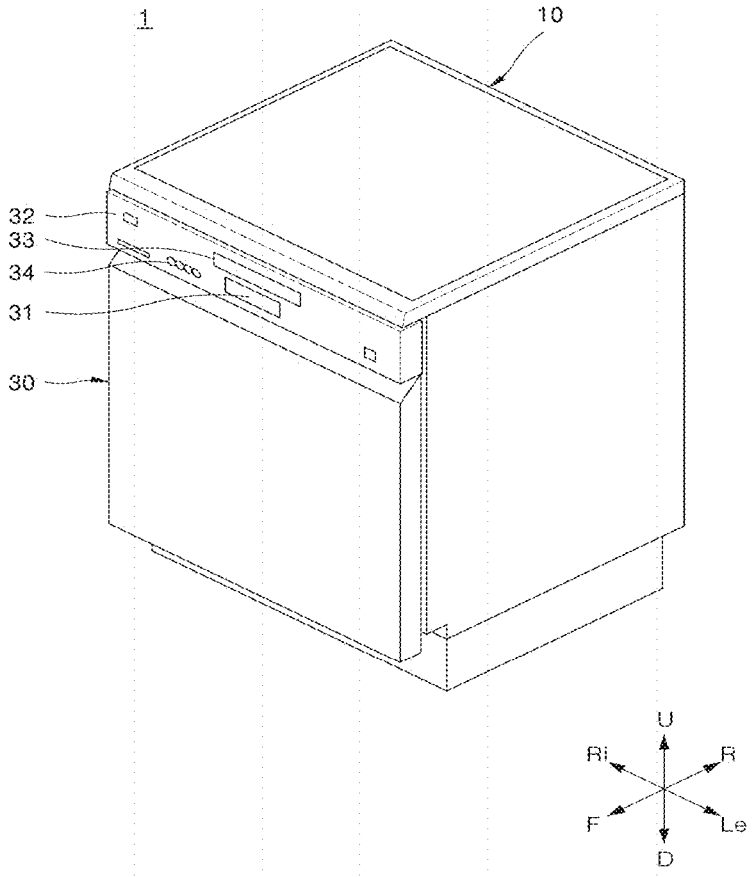
FIG. 1 is front perspective view showing a dishwasher of one embodiment.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Below, preferred embodiments according to the disclosure are specifically described with reference to accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

Throughout the disclosure, each component can be provided as a single one or a plurality of ones, unless explicitly stated to the contrary.

When one component is described as being "in the upper portion (or lower potion)" or "on (or under)" another component, one component can be directly on (or under) another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereafter, the subject matter of the present disclosure is described with reference to the drawings showing the configuration of the dishwasher 1 of the embodiment.

[Entire Structure of Dishwasher]

Hereafter, the entire structure of the dishwasher of one embodiment is describer with reference to the accompanying drawings.

Figure 2:
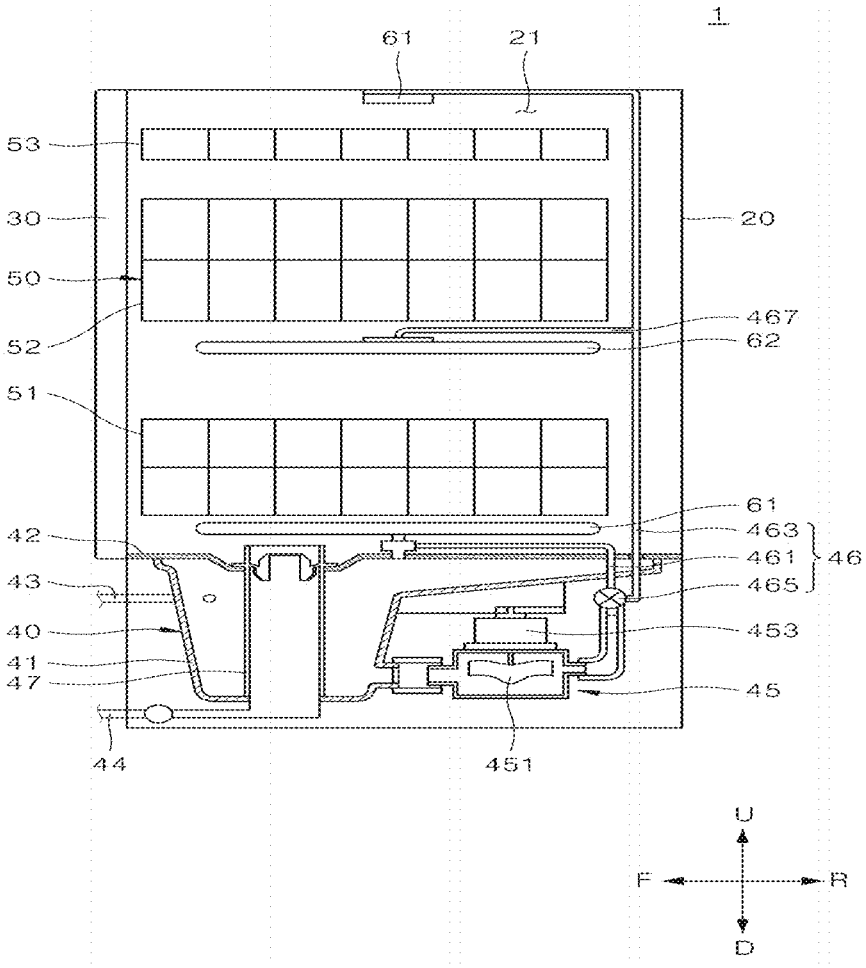
FIG. 2 is a schematic cross-sectional view showing the dishwasher in FIG. 1.

FIG. 1 is a front perspective view showing a dishwasher according to the present disclosure, and FIG. 2 is a schematic cross-sectional view schematically showing the inner structure of the dishwasher according to the present disclosure.

As illustrated in FIG. 1 to 2, the dishwasher 1 according to the present disclosure comprises a case 10 forming the exterior of the dishwasher 1, a tub 20 being installed in the case 10, forming a wash space 21 in which a wash target is washed and having a front surface that is open, a door 30 opening and closing the open front surface of the tub 20, a driving part 40 being disposed under the tub 20 and supplying, collecting, circulating and draining wash water for washing a wash target, a storage part 50 being provided detachably in the wash space 21 in the tub 20 and allowing a wash target to be mounted on, and a spray part 60 being installed near the storage part 50 and spraying wash water for washing a wash target.

At this time, wash targets mounted in the storage part 50 may be cooking vessels such as bowls, dishes, spoons, chopsticks, and the like, and other cooking tools, for example. Hereafter, the wash targets are referred to as cooking vessels, unless mentioned otherwise.

The tub 20 may be formed into a box the front surface of which is open entirely, and may be a so-called tub.

The tub 20 may have a wash space 21 therein, and its open front surface may be opened and closed by the door 30.

The tub 20 may be formed in a way that a metallic sheet having strong resistance against high-temperature and moisture, e.g., a stainless steel-based sheet, is pressed.

Additionally, a plurality of brackets may be disposed on the inner surfaces of the tub 20 and allow functional components such as a storage part 50, a spray part 60 and the like, which are described below, to be supported and installed in the tub 20.

The driving part 40 may comprise a sump 41 storing wash water, a sump cover 42 distinguishing the sump 41 from the tub 20, a water supply part 43 supplying wash water to the sump 41 from the outside, a drain part 44 discharging wash water of the sump 41 to the outside, and a water supply pump 45 and a supply channel 46 for supplying wash water of the sump 41 to the spray part 60.

The sump cover 42 may be disposed at the upper side of the sump 41, and distinguish the sump 41 from the tub 20. Additionally, the sump cover 42 may be provided with a plurality of return holes for returning wash water, having sprayed to the wash space 21 through the spray part 60, to the sump 41.

That is, wash water having sprayed toward cooking vessels from the spray part 60 may fall to the lower portion of the wash space 21 and return to the sump 41 through the sump cover 42.

The water supply pump 45 is provided in a lateral portion or the lower portion of the sump 41, and pressurizes wash water and supplies the same to the spray part 60.

One end of the water supply pump 45 may connect to the sump 41, and the other end may connect to the supply channel 46. The water supply pump 45 may have an impeller 451, a motor 453 and the like, therein. As power is supplied to the motor 453, the impeller 451 may rotate, and wash water of the sump 41 may be pressurized and then supplied to the spray part 60 through the supply channel 46.

The supply channel 46 may selectively supply the wash water supplied by the water supply pump 45 to the spray part 60.

For example, the supply channel 46 may comprise a first supply channel 461 connecting to a lower spray arm 61, and a second supply channel 463 connecting to an upper spray arm 62 and a top nozzle 63. The supply channel 46 may be provided with a supply channel diverting valve 465 selectively opening and closing the supply channels 461, 463.

At this time, the supply channel diverting valve 465 may be controlled to allow each of the supply channels 461, 463 to be opened consecutively or opened simultaneously.

The spray part 60 is provided to spray wash water to cooking vessels and the like stored in the storage part 50.

Specifically, the spray part 60 may comprise a lower spray arm 61 being disposed under the tub 20 and spraying wash water to a lower rack 51, an upper spray arm 62 being disposed between the lower rack 51 and an upper rack 52 and spraying wash water to the lower rack 51 and the upper rack 52, and a top nozzle 63 being disposed in the upper portion of the tub 20 and spraying wash water to a top rack 53 or the upper rack 52.

In particular, the lower spray arm 61 and the upper spray arm 62 may be provided in the wash space 21 of the tub 20, and spray wash water toward cooking vessels in the storage part 50 while rotating.

The lower spray arm 61 may be rotatably supported at the upper side of the sump cover 42 such that the lower spray arm 61 may spray wash water to the lower rack 51 while rotating under the lower rack 51.

Additionally, the upper spray arm 62 may be rotatably supported by a spray arm holder 467 such that the upper spray arm 62 may spray wash water while rotating between the lower rack 51 and the upper rack 52.

The tub 20 may be further provided with a reflection plate on a lower surface 25 thereof, to enhance washing efficiency, and the reflection plate diverts the direction of wash water having sprayed from the lower spray arm 61 to an upward direction (U-direction).

Since a well-known configuration can be applied to the configuration of the spray part 60, detailed description of the configuration of the spray part 60 is omitted hereafter.

The storage part 50 for storing cooking vessels may be provided in the wash space 21.

The storage part 50 may be withdrawn through the open front surface of the tub 20 from the inside of the tub 20.

For example, FIG. 2 shows an embodiment provided with a storage part comprising a lower rack 51 that is disposed in the lower portion of the tub 20 and stores relatively large-sized cooking vessels, an upper rack 52 that is disposed at the upper side of the lower rack 51 and stores medium-sized cooking vessels, and a top rack 53 that is disposed in the upper portion of the tub 20 and stores small-sized cooking vessels and the like. However, the subject matter of the present disclosure is not limited to the embodiment. Hereafter, a dishwasher that is provided with three storage parts 50, as illustrated, is described.

Each of the lower rack 51, the upper rack 52 and the top rack 53 may be withdrawn outward through the open front surface of the tub 20.

To this end, the tub 20 may have a guide rail 54, on both lateral walls thereof that form the inner circumferential surface of the tub 20, and for example, the guide rail 54 may comprise an upper rail 541, a lower rail 542, a top rail 543 and the like.

Each of the lower rack 51, the upper rack 52 and the top rack 53 may be provided thereunder with wheels. A user may withdraw the lower rack 51, the upper rack 52 and the top rack 53 outward through the front surface of the tub 20 to easily store cooking vessels on the racks or take out cooking vessels from the racks after a washing process.

The guide rail 54 may be provided as a fixed guide rail that guides the withdrawal and insertion of the spray part 60 in the form of a simple rail or as a stretchable guide rail which guides the withdrawal and storage of the spray part 60 and the withdrawal distance of which increases as the spray part 60 is withdrawn.

The door 30 is used for opening and closing the open front surface of the tub 20 that is described above.

Ordinarily, a hinge part (not illustrated) for opening and closing the door 30 is provided in the lower portion of the open front surface, and the door 30 is open with respect to the hinge part as a rotation axis.

The door 30 may be provided with a handle 31 and a control panel 32 on the outer surface thereof. The handle 31 is used for opening the door 30, and the control panel 32 is used for controlling the dishwasher 1.

As illustrated, the control panel 32 may be provided with a display 33 that visually displays information on a current operation state and the like of the dishwasher, and a button part 34 comprising a selection button to which the user's selection manipulation is input, a power button to which the user's manipulation for turning on-off the power source of the dishwasher is input, and the like.

The inner surface of the door 30 may form a mounting surface that supports the lower rack 51 of the storage part 50 as the door 30 is opened as well as forming one surface of the tub 20 as the door 30 is closed.

To this end, as the door 30 is fully opened, the inner surface of the door 30 forms a horizontal surface in the same direction where the guide rail 54, by which the lower rack 51 is guided, extends, for example.

The door 30 may be provided rotatably between a closed position and a fully-open position, and an intermediate still position may be formed between the closed position and the fully open position.

The door 30 may stand still in the intermediate still position, and at this time, the wash space 21 of the tub 20 may be open outward partially. When the door 30 is disposed at the intermediate still position, a dry air supply part 80 described hereafter may operate to supply high-temperature dry air or low-temperature dry air to the wash space 21.

Though not illustrated, the dry air supply part 80 may be provided in the lower portion of the tub 20 and generate high-temperature dry air and supply the high-temperature dry air into the tub 20.

Hereafter, a detailed configuration of the dry air supply part 80 is described with reference to FIG. 3

[Detailed Configuration of Dry Air Supply Part]

Hereafter, the detained configuration of the above-described dry air supply part 80 is described with reference to FIGS. 3 to 7.

Figure 3:
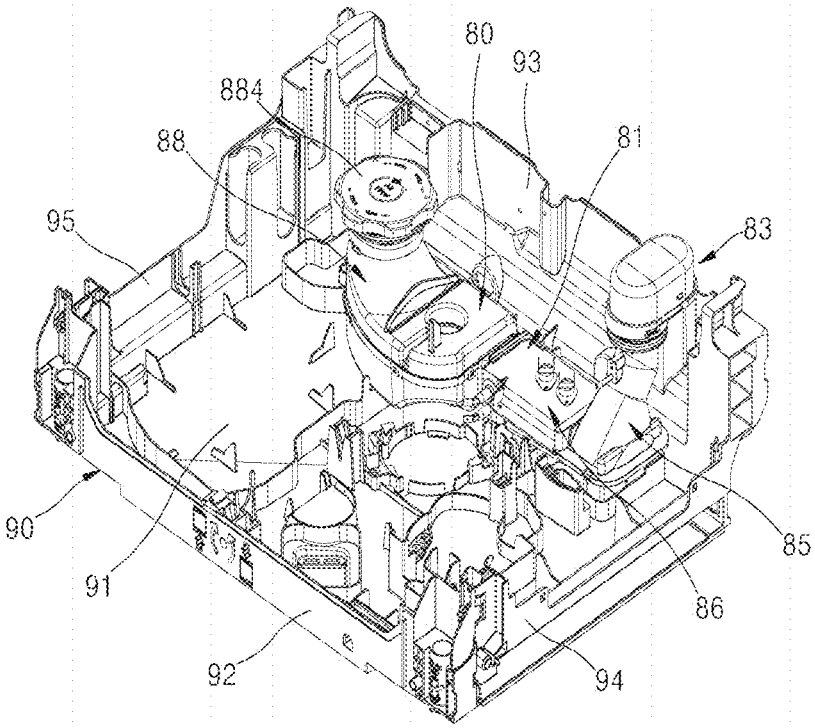
FIG. 3 is a front perspective view showing a dry air supply part of the dishwasher of one embodiment, which is accommodated in a base.

As illustrated in FIG. 3, the dry air supply part 80 may be accommodated in a base 90 and may be disposed to be supported by a lower surface 91 of the base 90.

For example, the dry air supply part 80 may be disposed in a position adjacent to a rear surface 93 of the base 90, and disposed in a position between a leakage detecting part and the rear surface 93 of the base 90, approximately in parallel with the rear surface 93 of the base 90.

The position in which the dry air supply part is disposed may be selected considering the characteristics of the dry air supply part 80 that generates heat of about 100° C. or greater in a high-temperature dry air supply mode. That is, the dry air supply part may be disposed to avoid electronic components that are greatly affected by high-temperature heat.

Additionally, the arrangement position of the dry air supply part may be selected based on the position of a dry air supply hole 254 formed on the lower surface 25 of the tub 20. That is, considering the user's safety, the dry air supply hole 254 into which dry air flows may be formed at the corner of the lower surface 25 of the tub 20, which is adjacent to the rear surface and the left side surface of the tub 20.

For the dry air supply part 80 to effectively generate dry air and supply the same to the dry air supply hole 254 formed in the above-described position, the dry air supply part 80 may be disposed at the lower side of the dry air supply hole 254.

The arrangement position of the dry air supply part 80 is described exemplarily. The dry air supply part 80 may be disposed near a left side surface 94, a right side surface 95 or a front surface 92 of the base 90 rather than the rear surface 93 of the base 90. Hereafter, the dry air supply part 80 disposed near the rear surface 93 of the base 90 approximately in parallel with the rear surface 93 is described, but the position of the dry air supply part 80 is not limited.

Additionally, a support rib (not illustrated) for supporting the dry air supply part 80 and preventing the escape of the dry air supply part 80, a plurality of guide ribs (not illustrated) setting the position of a leakage detecting part (not illustrated) that detects whether wash water leaks from the tub 20 and preventing the escape of the leakage detecting part (not illustrated), and a wash water rib (not illustrated) for guiding wash water being discharged from the dry air supply part 80 to the leakage detecting part may be provided on the lower surface 91 of the base 90.

The support rib, the guide ribs and the wash water rib may be formed integrally on the lower surface 91 of the base 90, for example.

A first leg, a second leg 892 and a third leg 893 of the dry air supply part 80 described hereafter may be coupled to the support rib, based on a non-fastening method. That is, the first leg, the second leg 892 and the third leg 893 may be simply held at the support rib without an additional fastening means such that the dry air supply part 80 may be supported in up-down, front-rear and left-right directions.

Figure 4:
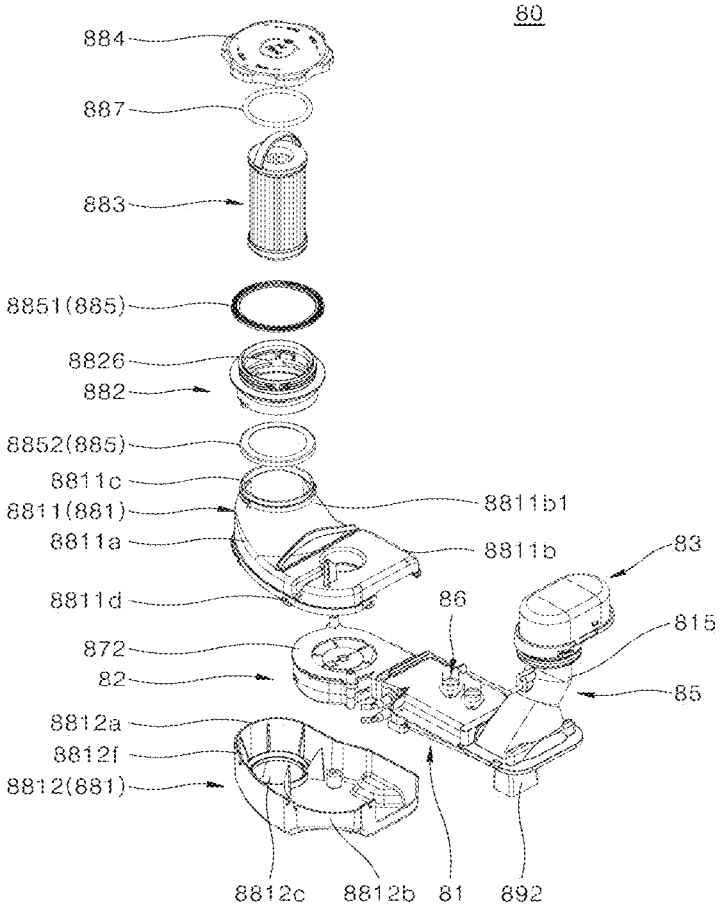
FIG. 4 is an exploded perspective view showing the dry air supply part in FIG. 3.
Figure 5:
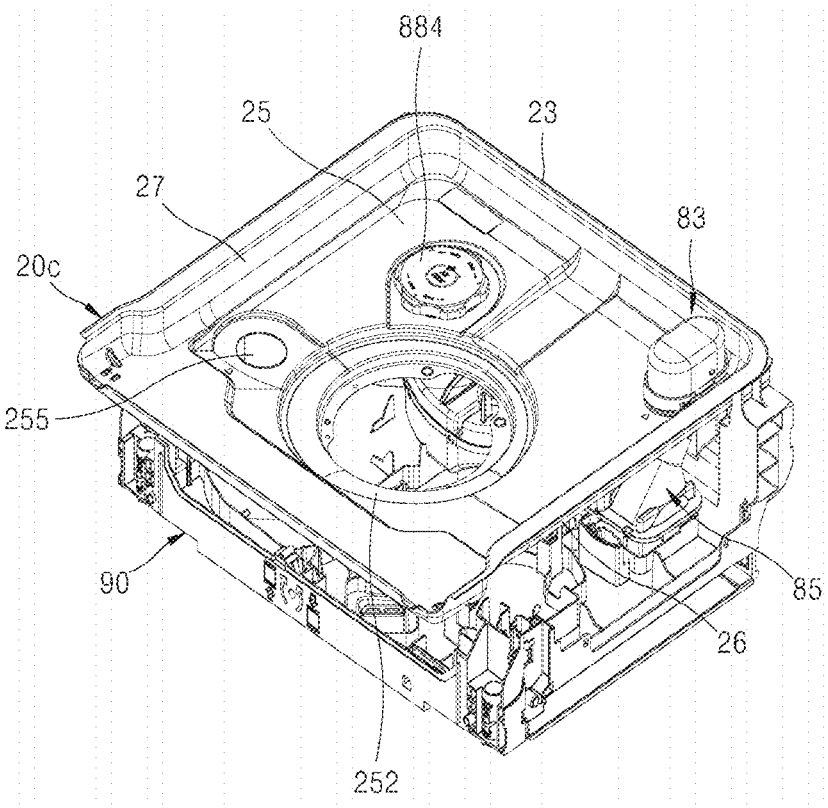
FIGS. 5 and 6 are front perspective views showing a bottom tub coupled to the dry air supply part in FIG. 3.
Figure 6:
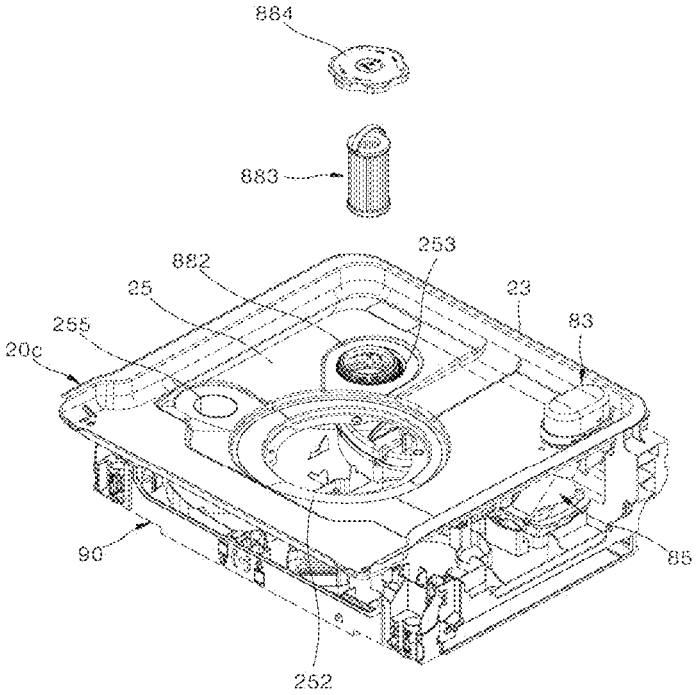
Figure 7:
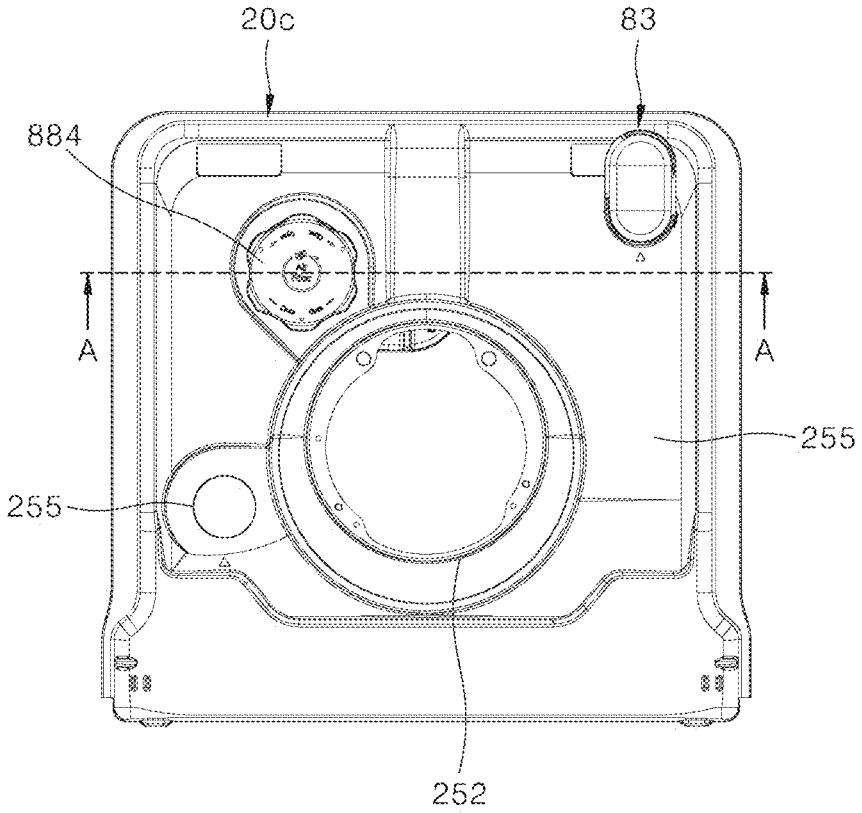
FIG. 7 is a plan view of FIG. 5.

FIG. 4 shows a detailed configuration of the dry air supply part 80.

As illustrated, the dry air supply part 80 generating dry air and supplying the same into the tub 20 may comprise an air blowing fan that generates dry airflow F to be supplied into the tub 20, a heater that heats dry air, a heater housing 81 that has an air passage in which the heater is accommodated, and a filtering part 88 that filters air to be suctioned into the air blowing fan.

The air blowing fan (not illustrated) is disposed at the upstream side in the direction of dry airflow F with respect to the heater and the heater housing 81, and accelerates air to the air passage formed in the heater housing 81 to generate dry airflow F.

The air blowing fan, and an air blowing motor generating rotational driving force of the air blowing fan may be mutually modularized, and form an assembly in a way that the air blowing fan and the air blowing motor are accommodated in a fan housing 82.

The air blowing fan and the fan housing 82 may be fixed to a housing connector 87 that connects a filer housing 881 of the below-described filtering part 88 and the heater housing 81.

Specifically, the air blowing fan and the fan housing 82 may be accommodated entirely in the filter housing 881 in the state of being fixed to a connection tab 872 the housing connector 87.

The type of the air blowing fan to be applied to the dry air supply part 80 is not limited, but a sirocco fan, for example, is preferred considering the position and space limitations in the installation of the air blowing fan.

When a sirocco fan is applied as illustrated, filtered air may be suctioned from a lower surface of the fan housing 82, in a direction parallel a direction from the center of the sirocco fan to the rotational axis of the same, and be accelerated and discharged outward in the radial direction.

The accelerated and discharged air may form dry airflow F and be drawn into the air passage in the heater housing 81 through the fan housing 82 and an inlet 8712 of the housing connector 97.

At this time, the air blowing fan, e.g., a sirocco fan, and a rotation shaft 8251 of the motor may be disposed to have directionality approximately parallel with the up-down direction (U-D direction), and filtered air may be suctioned through the lower surface of the fan housing 82, for example.

Further, a PCB substrate for controlling the moor may be built into an upper surface 821 of the fan housing 82, which corresponds to the opposite side of the lower surface into which filtered air is suctioned.

The fan housing 82, as illustrated, may be fixed to a ring-type connection tab 872 provided at the housing connector 87 through a fastening means such as a screw bolt that is not illustrated, and the like, for example.

The connection tab 872 may be provided with a pair of fastening bosses that extend from the upper surface of the connection tab 872 in the upward direction (U-direction).

To support the fan housing 82 and the heater housing 81, the first leg protruding toward the base may be integrally formed under the housing connector 87.

The heater may be indirectly supported in the state of separating from the heater housing 81 and a connector main body 871.

The front end side of the heater may be supported by a terminal fixation part, in the state of separating from the housing connector 87. A c may be fixed to the front surface of the terminal fixation part, in the state of protruding outward.

An entirely-open rear end portion 871*b* of the housing connector 87 may be fixed while being fitted and coupled to the heater housing 81.

The heater (not illustrated) is disposed in the air passage formed in the heater housing 81, and preferably, is directly exposed to dry airflow F in the air passage and heats the dry airflow F.

When the dry air supply part 80 supplies high-temperature dry air, power may be supplied to the heater, and the heater may heat dry air, and when the dry air supply part 80 supplies low-temperature dry air, the supply of power to the heater may be cut off, and the heater may stop operating.

At this time, when low-temperature dry air is supplied, the air blowing motor may keep operating to generate dry airflow F.

The type of the heater provided in the dry air supply part 80 of one embodiment is not limited, but a tube-type sheath heater may be selected since the sheath heater has a relatively simple structure, ensures excellent heat generation efficiency and helps to prevent electric leakage caused by the reverse inflow of wash water that comes in from the tub 20 reversely, for example.

To enhance heat exchange efficiency, the heater that is a sheath heater may have a stereoscopic shape with a plurality of bends, to be directly exposed to dry airflow F at the air passage in the heater housing 81 and ensure a maximum heat transfer surface.

Additionally, a pair of terminals for receiving power may be formed in one end portion and the other end portion of the heater.

The rear end side of the heater may be fixed and supported by a single heater bracket 845 disposed in the heater housing 81. That is, the rear end side of the heater may be supported on the air passage through the heater bracket 845 in the state of being separated from the heater housing 81.

Further, a temperature sensor as a temperature sensing part 86 sensing the temperature of high-temperature dry air generated through the heater or detecting the overheating of the heater may be provided on the upper side surface of the heater housing 81.

For example, the temperature sensor may comprise a thermistor that senses the temperature of dry air, and a thermostat that detects the overheating of the heater.

An output signal of the temperature sensor may be delivered to a non-illustrated controller, and the controller may receive the output signal of the temperature sensor to determine the temperature of high-temperature dry air and the overheating of the heater. As the heater overheats, the controller may cut off the supply of power to the heater and change the operation mode of the dry air supply part 80 from the high-temperature dry air supply mode to the low-temperature dry air supply mode.

The heater housing 81 may be formed into a hollow hole that has a vacant inner space such that the air passage, in which the above-described heater and heater bracket 845 are disposed, is formed.

At this time, for dry airflow F to move, the front end portion of the heater housing 81, corresponding to the upper stream side with respect to the direction of the movement of the dry airflow F. and the rear end portion of the heater housing 81, corresponding to the lower stream side with respect to the direction of the movement of the dry airflow F, may be open at least partially.

The dry air supply part 80 may further comprise a connection duct part 85 that is coupled to an outlet, formed at the left end side of the heater housing 81 and being open in the upward direction (U-direction), and has an air passage therein.

As described above, the heater housing 81 and the air blowing fan are disposed under the lower surface 25 of the tub 20, e.g., a bottom tub 20*c*. The connection duct part 85 guides dry air being discharged from the heater housing 81 to a predetermined position, i.e., the dry air supply hole 254 formed at the tub 20.

For example, the predetermined position may be the lower surface 25 of the tub 20, and the dry air supply hole 254 into which dry airflow F guided to the connection duct part 85 is drawn may be formed at a corner of the lower surface 25 of the tub 20, which is adjacent to a rear surface 23 and a left side surface 26.

As shown in the illustrative embodiment, a duct main body 851 of the connection duct part 85 may have a shape that is capable of changing the direction of dry airflow and connecting the dry air supply hole 254 of the tub 20 and the outlet of the heater housing 81.

For example, the duct main body 851 of the connection duct part 85 may have a cylinder shape that allows of the fluid communication of a lower end portion 8512 with the outlet of the heater housing 81 and allows an upper end 8511 to extend in the upward direction (U-direction) and connect to the dry air supply hole 254.

The lower end portion 8512 of the duct main body 851 may be coupled the heater housing 81 in a sliding manner.

Further, considering the cross section of the rectangle-shaped outlet of the heater housing 81, the lower end portion of the duct main body 851 may have a rectangle pillar shape, and for the prevention of leakage, the upper end 8511 of the duct main body 851 may have a cylinder shape.

That is, the duct main body 851 may have a cylinder shape to improve the efficiency of a coupling between the upper end 8511 of the duct main body 851 and the dry air supply hole 254 of the tub 20 and to prevent leakage.

An air flow guide 83 may be coupled to the upper end 8511 of the duct main body 851 and divert the direction of dry airflow being supplied through the duct main body 851 to supply the dry airflow to the wash space.

The filtering part 88 may be disposed in the upper stream of the heater with respect to the direction of the flow of dry airflow, to filter air to be suctioned into the air blowing fan and supply the filtered air to the heater.

Specifically, the filtering part 88 may comprise a filter member 883 that filters air to be suctioned into the air blowing fan, and a hollow hole-type filter housing 881 that has a filter accommodation space S1 in which the filter member 883 is disposed in a replaceable manner and a fan housing accommodation space S2 in which the fan housing 82 is disposed.

As illustrated in FIG. 4, the filter housing 881 may comprise a first housing 8811 and a second housing 8812 that are disposed in the form of a segment body that is segmented with respect to the up-down direction (U-D direction), for example. At this time, the first housing 8811 may be the upper housing, and the second housing 8812 may be the lower housing.

The filter housing 881 accommodates and supports the filter member 883 and the fan housing 82 of the air blowing fan.

Accordingly, the first housing 8811 may be divided into a filter accommodation part 8811*a* and a fan housing accommodation part 8811*b* such that the first housing 8811 accommodates and supports the filter member 883 and the fan housing 82 at least partially, preferably, accommodates and supports the upper portion of the filter member 883 and the upper portion of the fan housing 82.

As illustrated, the lower surfaces of the filter accommodation part 8811*a* and the fan housing accommodation part 8811*b* of the first housing 8811 are open entirely to allow the second housing 8812 to be coupled to the lower sides of the filter accommodation part 8811*a* and the fan housing accommodation part 8811*b* of the first housing 8811.

The filter accommodation part 8811*a* may be formed further upstream than the fan housing accommodation part 8811*b* with respect to the direction of the flow of dry airflow, and in the illustrative embodiment, formed on the right of the fan housing accommodation part 8811*b*.

The filter accommodation part 8811*a*, for example, may have an outer shape of a partial cylinder to accommodate the filter member 883 having a cylinder shape in a way that the filter member 883 may be inserted and withdrawn when the filter member 883 is replaced.

Additionally, a filter guide rib may be integrally provided in the filter accommodation part 8811*a* and have a shape similar to that of a filter guide rib 8812*f* of the second housing 8812 described hereafter.

The filter accommodation part 8811*a* may have a coupling opening 8811*c* at the upper end thereof, and the coupling opening 8811*c* is open in the form of a circle in response to the outer shape of the filter member 883. The filter member 883 may move downward through the coupling opening 8811*c*, and move to a filter accommodation part 8812*a* of the second housing 8812.

The fan housing accommodation part 8811*b* may be formed further downstream than the filter accommodation part 8811*a* with respect to the direction of the flow of dry airflow, and in the illustrative embodiment, formed integrally at the filter accommodation part 8811*a*, on the right of the filter accommodation part 8811*a*, near the heater housing 81.

The fan housing accommodation part 8811*b* may have an inner shape corresponding to the outer shape of the upper portion of the fan housing 82, to cover the upper portion of the air blowing fan entirely. For example, the fan housing accommodation part 8811*b* may have an upper surface formed into a flat plate.

As illustrated, the upper surface of the first housing 8811 may have an inclined surface 8811*b*1 that connects the upper end of the filter accommodation part 8811*a* and the fan housing accommodation part 8811*b*.

The second housing 8812 of the filter housing 881 is coupled to the lower portion of the first housing 8811 and forms a sealed accommodation space, and accommodates and supports the lower portions of the filter member 883 and the fan housing 82.

Like the first housing 8811, the second housing 8812 may be divided into a filter accommodation part 8812*a* and a fan housing accommodation part 8812*b*, to accommodate and support the lower portion of the filter member 883 and the lower portion of the fan housing 82.

As illustrated, the upper end of the second housing 8812 may be open entirely to be coupled to the lower end of the first housing 8811.

In response to the filter accommodation part 8811*a* of the first housing 8811, the filter accommodation part 8812*a* of the second housing 8812, provided under the filter accommodation part 8811*a* of the first housing 8811, may be provided with a plurality of filter guide ribs that guides the filter member 883's movement and prevents the filter member 883's escape from the right position at a time of inserting the filter member 883.

Additionally, in response to the filter member 883's outer shape formed into a cylinder, the plurality of filter guide ribs may be arranged and disposed radially around the filter member 883.

As the center of the plurality of filter guide ribs 8812*f*, a lower suction opening 8812*c* may be formed on the bottom surface of the filter accommodation part 8812*a* in a penetrating manner, and is open toward the lower surface of the base 90 and allows external air to be suctioned.

The lower suction opening 8812*c* may have a circle shape to correspond to the shape of a lower opening of the filter member 883 having a cylinder shape, and a relative position and size of the lower suction opening 8812*c* may be determined to allow external air to pass through the lower opening and to be smoothly suctioned into the filter member 883.

Additionally, as one airtight means, a pair of ring-type ribs may be formed around the lower suction opening of the bottom surface of the second housing 8812, and prevent non-filtered external air to be leaked and suctioned into the inner space of the filter housing 881 directly.

The fan housing accommodation part 8812*b* may be formed further downstream than the filter accommodation part 8812*a* with respect to the direction of the flow of dry airflow, and in the illustrative embodiment, formed integrally at the filter accommodation part 8812*a*, on the right of the filter accommodation part 8812*a*, near the heater housing 81.

The fan housing accommodation part 8811*b* may have an inner shape corresponding to the outer shape of the lower portion of the fan housing 82, to cover the lower portion of the air blowing fan entirely.

The bottom surface of the fan housing accommodation part 8811*b* may be spaced a predetermined distance apart from the lower surface of the fan housing 82, to allow filtered air to be suctioned effectively, and for example, be formed into a flat surface in a direction parallel with the horizontal direction.

As a means of spacing the fan housing 82 apart from the bottom surface of the fan housing accommodation part 8811*b* and supporting the fan housing 82, a plurality of uplifted surface parts and a screw boss that protrude from the bottom surface may be provided in the fan housing accommodation part 8812*b*.

In the first housing 8811 and the second housing 8812 that are disposed in the form of a segment body as described above, the lower end of the first housing 8811 and the upper end of the second housing 8812 may be detachably coupled to each other.

To achieve the above-described detachable coupling relationship, a fastening tab 8811*d* extending toward the second housing 8812 is provided at the lower end of the first housing 8811, and a hook projection 8812*d* may be provided at the upper end of the second housing 8812 and fastened to the fastening tab 8811*d* based on a hook coupling.

A tub connection duct 882 may be detachably coupled and fastened to the coupling opening 8811*c* of the filter accommodation part 8811*a* of the first housing 8811.

The filter member 883 may be replaced through a lower surface 25 of the tub 20.

To this end, the filter accommodation part 8811*a* of the first housing 8811 needs to connect to the lower surface 25 of the tub 20, and the tub connection duct 882 connects the lower surface 25 of the tub 20 and the filter accommodation part 8811*a* of the first housing 8811.

The tub connection duct 882 may be integrally provided at the filter accommodation part 8811*a* of the first housing 8811. The tub connection duct 882 may be provided additionally in the first housing 8811, as illustrated.

Like the duct main body 851 of the above-described connection duct part 85, an upper end portion 8821 of the tub connection duct 882 may pass through the lower surface 25 of the tub 20 and extend upward.

A filter replacement hole 253 (FIG. 11) may be provided on the lower surface 25 of the tub 20 to allow the upper end portion 8821 of the tub connection duct 882 to be inserted.

A sump hole 252 on which a sump 41 is mounted may be provided in the central portion of the lower surface 25 of the tub 20. The lower surface 25 of the tub 20 may have a convergence surface having an inclination angle at which the convergence surface gradually inclines downward toward the sump hole 252, to allow wash water to be effectively converged on the sump hole 252.

As illustrated, the filter replacement hole 253 may be formed on the convergence surface, at the rear of the sump hole 252.

To distinguish the filter replacement hole 253 from the dry air supply hole 254, the filter replacement hole 253 may be formed at the corner adjacent to the rear surface and the right side surface, on the lower surface 25 of the tub 20. Additionally, to easily insert and withdraw the filter member 883 for replacement, the filter replacement hole 253 may be disposed closer to the front surface of the tub 20 than the dry air supply hole 254 and disposed further rearward than a water softener communication hole 255.

The water softener communication hole 255 formed in front of the filter replacement hole 253, for example, may be used to insert a water softening agent into a water softener (not illustrated) provided under the water softener communication hole 255, and the like, or used for the replacement and maintenance and repairs of another component such as a purification filter (not illustrated) of a water supply part, and the like.

The filter replacement hole 253 may be disposed between the water softener communication hole 255 and the dry air supply hole 254 with respect to the front-rear direction or the left-right direction.

That is, the filter replacement hole 253 may be disposed outside a virtual extension line that connects the water softener communication hole 255 and the dry air supply hole 254.

By doing so, even if the lower surface 25 of the tub 20 has a plurality of openings, the strength, torsional rigidity and flexural rigidity of the tub 20 may not decrease.

Additionally, to distinguish the filter replacement hole 253 from the water softener communication hole 255 formed in front of the filter replacement hole 253, a sealing cap 884 having a different shape or color from the water softener communication hole 255 may be applied at the upper end of the tub connection duct 882 that passes through the filter replacement hole 253 and is exposed to the wash space.

As described above, the filter replacement hole 253 is provided on the convergence surface provided on the lower surface 25 of the tub 20. Thus, the tub connection duct 882's upper end portion and flange coupled to the filter replacement hole 253 may have a predetermined inclination angle with respect to the perpendicular direction in response to the inclination angle of the convergence surface of the tub 20, i.e., may be formed to incline with respect to the perpendicular direction.

A first gasket 885 may be further provided between the flange 8823 of the tub connection duct 882 and the lower surface 25 of the tub 20, to prevent a fastening nut 886 from loosening and prevent leakage.

As the tub connection duct 882 is fixed to the lower surface 25 of the tub 20 through the fastening nut 886, the sealing cap 884 may be coupled to the upper end portion 8821 of the tub connection duct 882 exposed to the inside of the tub 20. At this time, an airtight ring 887 for preventing leakage may be disposed between the sealing cap 884 and the upper end portion 8821 of the tub connection duct 882.

Additionally, an upper suction opening 8826 into which external air is suctioned may be formed under the flange corresponding to the upper side of the filter accommodation space S1, between the upper end portion and a lower end portion of the tub connection duct 882, in a penetrating manner.

The upper suction opening 8826 may be formed in a way that penetrates the cylinder-type tub connection duct 882 from the inner circumferential surface thereof to the outer circumferential surface thereof. For example, the upper suction opening 8826 may be provided as a plurality of penetration openings arranged and formed along the circumferential direction of the tub connection duct 882.

The upper suction opening 8826 may be formed higher than an upper opening of the filter member 883, in the state where the filter member 883 is disposed in the filter accommodation space S1. Accordingly, the upper suction opening 8826 may be formed between the tub 20 and the upper surface of the filter member 883 with respect to the up-down direction.

After external air having passed through the upper suction opening 8826 in a direction parallel with the horizontal direction enters into the filter member 883, the direction of the airflow changes, and the external air may be filtered w % bile passing through the outer circumferential surface of the filter member 883.

Figure 8:
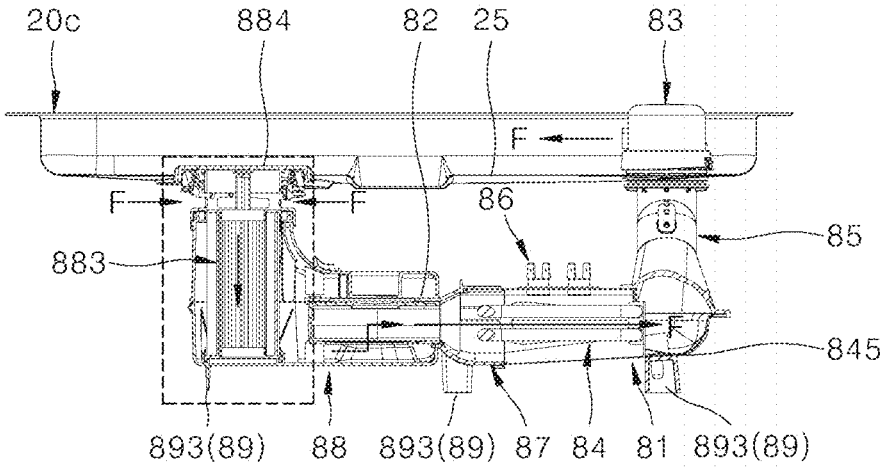
FIG. 8 is a cross-sectional view along A-A in FIG. 7.

The suction path of external air and the flow path of dry airflow having passed through the filter member 883 are described hereafter with reference to FIG. 8.

[Air Flow Path Before and After Filtering]

Hereafter, the flow path of external air before the external air passes through the filter member 883 of the dishwasher 1 of one embodiment, and the flow path of dry airflow F after external air passes through the filter member 883 and is filtered are described with reference to FIG. 8.

The first housing 8811 and the second housing 8812 of the filter housing 881 of the dishwasher 1 of one embodiment are spaced from each other in the up-down direction, and in the filter housing 881, external air is suctioned through a plurality of suction openings that are open toward a space between the base 90 and the tub 20.

As described above, the plurality of suction openings may comprise the upper suction opening 8826 provided at the tub connection duct 882, at the upper side of the filter accommodation space S1, and the lower suction opening 8812*c* provided on the bottom surface of the second housing 8812, at the lower side of the filter accommodation space S1.

As described above, the upper suction opening 8826 and the lower suction opening 8812*c* are spaced from each other and disposed respectively in the uppermost position and the lowermost position of the filter housing 881 with respect to the space between the tub 20 and the base 90. Accordingly, in the state where the effect of the flow rate of air suctioned respectively into the upper suction opening and the lower suction opening is minimized, external air may flow into the . . . through the two suction openings, thereby ensuring more flow rate of air required to dry a wash target and spending less time drying a wash target than usual.

As illustrated, the upper suction opening 8826 is open in a direction approximately parallel with the horizontal direction. Accordingly, external air suctioned into the upper suction opening 8826 forms airflow of a direction parallel with the horizontal direction.

The lower suction opening 8812*c* is formed on the bottom surface that extends horizontally. Accordingly, the lower suction opening 8812*c* is open toward the base 90 in a direction parallel with the perpendicular direction, and external air suctioned into the lower suction opening 8812*c* forms airflow of a direction parallel with the perpendicular direction.

External air suctioned through the upper suction opening 8826 may enter into the upper opening of the filter member 883 disposed right under the upper suction opening 8826 in the state where the filter member 883 is disposed in the filter accommodation space S1.

Additionally, external air suctioned through the lower suction opening 8812*c* may enter into the lower opening of the filter member 883 disposed right on the lower suction opening 8812*c* in the state where the filter member 883 is disposed in the filter accommodation space S1.

In the state where the filter member 883 is disposed, an airtight means of preventing non-filtered air from being suctioned into the filter housing 881 may be provided at the upper end side and the lower end side of the filter member 883.

Thus, external air suctioned into the upper suction opening 8826 and the lower suction opening 8812*c* may enter respectively into the upper opening and the lower opening of the filter member 883, without leaking.

Further, in the state where the filter member 883 is disposed in the filter accommodation space S1, the upper opening of the filter member 883 is open toward the lower surface 25 of the tub 20, and the lower opening of the filter member 883 is open toward the lower surface of the base 90. Accordingly, the direction of airflow of external air changes downward while passing through the upper opening, and external air having passed through the lower opening flows upward.

As described above, external air suctioned into the filter member 883 may pass through the filtering material of the filter member 883 and be evenly suctioned entirely in the up-down direction and circumferential direction.

Further, external air suctioned into the inner circumferential surface of the filter member 883 is filtered, and while passing through the outer circumferential surface of the filter member 883, is discharged, and immediately after the discharge, the direction of the flow of the external air changes.

As illustrated in FIG. 8, the direction of the flow of the filtered air having passed through the outer circumferential surface of the filter member 883 may change toward the lower surface of the fan housing 82 that is open toward the bottom surface of the filter housing 881.

The lower surface of the fan housing 82 is disposed in a position spaced upward from the bottom surface, between the lower end and the upper end of the filter member 883. Accordingly, air having passed through the filter member 883 in a position higher than the lower surface of the fan housing 82 flows downward to the lower surface of the fan housing 82, and air having passed through the filter member 883 in a position lower than the lower surface of the fan housing 82 flows upward to the lower surface of the fan housing 82.

Filtered air drawn into the fan housing 82 through the above-described flow path is accelerated by the air blowing fan and then drawn into the housing connector 87 and the inner space of the heater housing 81, such that dry airflow F is formed.

[Detailed Configuration of Airflow Guide]

Hereafter, a detailed configuration of the airflow guide 83 of the dishwasher 1 of one embodiment is described with reference to FIGS. 1 to 9.

Figure 9:
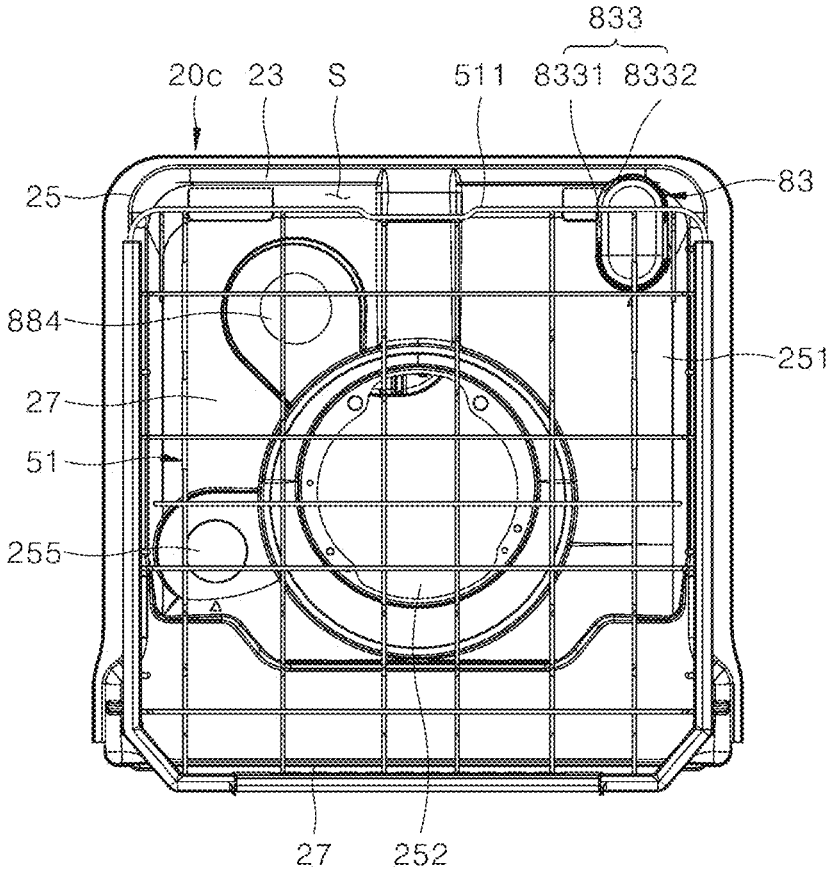
FIG. 9 is a plan view for describing a relative position relationship between a lower rack and a bottom tub with respect to an airflow guide of the dishwasher of one embodiment.

As illustrated in FIG. 9, the airflow guide 83 may be disposed between the lower surface 25 of the bottom tub 20*c* and the lower rack 51, near the lower surface 25 of the bottom tub 20*c*, and divert the direction of the flow of dry airflow F supplied through the duct main body 851.

Specifically, the airflow guide 83 may be disposed near the corner formed between the left side surface 26 and the rear surface 23 of the bottom tub 20*c* or near the corner formed between the right side surface 27 and the rear surface 23 of the bottom tub 20*c*. In response to the position of the airflow guide 83, the above-described dry air supply hole 254 for transferring dry air may be formed on the lower surface 25 of the bottom tub 20*c*.

FIGS. 1 to 9 show that the airflow guide 83 and the dry air supply hole 254 are adjacent to the lower surface 25 of the bottom tub 20*c*, near the corner formed between the left side surface 26 and the rear surface 23 of the bottom tub 20*c*, for example. Hereafter, for convenience, the airflow guide 83 and the dry air supply hole 254, which are disposed near the corner formed between the left side surface 26 and the rear surface 23 of the bottom tub 20*c* as illustrated, are described as an example, but not limited.

The corner formed between the left side surface 26 and the rear surface 23 of the bottom tub 20*c* corresponds to a position farthest from the upper end of the front surface 22 of the tub 20 that is partially open in the drying stage.

Thus, the period for which dry air sprayed from the airflow guide 83 remains in the tub 20 may extend effectively. By doing so, dry air may be supplied to the lower rack 51, the upper rack 52 and the top rack 53 evenly and then discharged through the upper end of the front surface of the tub, enabling thermal energy of the dry air to be transferred to wash targets effectively and significantly promoting the effect of drying the wash targets.

Additionally, since the airflow guide 83 is spaced a predetermined distance apart from the rear surface 23, the lower surface 25 and the left side surface 26 of the bottom tub 20*c*, food and the like may be effectively prevented from being fitted and fixed between the airflow guide 83 and the bottom tub 20*c*.

The period for which dry air remains in the tub 20 may further increase, based on the adjustment of the direction of the spray of dry air from the airflow guide 83.

That is, a discharge opening 833 of the airflow guide 83, from which dry air sprays, may be formed in a position where dry air does not directly spray toward the lower rack 51 and wash targets stored on the lower rack 51.

Specifically, the airflow guide 83 of the dishwasher 1 of one embodiment may discharge dry air in a direction that is not the upward direction (U-direction) perpendicular to the lower surface 25 of the bottom tub 20*c* or the direction in which dry air does not spray directly toward the lower rack 51.

To this end, the discharge opening 833 from which dry air sprays may be formed on the right side surface of the airflow guide 83 to discharge dry air in a direction approximately parallel with the rear surface 23 of the bottom tub 20*c*.

Figure 10:
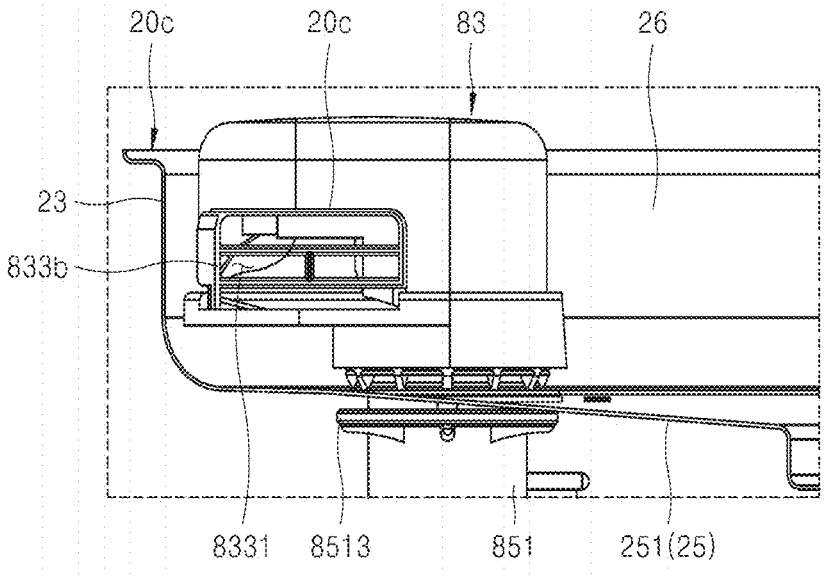
FIG. 10 is a partial enlarged view of FIG. 9 cut in a direction parallel with the front-rear direction.

As illustrated in FIGS. 9 and 10, the front-rear (F-R direction) width of the airflow guide 83 may be greater than the left-right (Le-Ri direction) width in the state where the airflow guide 83 is coupled to the duct main body 851 of the connection duct part 85, and the discharge opening 833 may be formed continuously throughout the right side surface of the the airflow guide 83, facing the right side surface 27 of the bottom tub 20*c*, and the rear surface of the the airflow guide 83. That is, the discharge opening 833 of the airflow guide 83 may have the directionality that does not face the door directly and face the front surface 22 of the tub 22 or the door 30 linearly.

At this time, the discharge opening 833 of the airflow guide 83 may be formed into a slit or have an oblong shape the up-down (U-D direction) height of which is less than the front-rear (F-R direction) length. Additionally, for dry air to spray in a lowermost position, the up-down (U-D direction) height of the discharge opening 833 may remain constant in the front-rear direction (F-R direction).

Additionally, as illustrated, a front edge 833*b* of the discharge opening 833, which is a first side edge, may be formed on the right side surface of the airflow guide 83, having a flat plate shape, and a rear edge 833*a* that is a second side edge may extend to the rear surface of the airflow guide 83, having a curved surface shape. That is, the front edge 833*b* and the rear edge 833*a* of the discharge opening 833 may be spaced from each other, along the direction where an upper end edge of the discharge opening 833 extends.

Accordingly, dry air sprayed through the discharge opening 833 may be discharged in the lowest position with respect to the up-down direction (U-D direction), and based on the slit shape of the discharge opening, spray having directionality, which is approximately parallel with the rear surface 23 of the bottom tub 20*c* with respect to the horizontal direction and does not face the door 30 linearly.

Further, to promote the effect of distributing dry air sprayed through the discharge opening 833, the discharge opening 833 may extend from the lower portion of the lower rack 51, between a space S formed between the lower rack 51 and the rear surface 23 of the bottom tub 20*c*.

That is, at least a portion of dry air sprayed through the slit-shaped discharge opening 833 may spray toward between the lower surface 25 of the bottom tub 20*c* and the lower rack 51, and the remaining portion of the dry air may spray toward the space S.

To this end, the front edge 833*a* of the slit-shaped discharge opening 833 may be disposed under the lower rack 51, and the rear edge 833*b* of the discharge opening 833 may be disposed in the space S.

In other words, the discharge opening 833 of the airflow guide 83, as illustrated in FIG. 9, may be divided into a first portion 8331 disposed under the lower rack 51, and a second portion 8332 disposed in the space S. and a rear end portion 511 of the lower rack 51 may be a reference line dividing the first portion 8331 and the second portion 8332.

By doing so, dry air may spray in a direction that does not face the center of the lower rack 51 directly, or a direction that avoids the lower rack 51, and dry airflow F having passed through the first portion 8331 may move up toward the lower surface of the lower rack 51, and dry airflow F having passed through the second portion 8332 may move up by passing through the space S.

Thus, the thermal energy of dry air may be distributed evenly in the tub 20 without concentrating on a specific portion of the lower rack 51.

A relative ratio of the first portion 8331 and the second portion 8332 may be set differently depending on a required distribution ratio of dry air. That is, when more dry air needs to be supplied to the lower rack 51, a surface area ratio of the first portion 8331 may increase, and when more dry air needs to be supplied to the space S, a surface area ratio of the second portion 8332 may increase.

However, since the capacity of the lower rack 51 is ordinarily much greater than the capacity of the upper rack 52 or the top rack 53, the surface area ratio of the first portion 8331 is greater than the surface area ratio of the second portion 8332, for example.

Figure 11:
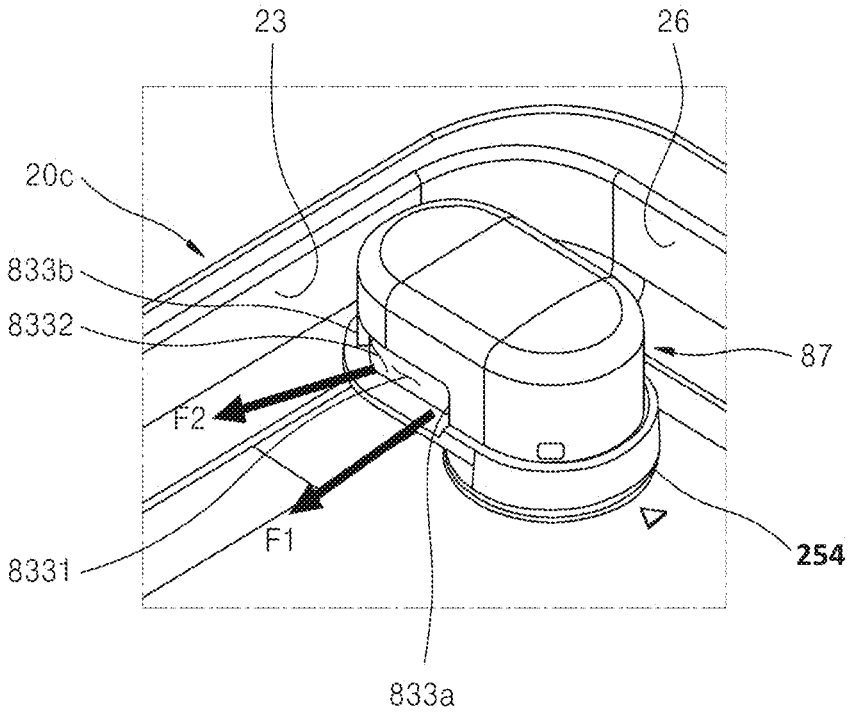
FIGS. 11 and 12 are partial enlarged views of FIG. 9.
Figure 12:
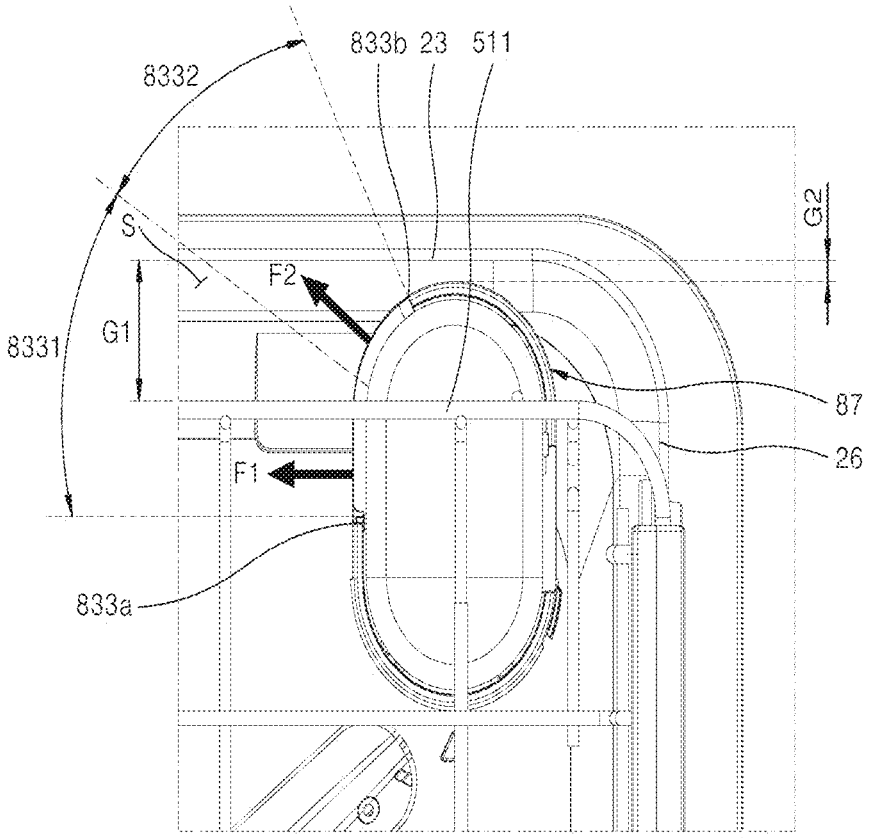

To this end, the airflow guide 83, as illustrated in FIGS. 11 and 12, may be disposed closer to the rear surface 23 of the bottom tub 20*c* than the lower rack 51. Specifically, when the rear end portion 511 of the lower rack 51 is spaced a first distance G1 apart from the rear surface 23 of the bottom tub 20*c* in the state where the lower rack 51 is stored in the wash space, the rear end portion of the airflow guide 83 may be spaced from the rear surface 23 of the bottom tub 20*c* to have a second distance G2 less than the first distance G1.

At this time, the front edge 833*a* of the slit-shaped discharge opening 833 may be disposed under the lower rack 51, and the rear edge 833*b* of the discharge opening 833 may be disposed in the space S.

In other words, the discharge opening 833 of the airflow guide 83, as illustrated in FIG. 12, may be divided into a first portion 8331 disposed under the lower rack 51, and a second portion 8332 disposed in the space S, and the rear end portion 511 of the lower rack 51 may be a reference line dividing the first portion 8331 and the second portion 8332.

By doing so, dry air may spray in a direction that does not face the center of the lower rack 51 directly, or a direction that avoids the lower rack 51, and dry airflow F1 having passed through the first portion 8331 may move up toward the lower surface of the lower rack 51, and dry airflow F2 having passed through the second portion 8332 may move up by passing through the space S.

Thus, the thermal energy of dry air may be distributed evenly in the tub 20 without concentrating on a specific portion of the lower rack 51.

A relative ratio of the first portion 8331 and the second portion 8332 may be set differently depending on a required distribution ratio of dry air. That is, when more dry air needs to be supplied to the lower rack 51, a surface area ratio of the first portion 8331 may increase, and when more dry air needs to be supplied to the space S, a surface area ratio of the second portion 8332 may increase.

However, since the capacity of the lower rack 51 is ordinarily much greater than the capacity of the upper rack 52 or the top rack 53, the surface area ratio of the first portion 8331 is greater than the surface area ratio of the second portion 8332, for example.

Considering the fact, the surface area of the second portion 8332, escaping from the rear end portion 511 of the lower rack 51 and being disposed in the space S, may account for 25% to 50% of the entire surface area of the discharge opening 833 of the airflow guide 83.

Further, since the rear edge 833*b* of the discharge opening 833, as illustrated in FIGS. 11 and 12, extends to the rear surface of the airflow guide 83, at least a portion of dry airflow sprayed at the rear edge 833*b* side of the discharge opening 833 may have directionality facing the rear surface 23 of the bottom tub 20*c*.

Figure 13:
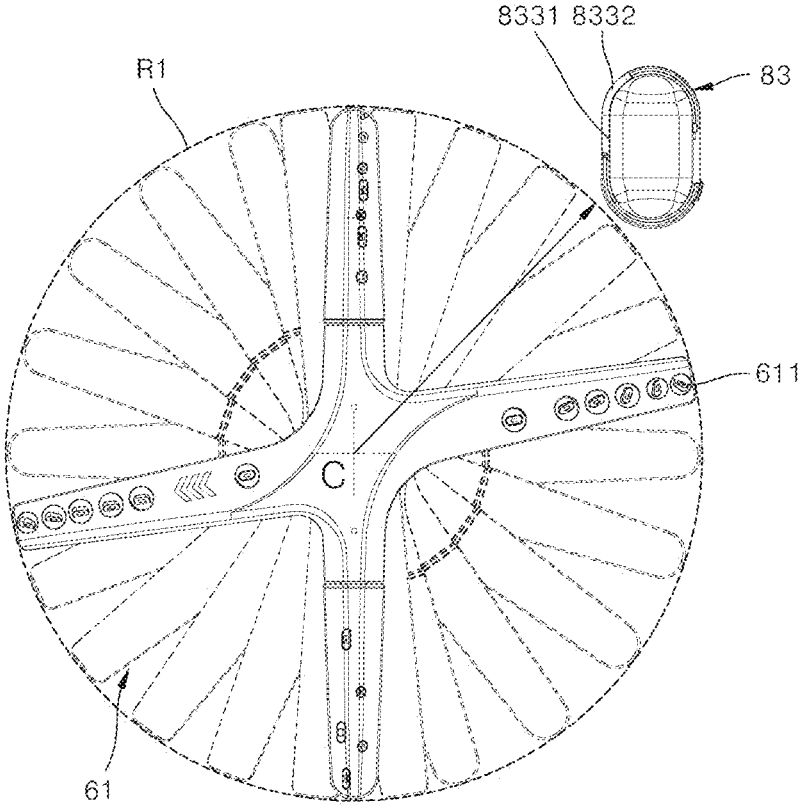
FIG. 13 is a plan view showing a relative position of a lower spray arm and an airflow guide.

As illustrated in FIG. 13, the airflow guide 83 may be disposed outside the rotation range R1 of the lower spray arm 61, and separated and spaced from the rear surface 23, the lower surface 25 and the left side surface 26 of the bottom tub 20*c*.

That is, the airflow guide 83 may be disposed between the corner gathered and formed by the rear surface 23, the lower surface 25 and the left side surface 26 of the bottom tub 20*c*, and the rotation rage of the lower spray arm 61.

Since the airflow guide 83 is disposed at the corner of the bottom tub 20*c*, outside the rotation range R1 of the lower spray arm 61, as described above, interference with the lower spray arm 61 rotating in the washing stage or the rinsing stage may be prevented effectively.

Additionally, since the airflow guide 83 is spaced a predetermined distance apart from the rear surface 23, the lower surface 25 and the left side surface 26 of the bottom tub 20*c*, food and the like may be effectively prevented from being fitted and fixed between the airflow guide 83 and the bottom tub 20*c*.

Figure 14A:
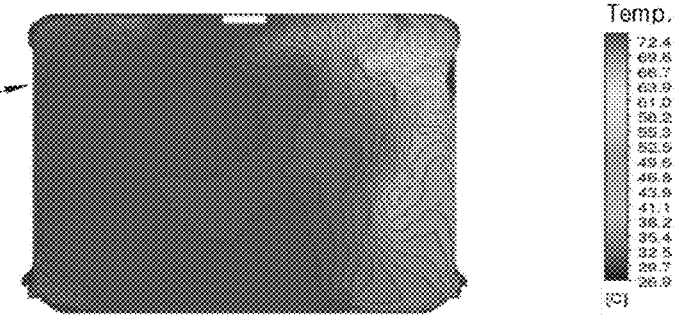
FIGS. 14A to 14C show experimental data on the distribution of measured temperatures in a drying process of the related art.
Figure 14B:
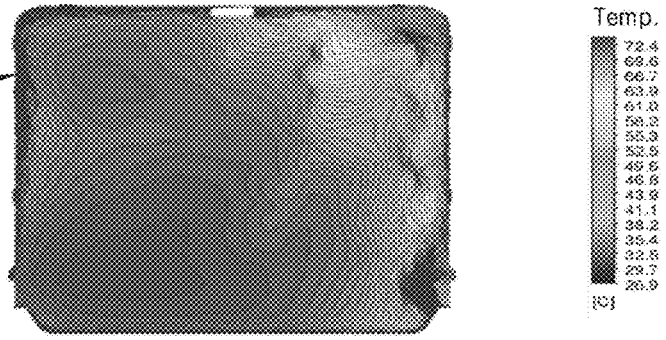
Figure 14C:
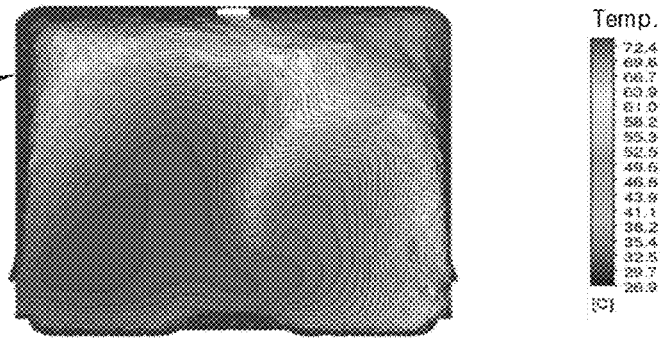
Figure 15A:
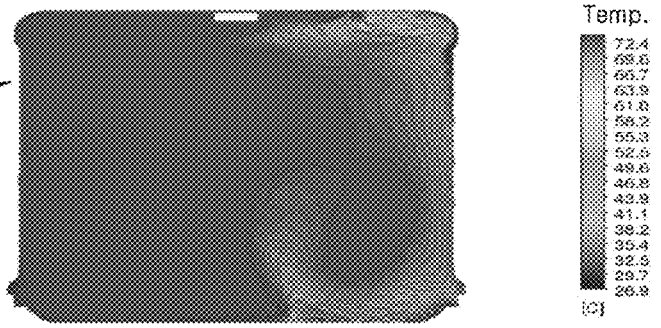
FIGS. 15A to 15C show experimental data on the distribution of measured temperatures in a drying process of one embodiment.
Figure 15B:
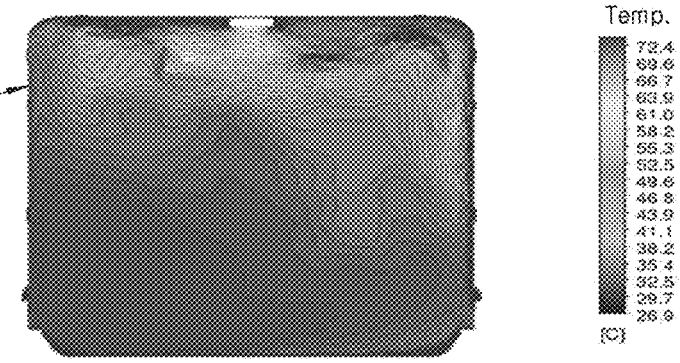
Figure 15C:
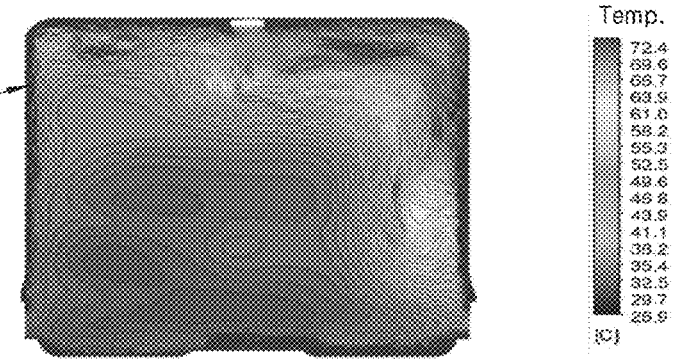

FIGS. 14A to 14C are views showing temperature distribution measured respectively at a top rack 53, an upper rack 52 and a lower rack 51 in the state where dry air is supplied through an airflow guide 83 of the related art, and FIGS. 15A to 15C are views showing temperature distribution measured respectively at the top rack 53, the upper rack 52 and the lower rack 51 in the state where dry air is supplied through the airflow guide 83 of one embodiment.

The experiment on the comparative example of the related art in FIGS. 14A to 14C, and the experiment on the experimental example of one embodiment in FIGS. 15A to 15C were performed under the same test conditions, except for the direction in which dry air sprayed.

As illustrated in FIGS. 14A to 14C, when the airflow guide 83 is disposed near the lower surface 25 of the bottom tub 20*c* or dry air sprays toward the central portion of the bottom tub 20*c*, in the related art, there is no big temperature deviation in each position of the lower rack 51 (FIG. 14A).

However, the temperature deviation in each position of the upper rack 52 and the top rack 53 reveals that temperature decreases rapidly from the central portion of the upper rack 52 and the top rack 53 to the outer side of the upper rack 52 and the top rack 53, and there is a big deviation between the central portion and the outer side (FIG. 14B and FIG. 14C).

On the contrary, as illustrated in FIGS. 15A to 15C, when the airflow guide 83 is disposed near the lower surface 25 of the bottom tub 20*c*, but dry air sprays in a direction parallel with the rear surface 23 of the bottom tub 20*c* and is distributed evenly, in the experimental example of the present disclosure, there is no big temperature deviation in each position of the lower rack 51 (FIG. 15A).

Further, the temperature deviation in each position of the upper rack 52 and the top rack 53 reveals that temperature decreases from the central portion of the upper rack 52 and the top rack 53 to the outer side of the upper rack 52 and the top rack 53 gradually and slowly, and there is no big temperature deviation between the central portion and the outer side.

In particular, unlike the related art, the present disclosure shows that the temperature of the central portion of the top rack 53 also remains quite high, that the temperature of dry air sprayed along the airflow guide 83 of one embodiment remains constant in the tub 20 entirely/dry air sprayed along the airflow guide 83 of one embodiment may make the temperature inside the entire tub 20 constant and that the effect of drying wash targets is promoted noticeably.

Hereafter, the inner structure of the airflow guide 83 of the dishwasher 1 of one embodiment is described with reference to FIGS. 16 to 24.

Figure 16:
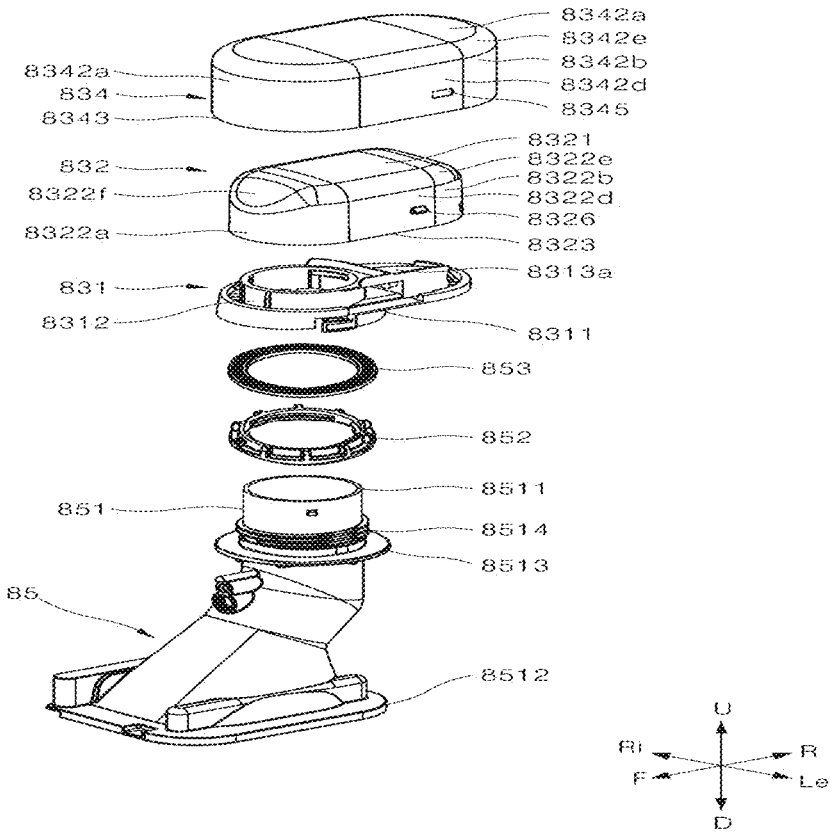
FIG. 16 is an exploded perspective view showing an airflow guide and a connection duct part of the dishwasher of one embodiment.

As illustrated in FIG. 16, the airflow guide 83 of the dishwasher 1 of one embodiment may comprise a lower guide 831 detachably coupled to the duct main body 851 of the connection duct part 85, an upper guide 832 coupled to the upper side of the lower guide 831, and a cap cover 834 disposed at the upper side of the upper guide 832 and coupled to the outer surface of the upper guide 832.

The airflow guide 83, for example, may be divided with respect to the up-down direction (U-D direction). The lower guide 831 constitutes the lower portion of the segment body. The upper guide 832 and the cap cover 834 may constitute the upper portion of the segment body.

The upper guide 832 is coupled to the upper side of the lower guide 831 described hereafter, and forms a closed inner flow space formed into a channel in which dry airflow F flows together with the lower guide 831.

Figure 17:
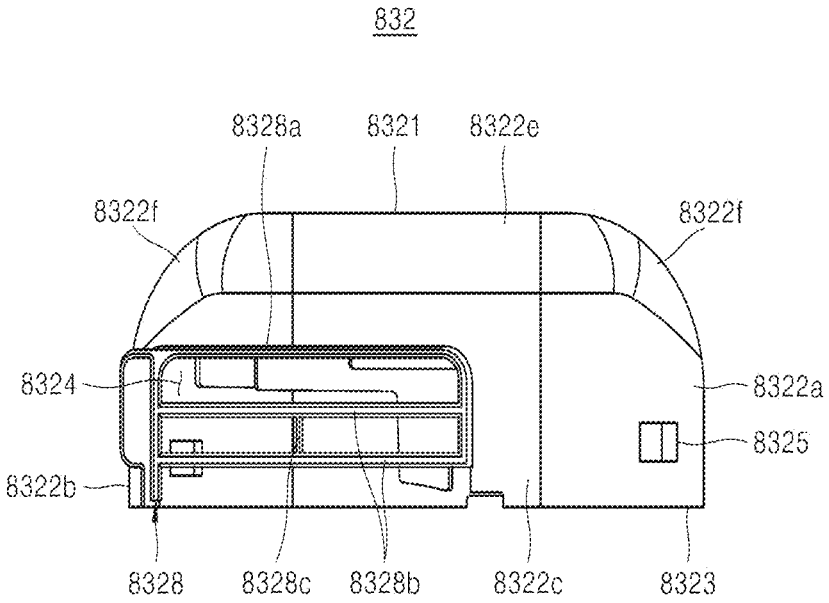
FIG. 17 is a side view showing an upper guide in FIG. 16.
Figure 18:
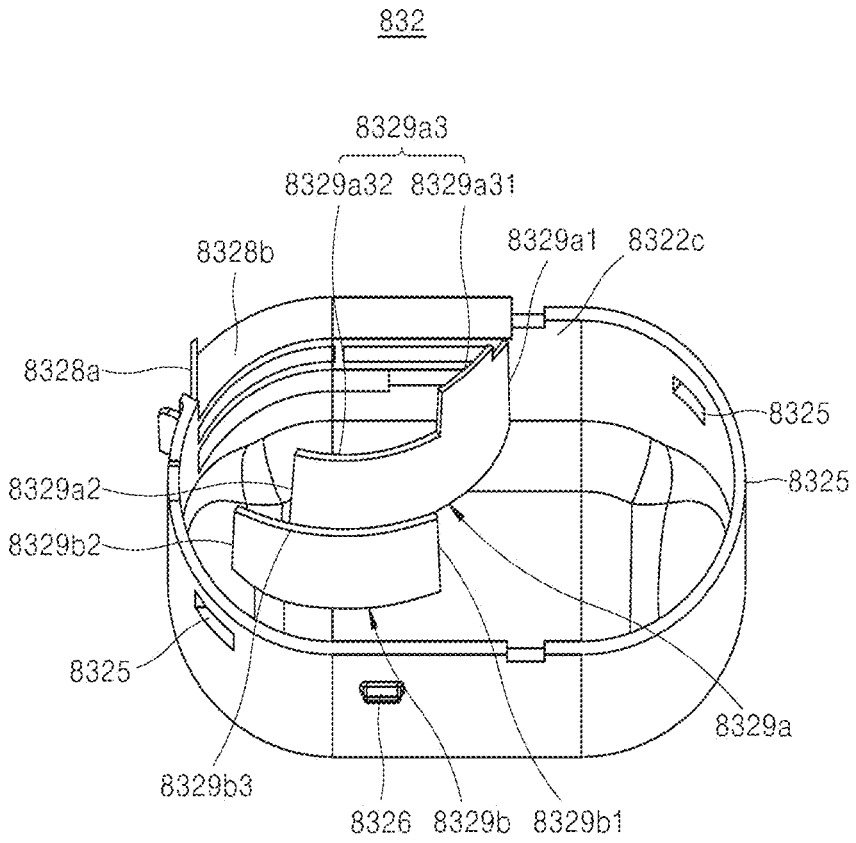
FIG. 18 is a rear perspective view showing the upper guide.

To form the inner flow space as illustrated in FIGS. 17 and 18, the upper guide 832 may be formed into a container which has a vacant space therein, and the lower surface of which is open entirely.

The open lower surface of the upper guide 832 may be coupled with a guide main body 8311 of the lower guide 831 and be closed entirely. By doing so, a closed inner flow space may be formed between the upper guide 832 and the lower guide 831.

At this time, in response to the shape of the lower guide 831, the outer shape of the upper guide 832 may have a front-rear width greater than a left-right width.

The upper guide 832 may be formed into a container that has an upper end surface 8321 formed approximately in parallel with a reference surface 8311*a* of the lower guide 831 described hereafter, and a lower surface being open through an outer wall surface which extends in the downward direction (D-direction) along the circumference of the upper end surface 8321.

At this time, the upper end surface 8321 and the outer wall surface may be integrally formed, and have a uniform thickness as a whole to ensure a maximum inner flow space, and preferably, be manufactured using plastic injection molding.

The outer wall surface may comprise a first flat surface part 8322*c* that forms the right side surface of the outer wall surface and is formed into a flat plate, and a second flat surface part 8322*d* that forms the left side surface of the outer wall surface and is formed into a flat plate. The first flat surface part 8322*c* and the second flat surface part 8322*d* may have a symmetrical shape, and be formed into a perpendicular surface or an inclined surface having a slope where a gap between the first flat surface part 8322*c* and the second flat surface part 8322*d* decreases gradually in the upward direction (U-direction).

Additionally, a first curved surface part 8322*a* may be continuously formed at the front sides of the first flat surface part 8322*c* and the second flat surface part 8322*d*, and a second curved surface part 8322*b* may be continuously formed at the rear sides of the first flat surface part 8322*c* and the second flat surface part 8322*d*.

The first curved surface part 8322*a* may form the front surface of the upper guide 832, and for example, have an outer shape of a half cylindrical surface that is convex forward.

Like the first curved surface part 8322*a*, the second curved surface part 8322*b* may form the rear surface of the upper guide 832, and for example, have an outer shape of a half cylindrical surface that is convex rearward.

The first curved surface part 8322*a* and the second curved surface part 8322*b* may be disposed to have an approximately symmetrical shape.

Each of the first curved surface part 8322*a* and the second curved surface part 8322*b* may integrally connect to the upper end surface 8321, the first flat surface part 8322*c* and the second flat surface part 8322*dc*, and form a continuous surface for the upper end surface 8321, the first flat surface part 8322*c* and the second flat surface part 8322*d*.

As illustrated, a first camper surface 8322*e* in a camper shape may be formed at an edge formed between the upper end surface 8321 and the outer wall surface. The first camper surface 8322*e* may help to minimize flow loss or noise caused by eddy currents that may be generated at an angular edge side of the inner flow space in which dry airflow F flows.

The first camper surface 8322*e* may be a curved surface having a predetermined curvature, or an inclined surface having a predetermined slope.

Like the first camper surface 8322*e*, a second camper surface 8322*f* in a camper shape may be formed at an edge that is formed by the upper end surface 8321 and the first curved surface part 8322*a* which are met, and at an edge that is formed by the upper end surface 8321 and the second curved surface part 8322*b* which are met.

Like the first camper surface 8322*e*, the second camper surface 8322*f* may be a curved surface having a predetermined curvature, or an inclined surface having a predetermined slope.

A lower end portion 8323 of the upper guide 832 formed around the open lower surface of the the upper guide 832 may be formed continuously while its height remains approximately constant from the upper end surface 8321 with respect to the up-down direction (U-D direction) such that the lower end portion 8323 of the upper guide 832 may be inserted and coupled to a misassembly prevention groove 8311*d* of the lower guide 831 described hereafter.

A first notch hole 8324 forming the front edge, the rear edge and the upper end edge of the discharge opening 833 may be formed in the lower end portion 8323 of the upper guide 832.

The first notch hole 8324, as illustrated, may be formed into a notch where the first flat surface part 8322*c* and the second curved surface part 8322*b* of the upper guide 832 are partially cut.

The lower end of the first notch hole 8324 is entirely open, and as the upper guide 832 is coupled to the lower guide 831, the above-described reference surface 8311*a* of the lower guide 831 may be coupled to the open lower end of the first notch hole 8324, and the reference surface 8311*a* may block the lower end of the first notch hole 8324.

The upper end edge of the first notch hole 8324 may extend approximately in parallel with the reference surface 8311*a* of the lower guide 831 and may extend linearly.

The front edge of the first notch hole 8324 may be formed at the first flat surface part 8322*c* and extend linearly along the up-down direction (U-D direction). The rear edge of the first notch hole 8324 may be formed at the second curved surface part 8322*b* and extend linearly along the up-down direction (U-D direction).

A rear corner part formed by the upper end edge and the rear edge which are met, and a front corner part formed by the upper end edge and the front edge which are met may respectively have a curved edge having a predetermined curvature.

A first holding hole 8325 which is formed into a rectangular penetration hole and to which the upper guide holding projection 8312*g* of the lower guide 831 is held and coupled may be formed at the first curved surface part 8322*a* of the upper guide 832, near the lower end portion 8323 of the upper guide 832.

As illustrated in FIG. 17, the outer shape of the upper guide 832 is approximately symmetrical with respect to the front-rear direction (F-R direction), but the first notch hole 8324 and the first holding hole 8325 are formed in an asymmetrical position with respect to the front-rear direction (F-R direction). The first notch hole 8324 and the first holding hole 8325 may serve as a means of preventing the misassembly of the upper guide 832 to the lower guide 831.

Additionally, at least one cap cover holding projection 8326 for fastening the cap cover 834 described hereafter may be integrally formed at the second flat surface part 8322*d* of the upper guide 832.

As described hereafter, the cap cover 834 may be coupled to the outer surface of the upper guide 832. At least one cap cover holding projection 8326 may have a lamp surface having a predetermined angle with respect to the second flat surface part 8322*d*, and a step surface formed approximately perpendicularly with respect to the second flat surface part, to ensure ease of coupling and prevent ease of separation.

As illustrated in FIG. 16, the cap cover 834 may be provided with a second holding hole 8345 that is formed near the lower end portion 8343 in a way that penetrates the inside and the outside of the cap cover 834.

The second holding hole 8345 may be formed into a rectangular penetration hole having a width and a height at which the cap cover holding projection 8326 can be inserted into the second holding hole 8345 at a time of coupling the upper guide 832 and the cap cover 834, and like the cap cover holding projection 8326, may be disposed higher than the upper guide holding projection 8312*g* with respect to the up-down direction.

By doing so, the cap cover holding projection 8326 and the second holding hole 8345 may clearly distinguish from the upper guide holding projection 8312*g* because of the difference in their heights, and the misassembly of the cap cover 834 having a symmetrical shape with respect to the front-rear direction (F-R direction) may be prevented effectively.

Additionally, the upper guide 832 of the airflow guide 83 of one embodiment may be provided with a blocking rib 8328 as a first means of minimizing the inflow of wash water into the airflow guide 83 and the connection duct part 85 through the discharge opening 833.

As illustrated in FIGS. 17 and 18, the blocking rib 8328 may comprise a first rib 8328*a* that extends in a shade shape along the upper end edge, the front edge and the rear edge of the first notch hole 8324.

The first rib 8328*a* extends continuously along the edges of the first notch hole 8324 and protrude approximately perpendicularly with respect to the first flat surface part 8322*c* of the upper guide 832. Preferably, the first rib 8328*a* may be formed integrally on the first flat surface part 8322*c* and the second curved surface part 8322*b* of the upper guide 832.

One end portion of the first rib 8328*a* may be formed at the rear edge of the first notch hole 8324, and the other end portion of the first rib 8328*a* may be formed at the front edge of the first notch hole 8324. The first rib 8328*a* may extend in a continuous protruding wall shape, between one end portion and the other end portion thereof, to serve as a shade surrounding the first notch hole 8324 approximately entirely.

However, to prevent interference with a first edge wall 8311*b* of the lower guide 831, one end portion and the other end portion of the first rib 8328*a* may be respectively spaced a predetermined height from the lower end portion 8323 of the upper guide 832 in the upward direction (U-direction).

The first rib 8328*a* may help to minimize the fall of wash targets from the storage part after a wash or the passage of wash water scattered after a fall through the first notch hole 8324.

To this end, a horizontal rib of the first rib 8328*a*, formed at least at the upper end edge of the first notch hole 8324, may horizontally protrude past the first edge wall 8311*b* of the lower guide 831 and the reference surface 8311*a*, as illustrated in FIG. 17.

That is, the horizontal portion of the first rib 8328*a* may extend to cover the first edge wall 8311*b* and the reference surface 8311*a* with respect to the up-down direction (U-D direction), and in the state where the airflow guide 83 is installed completely, the first edge wall 8311*b* and the reference surface 8311*a* are covered and by the first rib 8328*a* and is not be seen, when view from above.

Accordingly, the flow of wash water, which falls perpendicularly after wash targets are washed, collides with the first edge wall 8311*b* and then is scattered, into the first notch hole 8324 may be minimized.

However, wash water scattered in the washing stage or the rinsing stage may fall in a direction different from the perpendicular direction. That is, wash water avoiding the first rib 8328*a*, colliding with the first edge wall 8311*b* and being scattered is likely to flow into the first notch hole 8324.

To prevent this from happening, the blocking rib 8328 may further comprise at least one second rib 8328*b* that extends across the inside the first notch hole 8324, along the front-rear direction (F-R direction).

FIGS. 17 to 18 exemplarily show an embodiment provided with a pair of second ribs 8328*b* that are spaced in the up-down direction (U-D direction). Hereafter, an embodiment provided with a pair of second ribs 8328*b*, as illustrated, is described for convenience, but not limited.

Each of the pair of second ribs 8328*b* may extend across the inside the first notch hole 8324 and have the same shape.

At this time, to prevent deterioration in the spray efficiency of dry air spraying, the up-down thickness of each of the second ribs 8328*b* may be much less than the front-rear length.

Additionally, to minimize the flow of perpendicularly falling wash water into the first notch hole 8324, caused by the collision with the first edge wall 8311*b* and scattering of the wash water, the pair of second ribs 8328*b*, like the first rib 8328*a*, may protrude horizontally past the first edge wall 8311*b* and the reference surface 8311*a* of the lower guide 831. That is, the horizontal position of the left end portion of the horizontal rib of the first rib 8328*a* may be the same as the horizontal position of the left end portion of the pair of second ribs 8328*b*.

However, to cover the inside of the first notch hole 8324 entirely with respect to the front-rear direction (F-R direction), the rear end portion forming one end portion of each of the second ribs 8328*b* may integrally connect to the rear edge of the first notch hole 8324, and the front end portion forming the other end portion of each of the second rib 8328*b* may integrally connect to the front edge of the first notch hole 8324.

The shape of the second rib 8328*b* may help to prevent the inflow of wash water, in a way that the wash water is blocked by the second rib 8328*b* again, even if the wash water collides with the first edge wall 8311*b* by avoiding the first rib 8328*a* and is scattered.

Additionally, since the thickness of the pair of second ribs 8328*b* is much less than the front-rear length thereof, the second ribs have relatively low strength, and is likely to be damaged by small magnitude of external force. To prevent such damage, a bridge rib 8328*c* is disposed between the front end portion and the rear end portion of the second rib 8328*b* and connects the pair of second ribs 8328*b* mutually to reinforce the second ribs. In the illustrative embodiment, the bridge rib 8328*c* extends only between the pair of second ribs 8328*b*, but may further extend to the upper end edge of the first notch hole 8324.

Further, the upper guide 832 of the airflow guide 83 of one embodiment may be provided with at least one blocking wall 8329 that is disposed in the inner flow space of the upper guide 832, as a second means of minimizing the flow of wash water into the airflow guide 83 and the connection duct part 85 through the discharge opening 833.

At least one blocking wall 8329 may help to prevent and minimize the movement of the droplets of wash water, which has passed through the blocking rib 8328 and flown into the airflow guide 83 after the wash water's collision and scattering, toward the lower portion of the upper end surface 8321 of the upper guide 832 or toward a duct coupling part 8312 of the lower guide 831.

To this end, as illustrated in FIGS. 17 and 18, at least one blocking wall 8329 may be disposed in the form of a barrier that extends downward from the lower portion of the upper end surface 8321 of the upper guide 832, to at least partially block the upper portion side of the first notch hole 8324 forming the discharge opening 833.

That is, the up-down position of the lower end of at least one blocking wall 8329 may be between the upper end edge of the first notch hole 8324 and the reference surface 8311*a* of the lower guide 831. Accordingly, when the inside of the first notch hole 8324 is viewed from the outside, the duct coupling part 8312 of the lower guide 831 is entirely covered by at least one blocking wall 8329 and is not be seen visually from the outside.

Thus, among droplets of wash water being scattered and flowing into the airflow guide 83, droplets bouncing upward collide with at least one blocking wall 8329 and flow downward along at least one blocking wall 8329 by using gravity.

The droplets prevented from coming in and falling downward along at least one blocking wall 8329 need to be discharged out of the airflow guide 83 again. To this end, the lower end edge of at least one blocking wall 8329 may extend toward a channel guide surface 8313 of the lower guide 831. Additionally, at least one blocking wall 8329 may be disposed in the channel guide surface area with respect to the horizontal direction, as described hereafter. A relative position relationship between the blocking wall 8329 and the channel guide surface 8313 of the lower guide 831 is described hereafter with reference to FIGS. 23 and 24.

Further, as shown in the illustrative embodiment, the blocking wall 8329 may comprise a first blocking wall 8329*a* disposed relatively close to the first notch hole 8324, and a second blocking wall 8329*b* disposed farther from the first notch hole 8324 than the first blocking wall 8329*a*, for example.

As described above, at least one blocking wall 8329 is disposed in the inner flow space where dry airflow F flows.

Accordingly, if a single blocking wall covers the upper portion side of the first notch hole 8324 entirely, the flow resistance of dry airflow F may increase, resulting in deterioration of air blowing efficiency.

To prevent deterioration in air blowing efficiency, caused by an increase in flow resistance, the blocking wall 8329 may be divided into the first blocking wall 8329*a* and the second blocking wall 8329*b* to complementarily cover the upper portion side of the first notch hole 8324.

That is, the first blocking wall 8329*a* may be disposed to partially cover the upper portion side of the first notch hole 8324, and the second blocking wall 8329*b* may be disposed to at least partially cover the remaining portion of the first notch hole 8324 that is not cover by the first blocking wall 8329*a*.

The upper end edge of the first blocking wall 8329*a* may integrally connect to the lower portion of the upper end surface 8321 of the upper guide 832 and be formed into a curved surface that is convex in a direction farther from the first notch hole 8324 forming the discharge opening 833, from one end edge 8329*a*1 of the first blocking wall 8329*a* toward the other end edge 8329*a*2 thereof.

Likewise, the upper end edge of the second blocking wall 8329*b* may integrally connect to the lower portion of the upper end surface 8321 of the upper guide 832 and be formed into a curved surface that is convex in a direction farther from the first notch hole 8324 forming the discharge opening 833, from one end edge 8329*b*1 of the second blocking wall 8329*b* toward the other end edge 8329*b*2 thereof.

That is, the flow direction of air having passed through the upper end 8511 of the connection duct part 85 and flown into the inner flow space changes toward the first notch hole 8324 forming the discharge opening 833, as described hereafter. That is, in the process of changing a flow direction, a rotation speed component is produced in dry airflow F.

To prevent a rapid change in the flow space and produce a rotation speed component effectively in the process of changing a flow direction, the first blocking wall 8329*a* and the second blocking wall 8329*b* may also serve as a flow guide.

To minimize flow resistance and serve as a flow guide effectively, the first blocking wall 8329*a* and the second blocking wall 8329*b* may be formed into a curved surface having predetermined curvature, and have a uniform thickness from one end edge 8329*a*1, 8329*b*1 to the other end edge 8329*a*2, 8329*b*2 of each of the first blocking wall 8329*a* and the second blocking wall 8329*b*.

However, detailed shapes of the first blocking wall 8329*a* and the second blocking wall may differ from each other.

That is, one end edge 8329*a*1 of the first blocking wall 8329*a* may be a fixation end portion that integrally connects to the front edge of the first notch hole 8324, and the other end edge 8329*a*2 of the first blocking wall 8329*a* may be a free end portion that does not connect to the outer wall surface of the upper guide 832.

One end edge 8329*a*1 of the first blocking wall 8329*a* integrally connects to the front edge of the first notch hole 8324, as described above, such that droplets of wash water are prevented from flowing directly into an upper end 8312*a* of the duct coupling part 8312 of the lower guide 831 and the upper end 8511 of the connection duct part 85 through the front edge side of the first notch hole 8324, in a minimum distance.

Additionally, the up-down position of a lower end edge 8329*a*3 of the first blocking wall 8329*a* may change from one end edge 8329*a*1 of the first blocking wall 8329*a* to the other end edge 8329*a*2 thereof. For example, the lower end edge 8329*a*3 of the first blocking wall 8329*a* may have a step.

Specifically, the lower end edge 8329*a*3 of the first blocking wall 8329*a* may comprise a first edge 8329*a*31 the up-down position of which is maintained approximately in a first position, and a second edge 8329*a*32 the up-down position of which is maintained approximately in a second position. At this time, the first position is lower than the second position, thereby forming a step.

The first edge 8329*a*31, as illustrated, may be disposed closer to the one end edge of the first blocking wall 8329*a* and the front edge side of the first notch hole 8324 than the second edge 8329*a*32.

That is, the up-down position of the lower end edge of the first blocking wall 8329*a*, formed near the front edge side of the first notch hole 8324, may remain lower. By doing so, droplets of wash water may be further prevented from directly flowing into the upper end 8312*a* of the duct coupling part 8312 of the lower guide 831 and the upper end 8511 of the connection duct part 85, into which dry airflow F comes through the front edge side of the first notch hole 8324, in a minimum distance.

As described hereafter, the first position of the first edge 8329*a*31 and the second position of the second edge 8329*a*32 may be lower than the up-down position of the upper end of a division wall provided at the lower guide 831. That is, the lower end edge 8329*a*3 of the first blocking wall 8329*a* may entirely extend to a position lower than the up-down position of the upper end of the division wall 8314.

Additionally, the second blocking wall 8329*b* may be disposed in the state of separating from the first blocking wall 8329*a* and disposed between the first blocking wall 8329*a* and the second flat surface part 8322*d*.

As illustrated, each of one end edge 8329*b*1 and the other end edge 8329*b*2 of the second blocking wall 8329*b* may be a free end portion that does not connect to the outer wall surface of the upper guide 832.

However, the other end edge 8329*b*2 of the second blocking wall 8329*b* may be disposed closer to the rear edge of the first notch hole 8324 than the other end edge 8329*a*2 of the first blocking wall 8329*a* with respect to the front-rear direction, as described above.

Further, the up-down position of a lower end edge 8329*b*3 of the second blocking wall 8329*b* may remain constant approximately from one end edge 8329*b*1 to the other end edge 8329*b*2 and remain higher than the second edge 8329*a*32 of the first blocking wall 8329*a*.

However, like the up-down position of the lower end edge of the first blocking wall 8329*a*, the up-down position of the lower end edge 8329*b*3 of the second blocking wall 8329*b* may be entirely lower than the up-down position of the upper end of the division wall 8314 provided at the lower guide 831.

Further, the cap cover 834 disposed at the upper side of the upper guide 832 may be coupled to the outer surface of the upper guide 832 to protect the upper guide 832.

The upper guide 832 is disposed lower than the storage part that accommodates wash targets, and the upper end surface 8321 and the outer wall surface are disposed in a way that the upper end surface 8321 and the outer wall surface are mostly exposed to the wash space 21 of the tub 20. However, as described above, the upper guide 832 is made of a plastic material having relatively low strength.

Accordingly, the upper guide 832 may be broken directly due to a collision with wash targets that may fall from the storage part between the washing stage and the rinsing stage or may fall while the user withdraws the storage part.

The cap cover 834 is coupled to the upper side of the outer surface of the upper guide 832 to prevent the damage to the upper guide 832, caused by a collision with wash targets.

To this end, the cap cover 834 may be made of a material having higher breaking strength and corrosion resistance than the upper guide 832, and preferably, may be formed with a sheet of metal such as stainless steel and the like.

To be coupled to the outer surface of the upper guide 832, the cap cover 834 may have a shape corresponding to the shape of the outer surface of the upper guide 832.

Accordingly, like the upper guide 832, the cap cover 834 has a vacant space therein, and is formed into a container that is entirely open.

The upper guide 832 may be inserted and coupled through an open lower surface of the cap cover 834.

In response to the shape of the upper guide 832, the outer shape of the cap cover 834 may have a front-rear width greater than a left-right width.

Specifically, the cap cover 834 may comprise an upper end surface 8341 formed in parallel with the upper end surface 8321 of the upper guide 832, and an outer wall surface extending along the circumference of the upper end surface 8321 in the downward direction (D-direction).

Like the upper guide 832, the outer wall surface of the cap cover 834 may comprise a first flat surface part 8342*c* forming a right side surface and being formed into a flat plate, and a second flat surface part 8342*d* forming a left side surface and being formed into a flat plate.

The first flat surface part 8342*c* and the second flat surface part 8342*d* may have a symmetrical shape, and be formed into a perpendicular surface or an inclined surface having a slope where a gap between the first flat surface part 8342*c* and the second flat surface part 8342*d* decreases gradually in the upward direction (U-direction).

Additionally, a first curved surface part 8342*a* may be formed at the front sides of the first flat surface part 8342*c* and the second flat surface part 8342*d*, and a second curved surface part 8342*b* may be continuously formed at the rear sides of the first flat surface part 8342*c* and the second flat surface part 8342*d*.

The first curved surface part 8342*a* may form the front surface of the cap cover 834, and for example, have an outer shape of a half cylindrical surface that is convex forward in response to the shape of the first curved surface part 8322*a* of the upper guide 832.

The second curved surface part 8342*b* may form the rear surface of the cap cover 834, and for example, have an outer shape of a half cylindrical surface that is convex forward in response to the shape of the second curved surface part 8322*b* of the upper guide 832.

Each of the first curved surface part 8342*a* and the second curved surface part 8342*b* may be integrally formed on the upper end surface 8341, the first flat surface part 8342*c* and the second flat surface part 8342*d*, and form a continuous surface for the upper end surface 8341, the first flat surface part 8342*c* and the second flat surface part 8342*d*.

Additionally, in response to the upper guide 832, a camper surface 8342*e* in a camper shape may be formed at an edge formed between the upper end surface 8341 and the outer wall surface.

However, unlike the upper guide 832, the cap cover 834 is not provided with a component corresponding to the second camper surface 8322*f* of the upper guide 832.

The lower end portion 8343 of the outer wall surface of the cap cover 834 may extend to the lower end portion 8323 of the outer wall surface of the upper guide 832 to cover the outer wall surface of the upper guide 832 entirely. Accordingly, at a time of coupling the cap cover 834 to the lower guide 831, the lower end portion 8343 of the cap cover 834 and the lower end portion 8323 of the upper guide 832 may be inserted into the misassembly prevention groove 8311*d* of the lower guide 831, together.

Additionally, a second notch hole 8344 maybe formed in the lower end portion 8343 of the cap cover 834 and have a shape corresponding to that of the first notch hole 8324 of the upper guide 832.

Like the first notch hole 8324, the second notch hole 8344 may be formed into a notch where the first flat surface part 8342*c* and the second curved surface part 8342*b* of the cap cover 834 are partially cut.

Since the second notch hole 8344 has the same shape as the first notch hole 8324, a detailed shape of the second notch hole 8344 is not described.

However, a holding jaw 8344*a* may be provided at the lower end of the front edge of the second notch hole 8344 and protrude to the inside of the second notch hole 8344.

The holding jaw 8344*a* is a portion that is held and coupled to the other end portion of the above-described first rib 8328*a*, and the right side portion of the cap cover 834 may be coupled to the upper guide 832 through the holding jaw 8344*a*.

Additionally, the second holding hole 8345 may be formed near the lower end portion 8323 of the upper guide 832, at the second flat surface part 8342*d* of the cap cover 834, and formed into a rectangular penetration hole to which the above-described cap cover holding projection 8326 of the upper guide 832 is held and coupled.

As the cap cover holding projection 8326 is held and coupled to the second holding hole 8345, the left side portion of the cap cover 834 may be coupled to the upper guide 832.

That is, the cap cover 834 may be coupled to two spots of the upper guide 832 at least though the holding jaw 8344*a* and the cap cover holding projection 8326.

Figure 19:
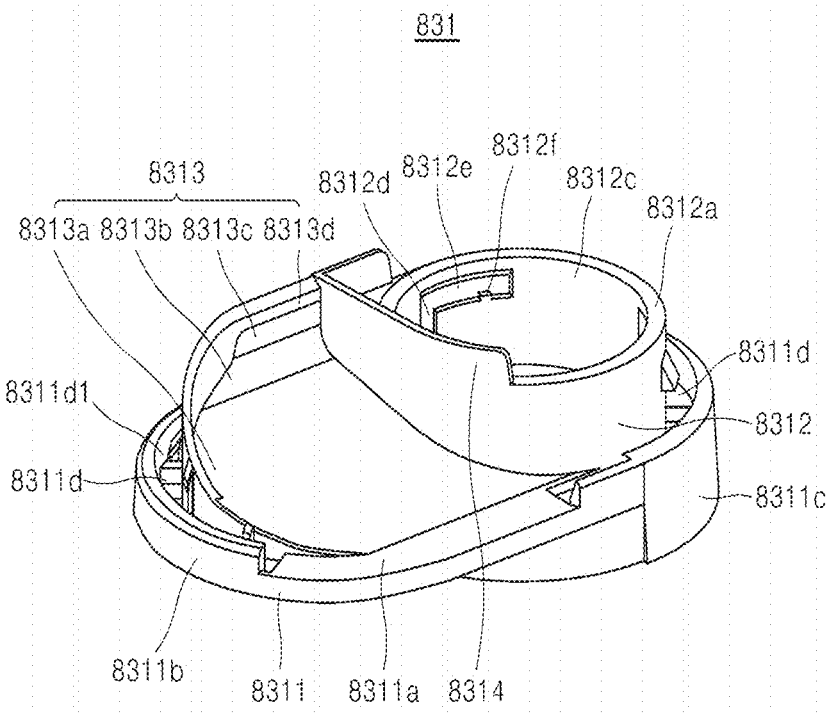
FIG. 19 is a rear perspective view showing a lower guide in FIG. 16.
Figure 20:
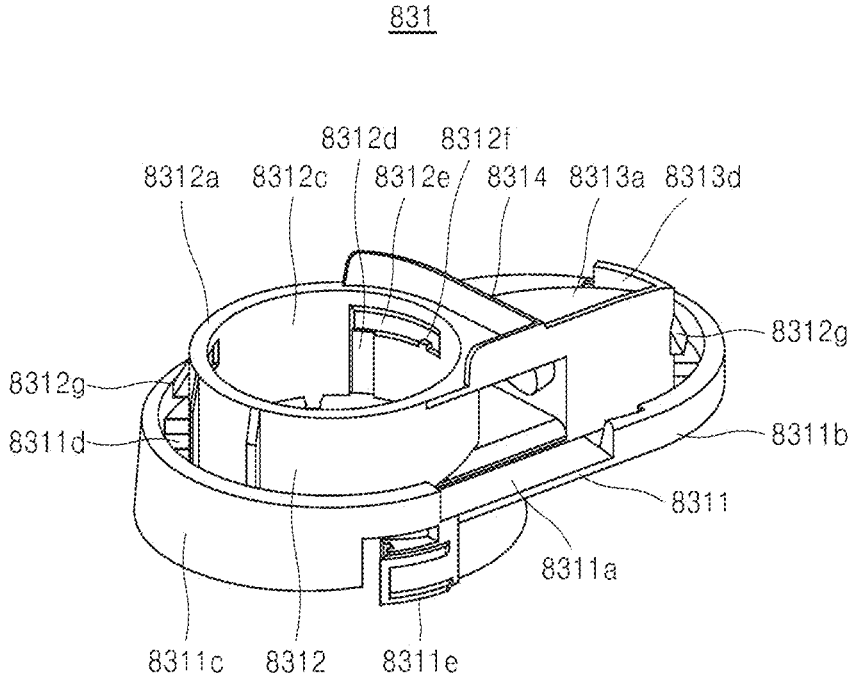
FIG. 20 is a front perspective view of the lower guide.
Figure 21:
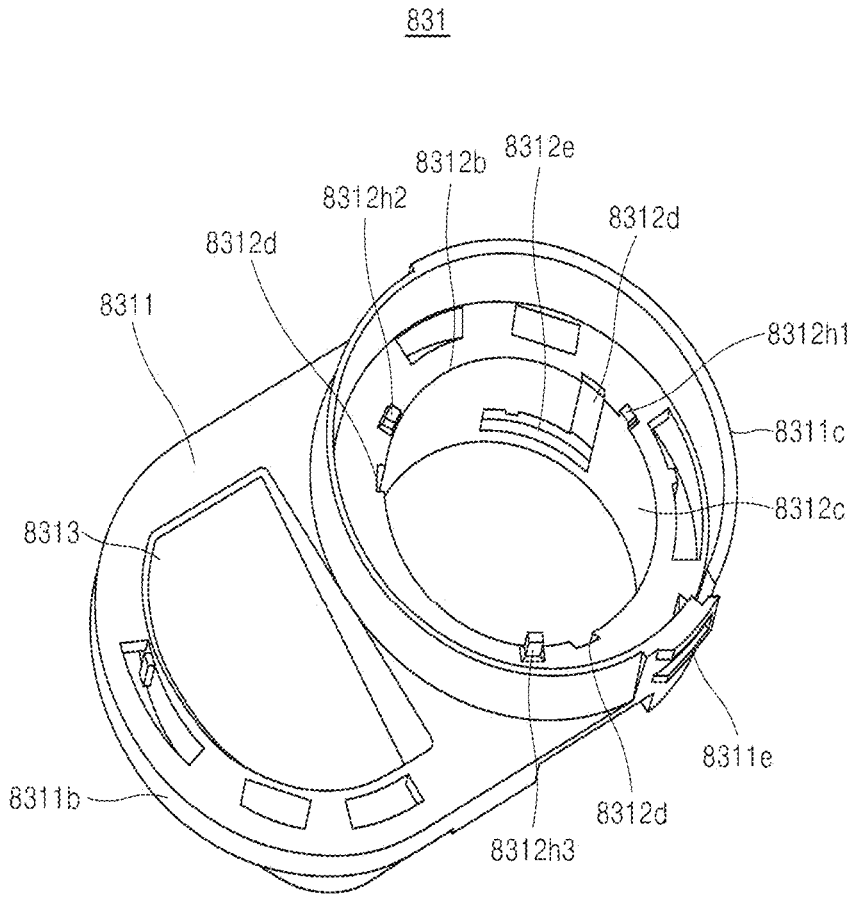
FIG. 21 is a bottom perspective view of the lower guide.

Further, the lower guide 831, as illustrated in FIGS. 19 to 21, may comprise a guide main body 8311 formed into an approximately flat plate.

The guide main body 8311 may have an outer shape in which a front-rear (F-R direction) width is greater than a left-right (Le-Ri direction) width, in the state where the guide main body 8311 is disposed at the connection duct part 85.

At this time, the left and right edges of the outer edge forming the outer shape of the guide main body 8311 may have a linear shape, the front edge may have a circular arc shape that is convex forward, and the rear edge may have a circular arc shape that is convex rearward.

The left and right edges of the guide main body 8311 may have shapes that are approximately symmetrical to each other and parallel with each other, and the front and rear edges of the guide main body 8311 may have shapes that are symmetrical to each other.

The reference surface 8311*a* serving as a lower end edge of the above-described discharge opening 833 may be formed at the right edge side of the guide main body 8311. The reference surface 8311*a*, as illustrated, may be provided in the form of a flat surface that extends in a direction farther from the discharge opening 833 along the horizontal direction, and extend to the lower end of the channel guide surface 8313 described hereafter from the right edge.

Further, the first edge wall 8311*b* may be formed at least partially at the left, right, front and rear edges of the guide main body 8311 and extend from the reference surface 8311*a* in the upward direction (U-direction) by a predetermined height.

The first edge wall 8311*b*, as illustrated, may be formed continuously along the outer edge of the guide main body 8311. However, the first edge wall 8311*b* may not be formed at least in the discharge opening area 833 not to prevent the spray of dry air, as illustrated in FIG. 19.

Further, a misassembly prevention groove 8311*d* may be formed inside the first edge wall 8311*b* and be depressed further downward (in the D-direction) than the reference surface 8311*a*, with respect to the up-down direction (U-D direction), and serve as a misassembly prevention part of the upper guide 832. At this time, the height at which the misassembly prevention groove 8311*d* is depressed from the reference surface 8311*a*, may remain constant approximately along the first edge wall 8311*b*.

The lower end portion 8323 of the upper guide 832, which is described hereafter, may be inserted and coupled to the misassembly prevention groove 8311*d*. Accordingly, the misassembly prevention groove 8311*d* may have a shape and a size corresponding to the shape and the size of the lower end portion 8323 of the upper guide 832. As described above, the shape of the lower end portion 8323 of the upper guide 832 is formed continuously except for the area where the first notch hole 8324 forming the discharge opening 833 is formed, i.e., the area where the reference surface 8311*a* is formed. In response, the misasssembly prevention groove 8311*d* may be formed continuously along the first edge wall 8311*b*.

At this time, the shape of the lower end portion 8323 of the upper guide 832 may be asymmetrical to the shape of the misassembly prevention groove 8311*d* with respect to the front-rear direction (F-R direction). Accordingly, the lower end portion 8323 of the upper guide 832 may not be coupled and fastened to the misassembly prevention groove 8311*d* in a direction different from a predetermined direction. By doing so, a misassembly between the upper guide 832 and the lower guide 831 may be prevented effectively.

Further, a second edge wall 8311*c* may be formed at the front edge of the guide main body 8311 and extend from the reference surface 8311*a* in the downward direction (D-direction) to have a predetermined height.

The second edge wall 8311*c*, as illustrated, may be formed continuously into a cylinder along the circular arc-shaped front edge of the guide main body 8311, and the lower end potion of the second edge wall 8311*c* may extend past a lower end 8312*b* of the duct coupling part 8312 that is described below.

That is, the second edge wall 8311*c* may be formed in a way that surrounds the outer surface of the below-described duct coupling part 8312 at least partially. At this time, the second edge wall 8311*c* is formed in the state of being separated and spaced from the duct coupling part 8312, and a predetermined space may be formed between the second edge wall 8311*c* and the duct coupling part 8312. As described below, an upper end 8522 of a fastening nut 852 may be inserted into the space at least partially.

A release prevention part 8311*e* may be provided on the second edge wall 8311*c*, and based on an interaction with the fastening nut 852, keep the lower guide 831 fixed to the fastening nut 852 and prevent the lower guide 831 from escaping from a fixed position.

As described hereafter, the lower guide 831 is detachably coupled to the duct main body 851 of the connection duct part 85 based on a two-stage coupling manipulation, without an additional coupling member. The two-stage coupling manipulation may comprise an up-down perpendicular movement manipulation and a circumferential rotational movement manipulation, for example.

The release prevention part 8311*e* prevents a relative rotation of the lower guide 831 in a direction opposite to the direction of the rotational movement in the two-stage coupling manipulation, i.e., prevents the lower guide 831 from escaping from the fixed position after the second-stage coupling manipulation including the perpendicular movement manipulation and the rotational movement manipulation is completed.

The release prevention part 8311*e*, as illustrated exemplarily, may be formed integrally on the second edge wall 8311*c*, and prevent the relative rotation of the lower guide 831 in a direction opposite to the direction of the rotational movement of the two-stage coupling manipulation, in the form of an elastic hook.

The lower guide 831, as described above, is directly coupled to the duct main body 851 of the connection duct part 85, using a pipe coupling method.

To this end, the lower guide 831 may comprise a cylindrical duct coupling part 8312 to which the upper end 8511 of the cylinder-shaped duct main body 851 is inserted and detachably coupled.

In response to the shape of the duct main body 851, the duct coupling part 8312 may be formed into a cylinder the central axis C of which extends in parallel with the up-down direction (U-D direction). For the upper end 8511 of the duct main body 851 to be inserted into and pass through the duct coupling part 8312, the inner diameter of the lower end 8312*b* of the duct coupling part 8312 may be greater than or the same as the outer diameter of the upper end 8511 of the duct main body 851.

The duct coupling part 8312 may be formed integrally at the guide main body 8311, and disposed near the circular arc-shaped rear edge of the guide main body 8311. That is, the duct coupling part 8312 may be biased toward the rear side of the guide main body 8311 with respect to the front-rear direction (F-R direction).

The upper end 8312*a* of the cylindrical duct coupling part 8312, from which dry air is discharged, may be formed in a position that protrudes from the guide main body 8311, in the upward direction (U-direction). Preferably, the upper end 8312*a* of the duct coupling part 8312 protrudes to and is exposed to the inner flow space formed between the guide main body 8311 of the lower guide 831 and the upper guide 832.

At this time, in the state where the coupling of the upper end 8511 of the connection duct part 85 is completed, the position of the upper end 8312*a* of the duct coupling part 8312 may be formed in a position lower than the position of the upper end 8511 of the connection duct part 85 with respect to the up-down direction (U-D direction).

Figure 22:
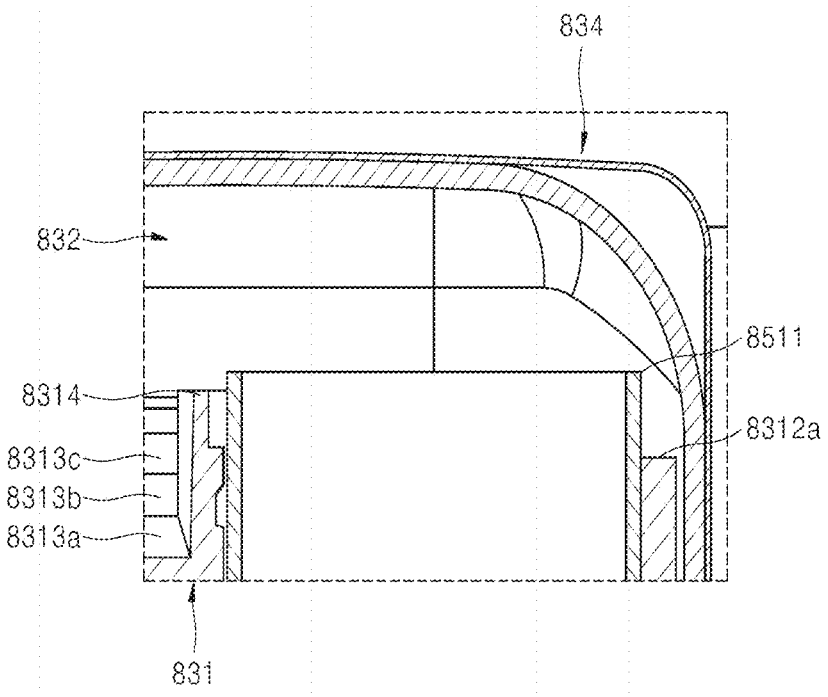
FIG. 22 is a cross-sectional view showing a coupling state between the connection duct part and the lower guide.

That is, the upper end 8511 of the connection duct part 85, as illustrated in FIG. 22, may protrude further upward than the upper end 8312*a* of the duct coupling part 8312. Since the upper end 8511 of the connection duct part 85 remains higher than the upper end 8312*a* of the duct coupling part 8312 as described above, the upward movement of droplets of wash water coming in through the discharge opening 833 along a gap between the outer circumferential surface of the connection duct part 85 and the inner circumferential surface of the duct coupling part 8312, caused by a capillary phenomenon, may be fundamentally blocked.

Additionally, the central axis of the duct coupling part 8712 may be spaced from the first notch hole 8724 with respect to the front-rear direction (F-R direction) or the horizontal direction. In the embodiment, the central axis of the duct coupling part 8712 may be disposed further forward than the first notch hole 8724. That is, at least the front edge of the first notch hole 8724 is disposed further rearward than the central axis of the duct coupling part 8712. Accordingly, a portion of the upper end 8712*a* of the duct coupling part

8712, exposed outward through the discharge opening 873 or the first notch hole 8724, may be minimized, and the flow of the reversely incoming wash water, having passed through the discharge opening 873, into the duct coupling part 8712 through the upper end 8712*a* of the duct coupling part 8712 may be minimized.

Further, a first guide groove 8312*d* that extends in a linear shape along the up-down direction (U-D direction), and a second guide groove 8312*e* that extends in a circular arc shape along the circumferential direction may be formed on an inner circumferential surface 8312*c* of the duct coupling part 8312.

As illustrated, the upper end of the first guide groove 8312*d* integrally connects to one end portion of the second guide groove 8312*e*.

The lower guide 831, as described above, is coupled to the duct main body 851 of the connection duct part 85, based on the two-stage coupling manipulation comprising the up-down perpendicular movement manipulation and the circumferential rotational movement manipulation.

The first guide groove 8312*d* extending along the up-down direction (U-D direction) in a linear shape guides the up-down perpendicular movement of the lower guide 831, and the second guide groove 8312*e* extending along the circumferential direction in a circular arc shape guides the circumferential rotational movement of the lower guide 831.

A guide projection 8516 may be integrally provided on the outer circumferential surface of the duct main body 851 inserted into and coupled to the duct coupling part 8312 of the lower guide 831, and protrude toward the inner circumferential surface of the connection duct part 85 and be inserted into the first guide groove 8312*d* and the second guide groove 8312*e* of the connection duct part 85.

Accordingly, the guide projection 8516, as described hereafter, may be first inserted into the first guide groove 8312*d* at a time of coupling the lower guide 831 and the duct main body 851.

As a result, in the state where the guide projection 8516 of the duct main body 851 is inserted into the first guide groove 8312*d*, the lower guide 831 may move perpendicularly in the downward direction (D-direction).

As the up-down perpendicular movement manipulation of the two-stage coupling manipulation starts, the first guide groove 8312*d* moves in the downward direction (D-direction) along the guide projection 8516 that stands still. As the guide projection 8516 reaches the upper end of the first guide groove 8312*d*, the lower guide 831 may not move in the downward direction (D-direction) any longer because of the guide projection 8516's action.

At this time, since the guide projection 8516 has arrived at one end portion of the second guide groove 8312*e*, the lower guide 831 may not make a downward (D-direction) movement while making a circumferential rotational movement in the two-stage coupling manipulation.

As the lower guide 831 rotates for the circumferential rotational movement manipulation of the two-stage coupling manipulation, the second guide groove 8312*e* moves along the guide projection 8516 that stands still. As the guide projection 8516 reaches the other end portion of the second guide groove 8312*e*, the lower guide 831 may not rotate in the circumferential direction any longer because of the guide projection 8516's action.

When the lower guide 831 does not rotate any longer as described above, the lower guide 831 and the duct main body 851 may be coupled completely, the lower guide 831 may be disposed in a fixed position completely, and without an additional coupling member or an additional fastening member, the lower guide 831 and the duct main body 851 may be coupled.

As illustrated in FIGS. 19 and 20, a stopper projection 8312*f* may be integrally formed on the inner circumferential surface 8312*c* of the duct coupling part 8312, at the other end portion side of the second guide groove 8312*e*, and may form stick-slip in relation to the movement of the guide projection 8516, and after the guide projection 8516 reaches the other end portion of the second guide groove 8312*e*, stop a relative rotation of the lower guide 831 in the opposite direction.

Thus, as long as external force of greater than a specific level is not applied, the stopper projection 8312*f* may prevent the guide projection 8516 from escaping from the other end portion of the second guide groove 8312*e*.

However, when the coupling of the lower guide 831 and the setting of the right position of the lower guide 831 are completed in the state where the guide projection 8516 is inserted into the second guide groove 8312*e*, the airflow guide 83 may not make a self weight-induced movement due to a hold between the second guide groove 8312*e* and the guide projection 8516.

However, as strong external force such as a collision of a wash target falling in the washing stage or the rinsing stage and the like is applied, the second guide groove 8312*e* and the guide projection 8516 may be easily released from the hold therebetween.

Even without strong external force, the lower guide 831 and the airflow guide 83 are highly likely to clatter because of a gap between the duct coupling part 8312 of the lower guide 831 and the duct main body 851 of the connection duct part 85, caused by manufacturing tolerance.

The clatter occurs due to a gap-induced relative displacement or relative movement of the lower guide 831 with respect to the connection duct part 85.

According to the present disclosure, at least one protruding rib may be included as a means of minimizing a gap between the lower guide 831 and the connection duct part 85, in particular, a means of limiting a relative downward movement to the connection duct part 85.

Referring to FIG. 21, at least one protruding rib may protrude downward from the lower end 8312*b* of the duct coupling part 8312 toward a male screw part 8541 provided on the outer circumferential surface of the duct main body 851 of the connection duct part 85.

That is, the airflow guide 83 of the dishwasher of one embodiment may adjust the amount of a generated gap and limit a relative downward movement through the male screw part 8514 of the duct main body 851 disposed at the lower portion side of the duct coupling part 8312.

Accordingly, as a relative downward movement of the airflow guide 83, i.e., a relative downward movement of the lower guide 831, is made, the relative movement of the lower guide 831 may be limited in a way that the lower end surface of at least one protruding rib contacts one side surface of the male screw part 8514.

FIG. 21 shows at least one protruding rib comprising a first protruding rib 8312*h*1, a second protruding rib 8312*h*2 and a third protruding rib 8312*h*3 that are disposed around a circular opening formed at the lower end 8312*b* of the duct coupling part 8312 of the lower guide 831 at regular intervals, for example. Hereafter, at least one protruding rib comprising the first protruding rib 8312*h*1, the second protruding rib 8312*h*2 and the third protruding rib 8312*h*3 is described but not limited.

As illustrated, the first protruding rib **8312*h*1, the second protruding rib 8312*h*2 and the third protruding rib 8312*h*3**, disposed at regular intervals along the circumferential direction, may have the same cross-sectional shape. For example, a cross section in a direction perpendicular to the direction in which the protruding rib protrudes may have an approximately rectangular shape.

That is, the protruding ribs **8312*h*1, 8312*h*2, 8312*h*3 may be formed into a rectangular pillar having the same circumferential width and the same radial width and protrude from the lower end 8312*b* of the duct coupling part 8312**.

However, the heights at which the first protruding rib **8312*h*1, the second protruding rib 8312*h*2 and the third protruding rib 8312*h*3 protrude downward from the lower end 8312*b* of the duct coupling part 8312** may be set differently.

That is, the first protruding rib **8312*h*1, the second protruding rib 8312*h*2 and the third protruding rib 8312*h*3 protrude toward the male screw parts 8514 that extend spirally in different positions. A maximum height of the first protruding rib 8312*h*1, the second protruding rib 8312*h*2 and the third protruding rib 8312*h*3 may differ such that a gap between the first, second and third protruding ribs 8312*h*1, 8312*h*2, 8312*h*3 and the male screw part 8514** remains constant in the position of each of the protruding ribs.

For example, the first protruding rib **8312*h*1 may protrude at a first height that is the smallest value, the second protruding rib 8312*h*2 may protrude at a second height greater than the first height, and the third protruding rib 8312*h*3** may protrude at a third height greater than the second height.

The first protruding rib **8312*h*1, the second protruding rib 8312*h*2 and the third protruding rib 8312*h*3, as described hereafter, may be disposed clockwise consecutively, when viewed from the upper portion side of the airflow guide 83**.

Additionally, the lower end surfaces of the first protruding rib **8312*h*1, the second protruding rib 8312*h*2 and the third protruding rib 8312*h*3 may be provided in the form of an inclined surface, in response to the shape of one side surface of the male screw part 8514** that extends spirally.

Detailed configurations of the first protruding rib **8312*h*1, the second protruding rib 8312*h*2 and the third protruding rib 8312*h*3 are described below with reference to FIGS. 28 and 29**.

Further, at least one upper guide holding projection **8312*g* may be integrally formed on the outer circumferential surface of the duct coupling part 8312 and couple the upper guide 832 described hereafter and the lower guide 831** mutually.

At least one upper guide holding projection **8312*g* may have a lamp surface having a predetermined inclination angle with respect to the outer circumferential surface of the duct coupling part 8312, and a stepped surface formed approximately perpendicularly with respect to the outer circumferential surface of the duct coupling part 8312, such that a coupling based on the downward movement of the upper guide 832 is readily ensured but a separation based on the upward movement of the upper guide 832** is not readily ensured.

Further, the channel guide surface 8313 guiding dry airflow F, having passed through the upper end **8312*a* of the duct coupling part 8312, to the discharge opening 833 may be formed at the front side of the duct coupling part 8312**.

As illustrated in FIG. 19, a curved surface of an inclined surface may be formed continuously between the upper end and the lower end of the channel guide surface 8313 to minimize flow loss of dry airflow F and the amount of generated flow noise. The upper end of the channel guide surface 8313 may extend to the approximately same height as the upper end **8312*a* of the duct coupling part 8312, and the lower end may extend in a curved surface shape or an inclined surface shape to the reference surface 8311*a* of the lower guide 831**.

Specifically, the channel guide surface 8313 may be a concave surface that is provided in a way that the channel guide surface 8313 is surrounded by the rear surface of the duct coupling part 8312 and a boundary wall **8313*d***.

That is, the channel guide surface 8313 may be formed into a concave surface to prevent droplets of wash water, which collide with the first edge wall **8311*b*, then are scattered and come in, from moving to the duct coupling part 8312 and the connection duct part 85, after the droplets collide with the channel guide surface 8313** and are scattered again.

That is, the shape of the channel guide surface 8313 may be formed such that a gap between the channel guide surface 8313 and the upper end surface 8321 of the upper guide 832 remains big to prevent the rescattered droplets of the wash water from bouncing.

For example, the channel guide surface 8313 may comprise a first inclined surface **8313*a* extending from the reference surface 8311*a* in a direction across the duct coupling part 8312, a second inclined surface 8313*c* having an extension width much less than the first inclined surface 8313*a*, and a curved surface part 8313*b* disposed between the first inclined surface 8313*a* and the second inclined surface 8313*c***.

The first inclined surface corresponds to a portion occupying most of the surface area of the channel guide surface 8313. Additionally, the reference surface **8311*a* and the first inclined surface 8313*a* are disposed in succession. To suppress the rescattering of wash water to a maximum degree, the first inclined surface 8313*a* is formed into a flat surface having a minimum climb angle. For example, the climb angle of the first inclined surface 8313*a*** may be about 10 degrees or so with respect to the reference surface.

The curved surface part **8313*b* and the second inclined surface 8313*c* are followed by the first inclined surface 8313*a*** to prevent a rapid change in the inner flow path in which dry airflow F flows.

The second inclined surface **8313*c*, as illustrated, may be formed into a flat surface, like the first inclined surface 8313*a*, but has a climb angle much greater than that of the first inclined surface 8313*a***.

For example, the climb angle of the second inclined surface **8313*c* may be about 80 degrees or so with respect to the reference surface 8311*a***.

Additionally, the lower guide 831 of the airflow guide 83 of one embodiment may comprise a division wall 8314 that protrudes upward from the upper end **8312*a* of the duct coupling part 8312 as a third means of minimizing the flow of wash water into the airflow guide 83 and the connection duct part 85 through the discharge opening 833**.

The division wall 8314 finally blocks droplets of wash water, which have passed through the above-described blocking rib 8328 and blocking wall 8329 in the state of being scattered after a collision, from entering into the duct coupling part 8312.

To this end, the division wall 8314, as illustrated in FIGS. 19, 20 and 22, may protrude upward from the upper end **8312*a* of the duct coupling part 8312, divide the area where the duct coupling part 8312 is formed and the area where the channel guide surface 8313 is formed, and extend in the form of a barrier that blocks the upper end of the duct coupling part 8312**.

That is, the division wall 8314 may be boundary wall that is disposed between the duct coupling part area and the channel guide surface area and distinguishes the duct coupling part area from the channel guide surface area.

As illustrated, the thickness of the division wall 8314 may remain constant from the right end portion thereof to the left end portion thereof.

At this time, the right end portion of the division wall 8314 may be a free end portion, and the left end portion may extend to the boundary wall 8313*d* and integrally connect to the boundary wall 8313*d*.

Additionally, to minimize flow resistance of dry airflow F moving toward the channel guide surface 8313 past the division wall 8314, the up-down position of the upper end of the division wall 8314 may remain constant approximately from the right end portion thereof to the left end portion thereof.

However, the up-down position of the upper end of the division wall 8314 may be lower than the upper end 8511 of the duct main body 851 and higher than the lower end edge of the blocking wall 8329 of the upper guide 832 such that the division wall 8314 blocks scattered droplets effectively while avoiding interference with the flow of dry airflow F and preventing a rapid increase in the flow resistance of dry airflow F.

That is, the up-down position of the upper end of the division wall 8314 may be higher than that of the lower end edge 8329*b*3 of the second blocking wall 8329*b* that is in the highest position of the lower end edge of the blocking wall 8329 of the upper guide 832.

Figure 23:
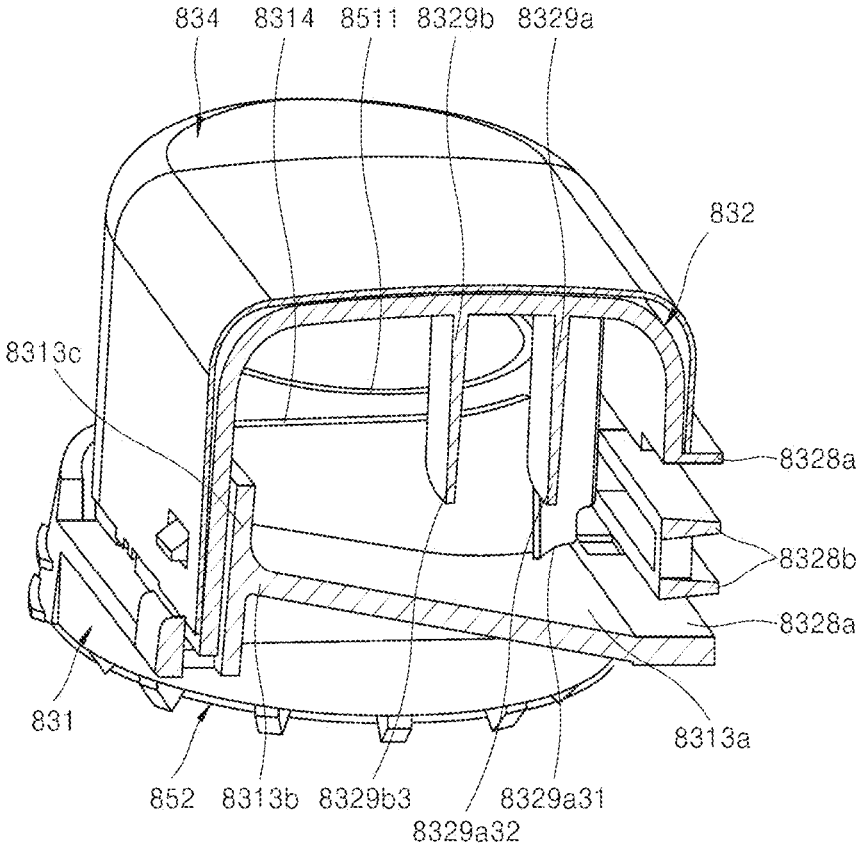
FIG. 23 is a perpendicular cross-sectional view showing a cross section in the state where the airflow guide is coupled to the connection duct part.

Hereafter, a means of preventing the inflow of wash water, provided at the airflow guide 83 of the dishwasher 1 of one embodiment, is described with reference to FIGS. 23 and 24.

As describe above, the discharge opening 833 of the airflow guide 83 spraying dry air to the wash space 21 of the tub 20 is open in the wash space 21.

Additionally, since the dry air supply part 80 is in a non-operation state in the washing stage or the rinsing stage, it is highly likely that wash water is scattered in a droplet state and flows into the inner flow space of the airflow guide 83 through the discharge opening 833. The droplets of the incoming wash water may also be recondensed in the airflow guide 83, pass through the duct coupling part 8312 and then flow into the dry air supply part 80.

To prevent the inflow of wash water, the airflow guide 83 of one embodiment is provided with a means of preventing the inflow of wash water as follows.

The first rib 8328*a* may be provided at the upper end edge, the front edge and the rear edge of the first notch hole 8324 and extend in a shade shape, and at least one second rib 8328*b* may be provided in the first notch hole 8324 and extend across the first notch hole 8324 along the front-rear direction (F-R direction).

By doing so, the inflow of droplets of wash water directly passing through the discharge opening 833 or the first notch hole 8324 may be blocked primarily.

Further, the first blocking wall 8329*a* and the second blocking wall 8329*b* may be provided in the first notch hole 8324, and extend downward from the lower portion of the upper end surface 8321 of the upper guide 832 to at least partially cover the upper portion side of the discharge opening 833 or the first notch hole 8324.

Among droplets of wash water that flows into the airflow guide 83 in the state of being scattered through the first notch hole 8324, droplets bouncing upward collide with the first blocking wall 8329*a* and the second blocking wall 8329*b* and move downward along the first blocking wall 8329*a* and the second blocking wall 8329*b*.

The first blocking wall 8329*a* and the second blocking wall 8329*b*, as illustrated, are disposed in the channel guide surface area. Accordingly, droplets of wash water, which are blocked by the first blocking wall 8329*a* and the second blocking wall 8329*b*, may flow down to the channel guide surface 8313 by using gravity.

Further, droplets of wash water, which are not blocked by the first blocking wall 8329*a* and the second blocking wall 8329*b*, may be finally blocked from moving toward the duct coupling part 8312 by the division wall 8314 that protrudes upward from the upper end 8312*a* of the duct coupling part 8312.

As describe above, the up-down position of the upper end of the division wall 8314 is higher than the up-down positions of the lower end edge 8329*a*3 of the first blocking wall 8329*a* and the lower end edge 8329*b*3 of the second blocking wall 8329*b*.

Thus, droplets of wash water having flown into the airflow guide 83 may be blocked from moving to the duct coupling part 8312 while colliding with the first blocking wall 8329*a* and the second blocking wall 8329*b*, but droplets of wash water, which avoid the first blocking wall 8329*a* and the second blocking wall 8329*b* and are scattered toward the duct coupling part 8312 while colliding with the channel guide surface 8313, may collide with the division wall 8314 without bouncing higher than the upper end of the division wall 8314.

As described about the first blocking wall 8329*a* and the second blocking wall 8329*b*, droplets of wash water, which collide with the division wall 8314 and are blocked by the division wall 8314, may flow down to the channel guide surface 8313 along the division wall 8314 by using gravity without moving toward the duct coupling part past the upper end of the division wall 8314.

As described above, droplets of wash water, blocked by the first blocking wall 8329*a* and the second blocking wall 8329*b*, and droplets of wash water, blocked by the division wall 8314, may move to the channel guide surface 8313 and naturally be discharged to the bottom tub 20*c* through the discharge opening 833.

Additionally, the upper end 8511 of the duct main body 851 protrudes to a position higher than the division wall 8314 of the lower guide 831 while protruding upward from the upper end 8312*a* of the duct coupling part 8312 of the lower guide 831.

Accordingly, even if droplets of washer are produced past the upper end of the division wall 8314, it is highly likely that the droplets do not reach the upper end 8511 of the duct main body 851 that is disposed in a higher position than the upper end of the division wall 8314 with respect to the up-down direction.

Further, wash water may be collected on the lower surface 25 of the tub 20 at a predetermined water level or above, in the washing stage or the rinsing stage.

An increasing water level of wash water may lead to the flow of wash water into the airflow guide 83 through the discharge opening 833 of the airflow guide 83 and the infiltration of water into a gap between the inner circumferential surface 8312*c* of the duct coupling part 8312 and the outer circumferential surface of the duct main body 851.

That is, the airflow guide 83 itself is likely to be submerged by wash water.

However, even if the airflow guide 83 is submerged as described above, wash water having flown into the airflow guide 83 may be discharged out of the airflow guide 83 along the channel guide surface 8313 through the discharge opening 833 again in the state where the water level of the wash water does not exceed the upper end of the division wall 8314.

Additionally, even if the water level of wash water exceeds the upper end of the division wall 8314, the height of the division wall 8314 remains lower than the height of the upper end 8511 of the duct main body 851, as described above. Thus, the wash water may not reach the upper end 8511 of the duct main body 851, and the wash water having arrived at the upper end 8312*a* of the duct coupling part 8312 may be discharged from the upper end 8312*a* of the duct coupling part 8312 to the lower surface 25 of the tub 20 again, through the gap between the inner circumferential surface 8312*c* of the duct coupling part 8312 and the outer circumferential surface of the duct main body 851.

By setting the height of the division wall 8314, the height of the upper end 8312*a* of the duct coupling part 8312 and the height of the upper end 8511 of the duct main body 851, wash water may be prevented from flowing into the heater housing 81 and the heater effectively past the upper end 8511 of the duct main body 851 even if the wash water is scattered ad flows into the airflow guide 83 or submerges the airflow guide 83.

Further, the airflow guide 83 of the dishwasher 1 of one embodiment may help to minimize resistance against the flow of dry airflow f supplied through the upper end 8511 of the duct main body 851 of the connection duct part 85 while blocking and minimizing the movement of droplets of wash water coming in through the first notch hole 8324 and the discharge opening 833 to the duct coupling part 8312 and the duct main body 851, based on the positions of the blocking rib 8328 of the upper guide 832, the blocking wall 8329, the division wall 8314 of the lower guide 831, and the upper end 8511 of the duct main body 851.

Figure 24:
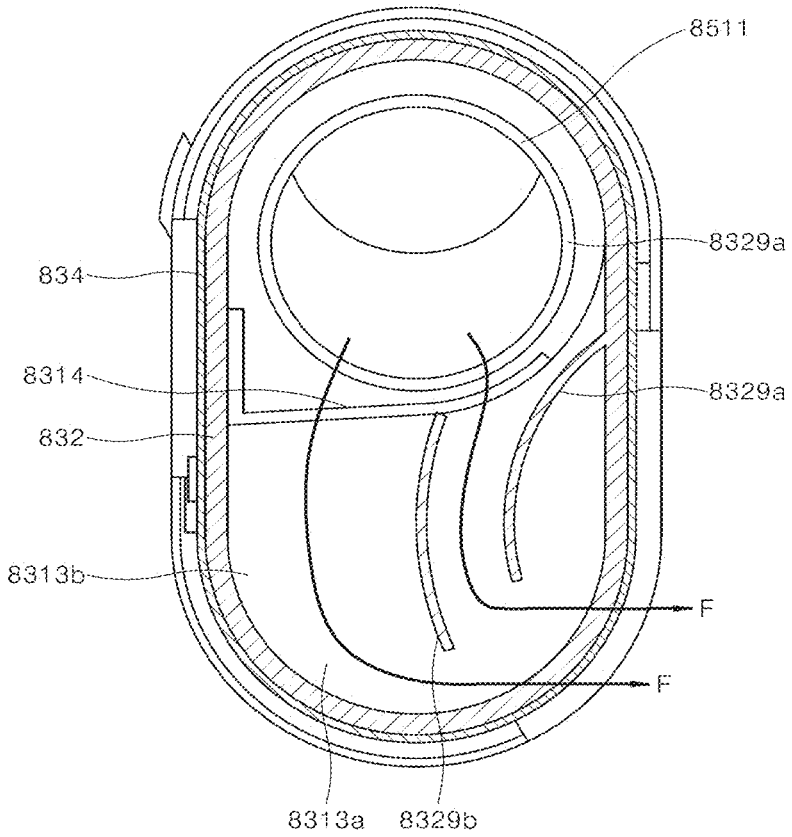
FIG. 24 is a horizontal cross-sectional view showing a cross section in the state where the airflow guide is coupled to the connection duct part.

Specifically, since the height of the upper end of the division wall 8314 remains lower than the upper end 8511 of the duct main body 851 into which dry airflow F flows, as illustrated in FIG. 24, the division wall 8314's resistance against the flow of dry airflow F having passed through the upper end 8511 of the duct main body 851 may be minimized.

Further, the flow path of dry airflow F having passed through the upper side of the division wall 8314 is partially blocked by the first blocking wall 8329*a* and the second blocking wall 8329*b*, but the lower end edge 8329*a*3 of the first blocking wall 8329*a* and the lower end edge 8329*b*3 of the second blocking wall 8329*b* are spaced upward from the channel guide surface 8313 by a predetermined distance.

Accordingly, the dry airflow F may flow effectively through a space between the lower end edge 8329*a*3 of the first blocking wall 8329*a* and the channel guide surface 8313 and a space between the lower end edge 8329*b*3 of the second blocking wall 8329*b* and the channel guide surface 8313.

Further, the other end edge 8329*a*2 of the first blocking wall 8329*a* and the other end edge 8329*b*2 of the second blocking wall 8329*b* may be respectively separated from the outer wall surface of the upper guide 832.

Thus, dry airflow F may flow effectively through a space between the other end edge 8329*a*2 of the first blocking wall 8329*a* and the outer wall surface of the upper guide 832 and a space between the other end edge 8329*b*2 of the second blocking wall 8329*b* and the outer wall surface of the upper guide 832.

The above-described configurations of the first blocking wall 8329*a* and the second blocking wall 8329*b* may help to minimize an increase in the flow resistance against dry airflow F and maximize a flow path of dry airflow F.

[Assembly of Airflow Guide and Means of Limiting Relative Movement]

Hereafter, the process of assembling and fixing the airflow guide 83 of one embodiment to the connection duct part 85 and a means of limiting movement relative to the connection duct part are described with reference to FIGS. 25A to 27B.

As described above, the lower guide 831 may be coupled to the duct main body 851 of the connection duct part 85 based on a two-stage coupling manipulation. Preferably, the two-stage coupling manipulation may include an up-down simple perpendicular movement manipulation and a circumferential simple rotational movement manipulation.

Figure 25A:
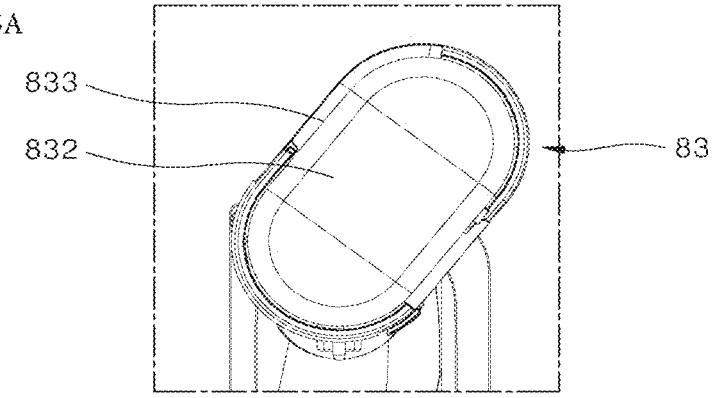
FIGS. 25A to 27B are plan views and front views showing the process of assembling the airflow guide of the dishwasher of one embodiment to the connection duct part.
Figure 25B:
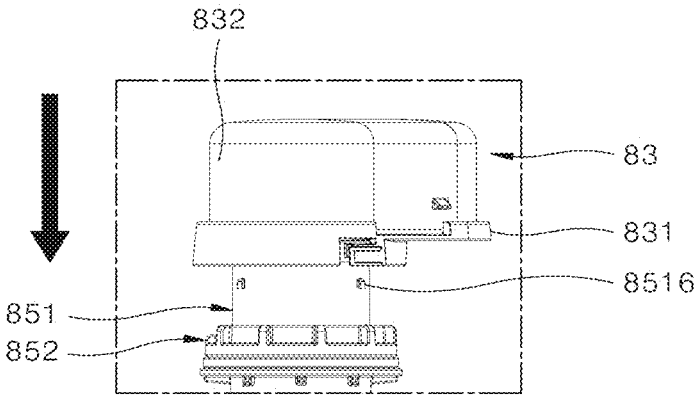

For the up-down perpendicular movement manipulation, in the state where the cap cover 834 and the upper guide 832 are coupled to the lower guide 831, the airflow guide 83 may be arranged to be disposed at the upper side of the duct main body 851 of the connection duct part 85, as illustrated in FIGS. 25A and 25B.

At this time, the central axes of the duct main body 851 and the duct coupling part 8312 may be aligned in the up-down direction (U-D direction) to be inserted into the lower end 8312*b* of the duct coupling part 8312 of the lower guide 831 of the upper end 8511 of the duct main body 851.

Additionally, the airflow guide 83 may be rotated clockwise around the duct coupling part 8312 from the fixed position within a predetermined range of angles. The position of the airflow guide 83 rotated clockwise is a position in which the guide projection 8516 formed on the outer circumferential surface of the duct main body 851 can be inserted into the first guide groove 8312*d* of the duct coupling part 8312.

When the arrangement of the airflow guide 83 is completed with respect to the duct main body 851 as illustrated, the airflow guide 83 moves perpendicularly in the downward direction (D-direction) along the direction indicated by the arrow in FIGS. 25A and 25B such that the upper end 8511 of the duct main body 851 is inserted into the lower end 8312*b* of the duct coupling part 8312. Accordingly, the guide projection 8516 of the duct main body 851 may be inserted into the lower end portion of the first guide groove 8312*d*.

In the state where the guide projection 8516 of the duct main body 851 is inserted into the lower end portion of the first guide groove 8312*d* as described above, as the airflow guide 83 perpendicularly moves in the downward direction (D-direction), the up-down perpendicular movement manipulation of the airflow guide 83 starts.

Accordingly, the movement of the first guide groove 8312*d* of the duct coupling part 8312 is guided by the guide projection 8516 that stands still, and the first guide groove 8312*d* perpendicularly moves in the downward direction (D-direction).

Figure 26A:
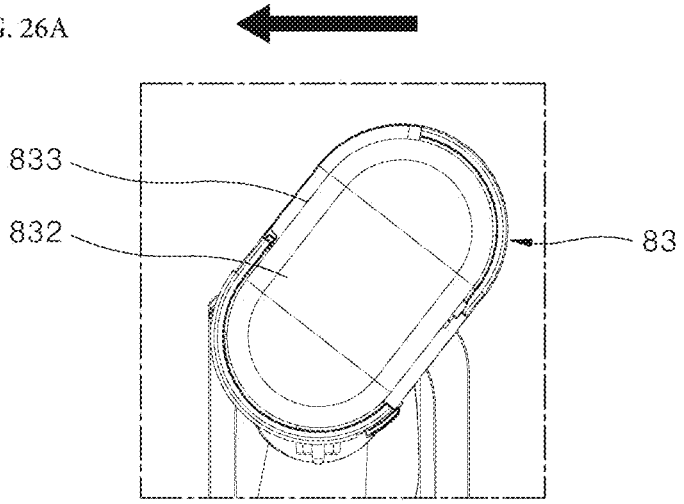
Figure 26B:
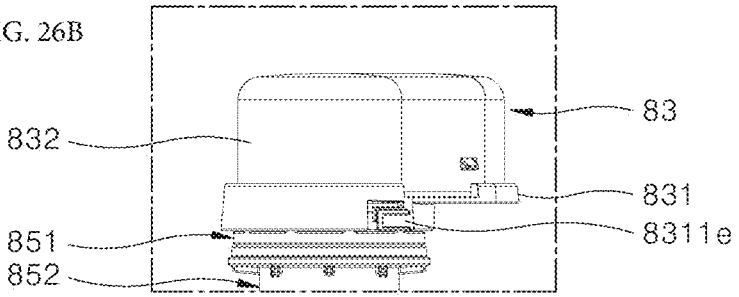

As the guide projection reaches the upper end of the first guide groove 8312*d* as illustrated in FIGS. 26A and 26B, the airflow guide 83 may not perpendicularly move in the downward direction (D-direction) any longer, based on the guide projection 8516's action.

At this time, since the guide projection 8516 reaches one end portion of the second guide groove 8312*e*, the airflow guide 83 may not make a perpendicular movement in the downward direction (D-direction), but may make a rotational movement circumferentially along the direction indicated by the arrow in FIG. 26A.

For the circumferential rotational movement manipulation of the two-stage coupling manipulation, as the airflow guide 83 rotates counterclockwise along the direction indicated by the arrow, the second guide groove 8312*e* may start to make a rotational movement counterclockwise along the guide projection 8516 that sands still.

As the airflow guide 83 starts to make a rotational movement counterclockwise, the guide projection 8516 reaches a stopper projection 8312*f* that is disposed near the other end portion of the second guide groove 8312*e*.

At this time, stick-slip in relation to the rotation of the airflow guide 83 may be formed by the stopper projection 8312*f*, and as a rotational force is additionally applied, the guide projection 8516 may go over the stopper projection 8312*f*.

Then as the guide projection 8516 reaches the other end portion of the second guide groove 8312*e* past the stopper projection 8312*f*, the airflow guide 83 may not rotate counterclockwise any longer because of the guide projection 8516's action.

Figure 27A:
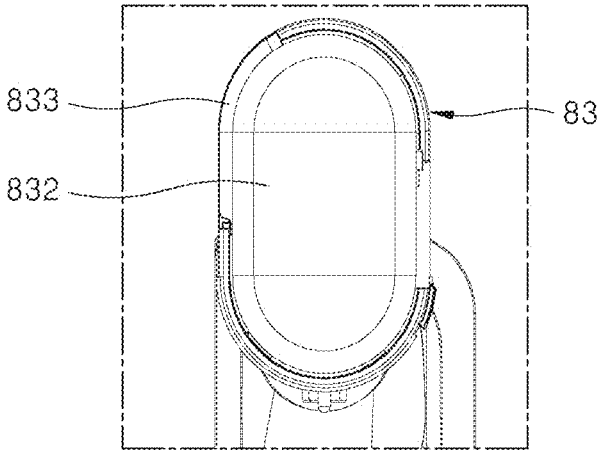
Figure 27B:
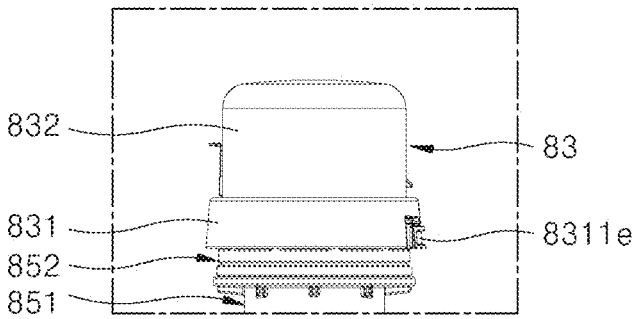

When the airflow guide 83 cannot rotate any longer as described above, the coupling between the lower guide 831 and the duct main body 851 may be completed, and as long as another external force is not applied, the guide projection may be fixed to the other end portion side of the second guide groove 8312*e* by the stopper projection 8312*f*, as illustrated in FIGS. 27A and 27B.

Accordingly, the airflow guide 83 may be disposed in a fixed position of the connection duct part 85, based on a very simple manipulation or assembly process comprising the simple perpendicular movement manipulation and the simple rotational movement manipulation.

However, as the arrangement of the airflow guide 83 is completed, the self weight-induced movement of the airflow guide 83 is impossible, but as strong external force is applied, the second guide groove 8312*e* and the guide projection 8516 are likely to be easily unheld from each other.

Further, the lower guide 831 and the airflow guide 83 are highly likely to clatter because of a gap between the duct coupling part 8312 of the lower guide 831 and the duct main body 851 of the connection duct part 85, caused by manufacturing tolerance.

To prevent the second guide groove 8312*e* and the guide projection 8516 from being unheld from each other and keep them fixed in their fixed positions, the release prevention part 8311*e* may be provided.

The release prevention part 8311*e*, as described above, may be integrally formed on the second edge wall 8311*c* of the lower guide 831 in a way that a L-shaped notch is formed at the lower end side of the second edge wall 8311*c* of the lower guide 831, i.e., in a way that the lower end of the second edge wall 8311*c* is partially cut.

Preferably, the release prevention part 8311*e* may be disposed near the left edge side of the guide main body 8311 of the lower guide 831, on the second edge wall 8311*c*.

Figure 28:
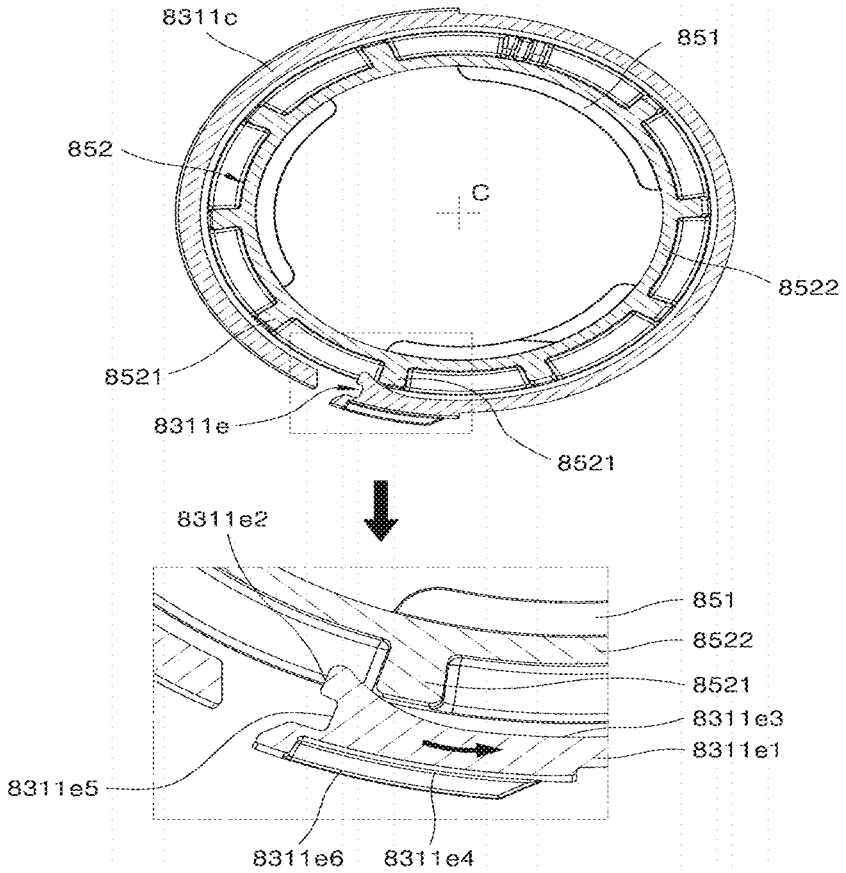
FIGS. 28 and 29 are cross-sectional views for describing the structure and function of a release prevention part provided at the airflow guide.
Figure 29:
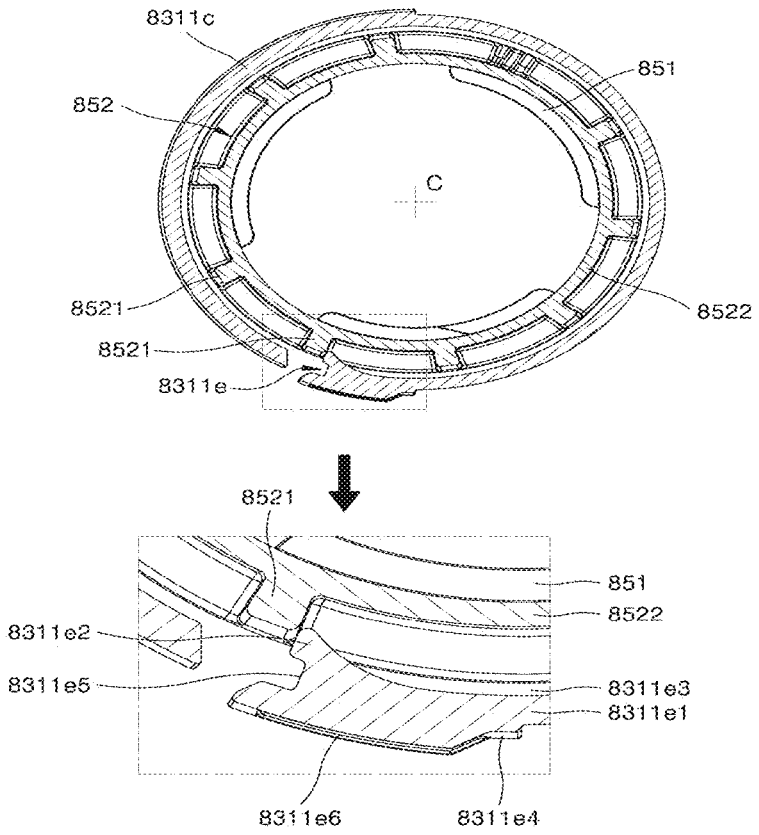

Specifically, the release prevention part 8311*e* may be formed into a circular arc-shaped plate that is disposed in a way that surrounds the circumference of the fastening nut 852 disposed inside the second edge wall 8311*c*, in a circular arc shape, and is elastically deformable, as illustrated in FIGS. 28 and 29.

One end portion of the release prevention part 8311*e* functions as a fixation end portion 8311*e*1 integrally connecting to the second edge wall 8311*c*. As described hereafter, the fixation end portion 8311*e*1 may also provide resilient force or elastic force to the other end portion side that is deformed at a time of rotational movement manipulation for installing and fixing the airflow guide 83.

The other end portion of the release prevention part 8311*e* separates from the second edge wall 8311*c* and functions as a free end portion 8311*e*2, and directly contacts one lateral surface of the stopper 8521 provided in the upper portion of the fastening nut 852 to stop the rotation of the lower guide 831.

To keep the free end portion 8311*e*2 contacting and holding the stopper 8521 directly and effectively, the radial thickness of the free end portion 8311*e*2 may be greater than the radial thickness of the fixation end portion 8311*e*1.

Specifically, as illustrated, a distance between an outer circumferential surface 8311*e*4 of the release prevention part 8311*e* and the central axis C of the duct coupling part 8312 remains constant, and an inner circumference surface 8311*e*3 of the release prevention part 8311*e* may comprise a portion where a distance from the central axis C of the duct coupling part 8312 remains constant, and a portion where a distance from the central axis C of the duct coupling part 8312 changes.

As illustrated, the inner circumferential surface 8311*e*3 of the release prevention part 8311*e* may comprise a non-contact surface that stays in no contact with the radial outer end portion of the stopper 8521, and a contact surface that is in contact with the radial outer end portion of the stopper 8521, for example.

The non-contact surface extends toward the free end portion 8311*e*2 from the fixation end portion 8311*e*1, has the same curvature as the outer circumferential surface 8311*e*4 and corresponds to a portion where a distance from the central axis C of the duct coupling part 8312 remains constant.

The contact surface extends to the free end portion 8311*e*2 from the position where the non-contact surface ends and corresponds to a portion where a distance from the central axis C of the duct coupling part 8312 decreases gradually.

The free end portion 8311*e*2 corresponding to the position where the contact surface ends may protrude further inward than the radial outer end portion of the stopper 8521 in the state where the release prevention part 8311*e* is not deformed as illustrated in FIG. 28.

Additionally, the contact surface corresponds to a portion that is directly pressurized by the radial outer end portion of the stopper 8521 while the lower guide 832 rotates.

Accordingly, the contact surface may be formed into a curved surface or an inclined surface such that the relative movement of the radial outer end portion of the stopper 8521 is smoothly made and frictional force decreases, for example.

Further, a tool groove 8311*e*5 may be formed on the end portion surface of the free end portion 8311*e*2 of the release prevention part 831*ie* and be concave toward the fixation end portion 8311*e*1 side with respect to the circumferential direction.

In the state where the airflow guide 83 is fixed in the fixed position completely, even if external force is applied, the airflow guide 83 is configured not to rotate in a direction where the airflow guide 83 separates from the connection duct part 85 as long as the release prevention part 8311*e* or the stopper 8521 is not broken.

Additionally, the airflow guide 83 is formed in a position farthest from the front surface of the tub 20, and the release prevention part 8311*e* is formed in a position facing the left side surface of the bottom tub 20*c*. The positions are hardly reached by the user, and the user cannot undo the holding state between the release prevention part 8311*e* and the stopper 8521 easily without an additional tool.

For the user to easily deform the release prevention part 8311*e* and undo the holding state between the free end portion 8311*e*2 of the release prevention part 8311*e* and the stopper 8521 with an ordinary tool such as a screwdriver and the like, the tool groove 8311*e*5 may be provided on the end portion surface of the free end portion 8311*e*2 of the release prevention part 8311*e*.

At this time, the tool groove 8311*e*5 may have a polygonal cross section as illustrated for an ordinary tool to be readily held at a time of undoing the holding state. FIGS. 28 and 29 show an embodiment comprising a tool groove 8311*e*5 having a cross section of a C shape, among polygons, for example.

Additionally, the release prevention part 8311*e* is configured to repeat elastically deformation at a time of assembling and separating the airflow guide 83.

Repetitive deformation may result in fatigue fracture. To prevent fatigue fracture, at least one reinforcement rib 8311*e*6 may be integrally provided on the outer circumferential surface 8311*e*4 of the release prevention part 8311*e* and protrude outward in the radial direction.

Hereafter, a relationship between the stopper 8521 of the fastening nut 852 and the operation of the release prevention part 8311*e* in the coupling process of the airflow guide 83 is described.

As described above, the lower guide 831 of the airflow guide 83 may be coupled to the duct main body 851 of the connection duct part 85 based on the two-stage coupling manipulation comprising a simple up-down perpendicular movement manipulation and a simple circumferential rotational movement manipulation.

As the up-down perpendicular movement manipulation is completed, the free end portion 8311*e*2 of the release prevention part 8311*e* may be disposed in a space between a pair of stoppers 8521 that are adjacent to each other with respect to the circumferential direction, as illustrated in FIG. 28.

As illustrated, the space between the pair of adjacent stoppers 8521 may be embodied by a circular arc groove that is open toward the outside in the upward direction and the radial direction.

As the circumferential rotational movement manipulation starts after the up-down perpendicular movement manipulation is completed, out of the pair of stoppers 8521, the radial outer end portion of a stopper 8521 disposed forward with respect to the rotation direction of the airflow guide 83, and the contact surface of the release prevention part 8311*e* may start to contact each other.

As the radial outer end portion of the stopper 8521 and the contact surface of the release prevention part 8311*e* start to contact, the rotational force of the airflow guide 83 is converted into a pressurizing force against the release prevention part 8311*e*.

Accordingly, the release prevention part 8311*e* is pressurized by the stopper 8521 that stands still, and is pushed gradually outward in the radial direction from an initial position that is no load state and starts to be elastically deformed.

At this time, the release prevention part 8311*e* may be elastically deformed continuously to the position where the free end portion 8311*e*2's contact with the radial outer end portion of the stopper 8521 is undone.

Thus, as illustrated in FIG. 29, as the contact between the free end portion 8311*e*2 of the release prevention part 8311*e* and the stopper 8521 is undone, the release prevention part 8311*e* may instantly return to the initial position with a click by using elasticity.

The free end portion 8311*e*2 of the release prevention part 8311*e* protrudes to the inside of a circular arc groove formed at the front side of the stopper 8521 at the same time as the release prevention part 8311*e* returns to the initial position.

Accordingly, once the free end portion 8311*e*2 of the release prevention part 8311*e* enters into the circular arc groove, based on the counterclockwise rotation of the airflow guide 83, as illustrated, the clockwise rotation opposite to the counterclockwise rotation must be limited by the lateral surface of the stopper 8521.

By doing so, a rotational movement in a direction where the airflow guide 83 separates from the duct main body 851 of the connection duct part may be prevented effectively through the release prevention part 8311*e* and the stopper 8521.

However, in the state where a rotational movement is not completed during the two-stage coupling manipulation, the free end portion 8311*e*2 of the release prevention part 8311*e* may rotate toward another adjacent stopper 8521 past the previous stopper 8521. At this time, the free end portion 8311*e*2 of the release prevention part 83711*e* may continue to rotate further while going over another stopper 8521, in the same way described above, and the airflow guide 83's rotation in the opposite direction may be limited in the same way.

The additional rotational movement may be performed until the guide projection provided at the duct main body 851 reaches the other end portion of the second guide groove 8312*e*, as described above.

Additionally, a relative movement, in particular, a downward relative movement, of the airflow guide 83, caused by a gap between the second guide groove 8312*e* and the guide projection 8516, may be limited and minimized through the first protruding rib 8312*h*1, the second protruding rib 8312*h*2 and the third protruding rib 8312*h*3 that protrude downward from the lower end 8312*b* of the duct coupling part 8312.

Figure 30:
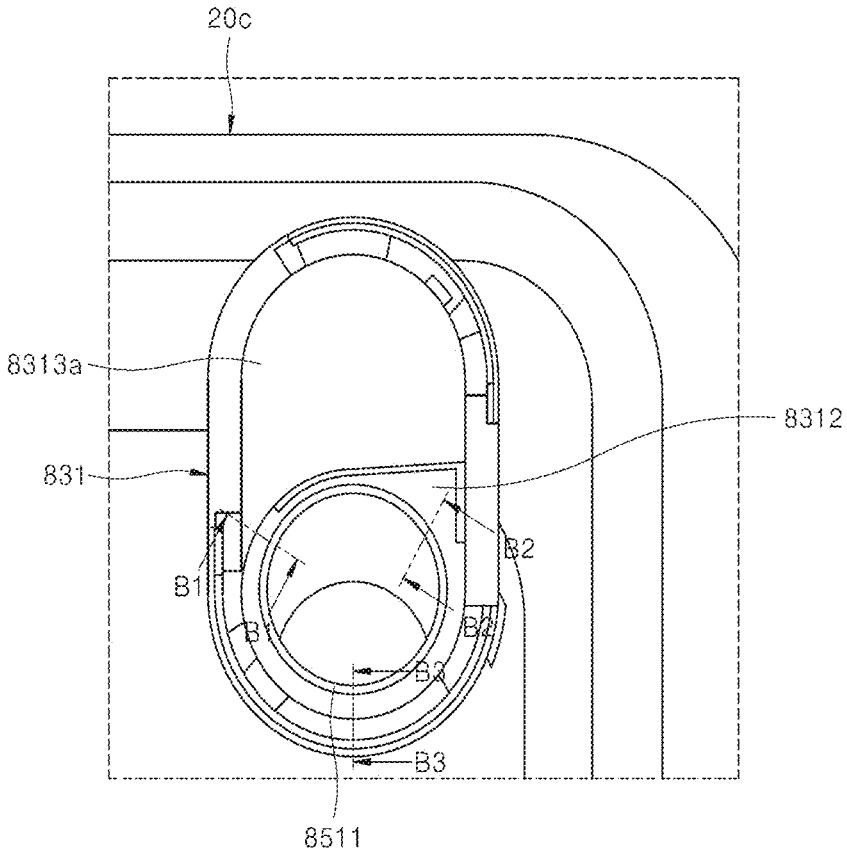
FIG. 30 is a partial enlarged view showing the state where the airflow guide is assembled to the connection duct part completely.

FIG. 30 shows that the airflow guide 83 is arranged in a fixed position completely. For convenience, the cap cover 834 and the upper guide 832 are omitted in FIG. 30.

As the fixation and arrangement of the airflow guide 83 are completed as illustrated in FIG. 30, a gap having a predetermined width may be formed between the first to third protruding ribs 8312*h*1, 8312*h*2, 8312*h*3 and the male screw part 8514 of duct main body 851 respectively.

As illustrated in the cross-sectional views of FIGS. 32 to 34, the first protruding rib 8312*h*1, the second protruding rib 8312*h*2 and the third protruding rib 8312*h*3, disposed at regular intervals around the circular opening formed at the lower end 8312*b* of the duct coupling part 8312, may have a different maximum protrusion height such that the gap between the protruding ribs and the male screw part 8514 is maintained at a predetermined level or below in the position of each of the protruding ribs.

At this time, a gap between the first protruding rib 8312*h*1 and the male screw part 8514 of the duct main body 851, a gap between the second protruding rib 8312*h*2 and the male screw part 8514 of the duct main body 851, and a gap between the third protruding rib 8312*h*3 and the male screw part 8514 of the duct main body 851 may differ depending on manufacturing tolerance of each of the protruding ribs.

However, the entire amount of a downward relative movement of the airflow guide 83 may be limited based on a gap having a maximum width among the gaps.

At this time, the maximum width of a gap may be 0.01 mm or less, for example.

Since the maximum gap is limited to 0.01 mm or less, the user may not recognize a clatter caused by the amount of relative movement or displacement corresponding to 0.01 mm or less even though each of the protruding ribs 8312*h*1, 8312*h*2, 8312*h*3 does not directly contact the male screw part 8514 of the duct main body 851.

Figure 31:
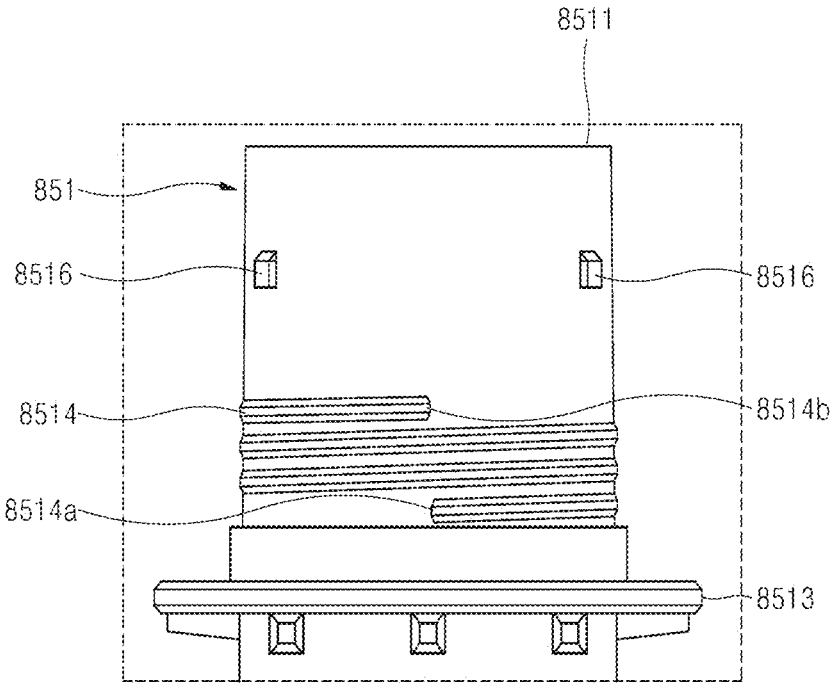
FIG. 31 is a partial enlarged view showing a connection duct part to which an airflow guide is assembled.

Further, as illustrated in FIG. 31, the male screw part 8514 of the duct main body 851, when viewed from above, may be provided as a right-handed screw to be tightened clockwise.

Thus, the male screw part 8514 extends in a spiral shape the up-down position of which gradually becomes low clockwise, when viewed from above.

When viewed from above, the first protruding rib 8312*h*1, the second protruding rib 8312*h*2 and the third protruding rib 8312*h*3 may be consecutively disposed clockwise such that the gap between each of the protruding ribs 8312*h*1, 8312*h*2, 8312*h*3 and the male screw part 8541 of the duct main body 851 remains similar approximately.

That is, the protrusion heights of the protruding ribs 8312*h*1, 8312*h*2, 8312*h*3 may gradually become high clockwise in response to the position of the male screw part 8514 of the duct main body 851 that gradually becomes low clockwise.

Accordingly, the counterclockwise rotational movement manipulation starts in the state where the perpendicular movement manipulation is completed, the gap between each of the protruding ribs 8312*h*1, 8312*h*2, 8312*h*3 and the male screw part 8514 of the duct main body 851 may decrease gradually.

Additionally, as illustrated in FIG. 31, the male screw part 8514 of the duct main body 851 may have at least three or more windings from an upper end 8514*b* thereof to a lower end 8514*a* thereof, for example.

Figure 32:
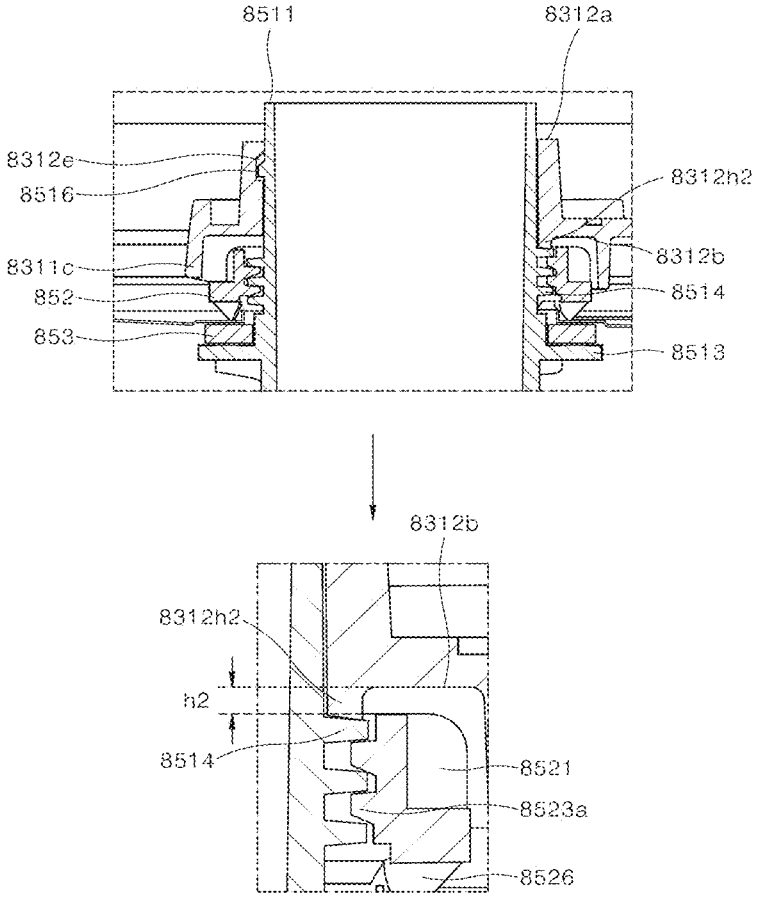
FIGS. 32 to 34 are cross-sectional views showing the cross sections of the airflow guide, the connection duct part and the bottom tub in FIG. 30, which are cut in different positions.
Figure 33:
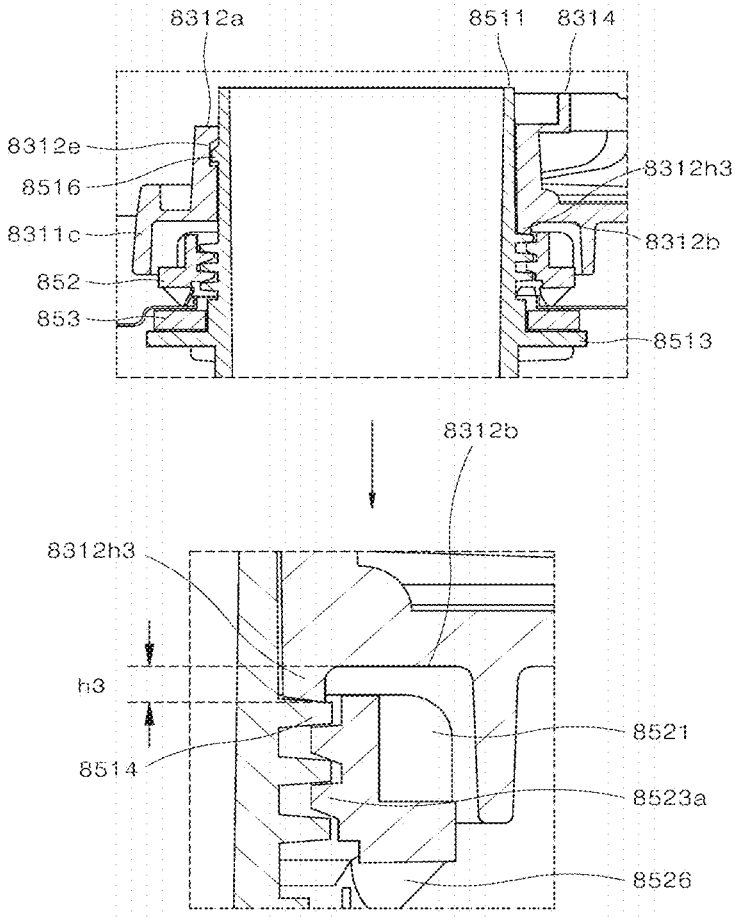
Figure 34:
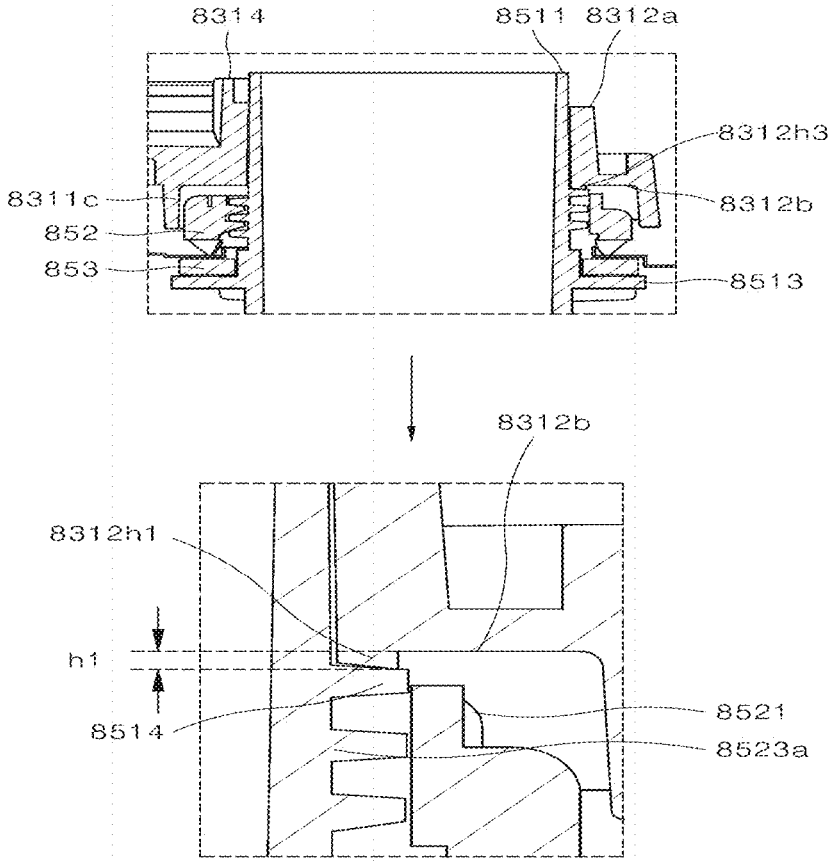

At this time, as illustrated in FIGS. 32 and 33, a screw thread 8523*a* of the fastening nut 852 to be screw-coupled to the male screw part 8514 of the duct main body 851 may have two windings that are less than those of the male screw part 8514 of the duct main body 851, for example.

Thus, as a screw coupling of the fastening nut 852 to the male screw part 8514 of the duct main body 851 is completed, the upper side surface of the screw thread of the male screw part 8514, corresponding to one winding from the upper end 8514*b* of the male screw part 8514 of the duct main body 851, may remain exposed to the lower end 8312*b* of the duct coupling part 8312.

As a result, the first protruding rib 8312*h*1, the second protruding rib 8312*h*2 and the third protruding rib 8312*h*3 of the duct coupling part 8312 may be supported by the upper side surface of the male screw part 8514 of the duct main body 851 at a time of occurrence of a downward relative movement, without being affected by the screw thread 8523*a* provided on an inner circumferential surface 8523 of the fastening nut 852.

Further, the radial maximum widths of the first protruding rib 8312*h*1, the second protruding rib 8312*h*2 and the third protruding rib 8312*h*3 may be the same, and be less than a gap between the outer circumferential surface of the connection duct part 85 and the inner circumferential surface 8523 of the fastening nut 852.

Accordingly, the first protruding rib 8312*h*1, the second protruding rib 8312*h*2 and the third protruding rib 8312*h*3 may be in no contact with the inner circumferential surface 8523 and the upper end 8522 of the fastening nut 852.

By doing so, although the third protruding rib 8312*h*3 having a maximum protrusion height is inserted into the fastening nut 852, a relative position of the third protruding rib 8312*h*3 with respect to the male screw part 8514 of the duct main body 851, as illustrated in FIG. 33, may be set regardless of the inner circumferential surface 8523 and the upper end 8522 of the fastening nut 852.

At this time, as described above, the lower end surfaces of the first protruding rib 8312*h*1, the second protruding rib 8312*h*2 and the third protruding rib 8312*h*3 may be provided in the form of an inclined surface to correspond to the shape of the upper side surface of the male screw part 8514 of the duct main body 851, which extends spirally.

The inclination angles of the lower end surfaces of the first protruding rib 8312*h*1, the second protruding rib 8312*h*2 and the third protruding rib 8312*h*3 may be approximately the same as that of the male screw part 8514 of the duct main body 851.

Thus, as at least any one of the first protruding rib 8312*h*1, the second protruding rib 8312*h*2 and the third protruding rib 8312*h*3 contacts the upper side surface of the male screw part 8514 of the duct main body 851 because of the airflow guide 83's downward relative movement caused by external force, at least any one of the first protruding rib 8312*h*1, the second protruding rib 8312*h*2 and the third protruding rib 8312*h*3 may be in surface-contact with the upper side surface of the male screw part 8514 of the duct main body 851.

That is, the lower end surface of at least any one of the first protruding rib 8312*h*1, the second protruding rib 8312*h*2 and the third protruding rib 8312*h*3 may be entirely supported by the upper side surface of the male screw part 8514 of the duct main body 851.

Since a maximum relative contact surface between the lower end surface of at least any one of the protruding ribs and the male screw part 8514 of the duct main body 851 is ensured, the downward relative movement of the airflow guide 83 may be effectively limited, and the airflow guide 83 may be reliably supported, despite strong external force.

[Detailed Configuration of Fastening Nut]

Figure 35:
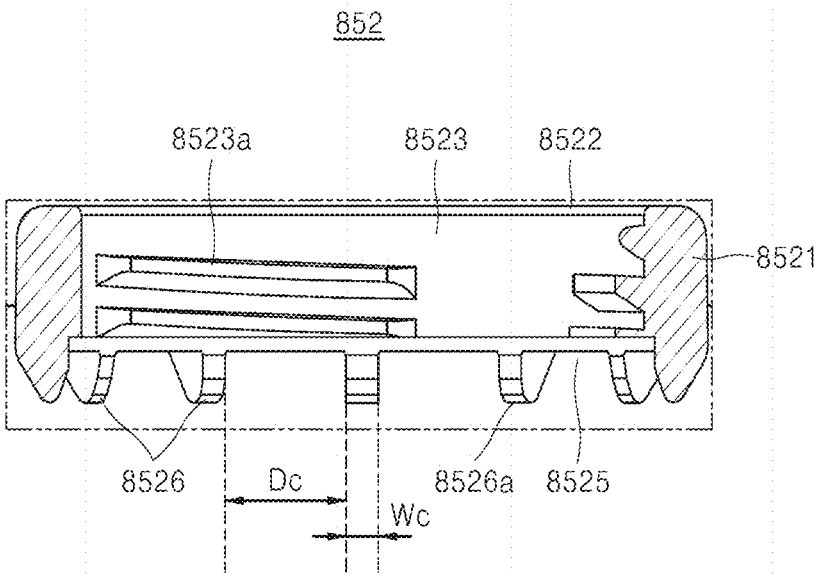
FIG. 35 is a cross-sectional view showing a perpendicular cross section of a fastening nut of the dishwasher of one embodiment.

Hereafter, a detailed configuration of the fastening nut 852 provided in the dishwasher 1 of one embodiment is described with reference to FIGS. 35 and 36.

The fastening nut, as described above, is screw-coupled to the outer circumferential surface of the connection duct part 85 and fixes the connection duct part 85 to the lower surface 25 of the bottom tub 20*c*.

To this end, the fastening nut 852 may have a cylindrical shape entirely, and be provided with a screw thread 8523*a* on the cylinder-shaped inner circumferential surface 8523*a* thereof, and the screw thread 8523*a* has a female screw shape and is screw-coupled to the male screw part 8514 of the duct main body 851 of the connection duct part 85.

The screw thread 8523*a* of the fastening nut, as described above, may have two windings, for example.

At a time of fixing and coupling the duct main body 851, the fastening nut 852 is screw-coupled to the male screw part 8514 of the duct main body 851 such that the upper end 8511 of the duct main body 851 is fixed to the tub 20, in the state of being exposed to the inside of the tub 20.

At this time, in the state where the fastening nut 852 is in close contact with the upper portion side of the lower surface 25 of the bottom tub 20*c*, and a flange 8513 of the duct main body 851 is in close contact with the lower portion side of the lower surface 25 of the bottom tub 20*c*, the flange 8513 receives the force of being pulled toward the lower surface of the bottom tub 20*c*, because of the fastening nut 852's coupling force.

By doing so, adhesive force between the flange 8513 and the lower surface 25 of the bottom tub 20*c* increases. Thus, it is less likely that wash water leaks to the outer circumferential surface of the duct main body 851. As a means of promoting the effect of preventing the leakage of wash water, an airtight ring made of an elastic material may be further provided between the flange 8513 and the lower surface 25 of the bottom tub 20*c*.

Additionally, a plurality of stoppers 8521 may be provided at the upper end side of the fastening nut 852 and interact with the release prevention part 8311*e* of the airflow guide 83.

The plurality of stoppers 8521 may be formed in a way that the upper end 8522 and the outer circumferential surface 8524 of the fastening nut 852 are depressed partially, and each of the plurality of stoppers 8521 may be disposed along the circumferential direction at regular intervals.

As described above, the other end portion of the release prevention part 8311*e* of the airflow guide 83 separates from the second edge wall 8311*c* and functions as a free end portion 8311*e*2, and directly contacts one side surface of the stopper 8521 of the fastening nut 852 and limits the rotational movement of the airflow guide 83 to prevent the airflow guide 83's escape from the right position thereof.

Further, the fastening nut 852 is directly exposed to wash water in the washing stage and the rinsing stage. In particular, the fastening nut 852 is directly exposed to the wash pace, and in some cases, is submerged in wash water filling the lower surface 25 of the bottom tub 20*c*, since it is disposed at the upper side of the lower surface 25 of the bottom tub 20*c*.

To be protected from corrosion caused by wash water, the fastening nut 852 may be manufactured, based on a plastic injection molding process.

Further, as the fastening nut 852 is coupled to the duct main body 851 completely, as described above, a lower end surface 8525 of the fastening nut 852 is in close contact with the lower surface 25 of the bottom tub 20*c* directly.

At this time, a minute gap may be formed between the lower surface 25 of the bottom tub 20*c* and the lower end surface 8525 of the fastening nut 852, in close contact, due to their manufacturing tolerance, and through the gap, wash water may flow into a space formed by the inner circumferential surface 8523 of the fastening nut 852, the outer circumferential surface of the duct main body 851 and the lower surface 25 of the bottom tub 20*c*.

Since the gap is minute, the wash water can hardly be discharged out of the fastening nut 852 once the wash water flows into the space.

The lower surface 25 of the bottom tub 20*c* is highly likely to be corroded by the wash water which is drawn but not discharged. In particular, since the dry air supply hole 254 is formed inside the fastening nut 852 in a way that the bottom tub 20*c* is perforated, the dry air supply hole 254 is highly likely to corrode, and germs included in wash water are reproduced generating a bad smell.

As a means of preventing the bottom tub 20*c*' corrosion and generation of a bad smell, the fastening nut 852 provided at the dishwasher 1 of one embodiment may comprise a plurality of contact projections 8526 that extends toward the bottom tub 20*c* from the lower end surface 8525.

Each of the plurality of contact projections 8526 may have an upper end that integrally connects to the lower end surface 8525 of the fastening nut 852, and a lower end that extends toward the lower surface 25 of the bottom tub 20*c* in the form of a protruding rib.

Each of the plurality of contact projections 8526 may be spaced from one another by a predetermined circumferential distance Dc, on the lower end surface 8525 of the fastening nut 852, in the circumferential direction.

At this time, the predetermined circumferential distance may be greater than a maximum circumferential thickness Wc of each contact projection 8526.

By doing so, a wash water passage through which wash water comes in and out may be provided between the contact projections 8526, and the lower end surface 8525 of the fastening nut 852 may be separated from the lower surface 25 of the bottom tub 20*c* and exposed to the wash space.

Accordingly, wash water may be effectively discharged out of the fastening nut without staying in the space formed by the inner circumferential surface 8523 of the fastening nut 852, the outer circumferential surface of the duct main body 851 and the lower surface 25 of the bottom tub 20*c*.

By doing so, the corrosion of the bottom tub 20*c*, i.e., the corrosion of the dry air supply hole 254, may be prevented effectively.

Further, each contact projection 8526 may have the same outer shape.

At this time, each contact projection 8526 may be formed into a sharp edge having a horizontal cross section of which decreases gradually from an upper end to a lower end, for example.

Additionally, a contact end portion 8526*a* at the lower end of the contact projection 8526, contacting the lower surface 25 of the bottom tub 20*c*, may be formed into a curved surface that is convex toward the lower surface 25 of the bottom tub 20*c*. Accordingly, the contact projection 8526 and the bottom tub 20*c* may remain at least in a linear contact state.

The shape of the contact projection may help to distribute the fastening nut 852's coupling force or pressurizing force uniformly through the each of the contact projections 8526 and apply the same to the lower surface 25 of the bottom tub 20*c*. Further, the sharp edge shape of the contact projection may help to minimize foreign substances such as food and the like fitted or fixed between the contact projection 8526 and the bottom tub 20*c*.

Figure 36:
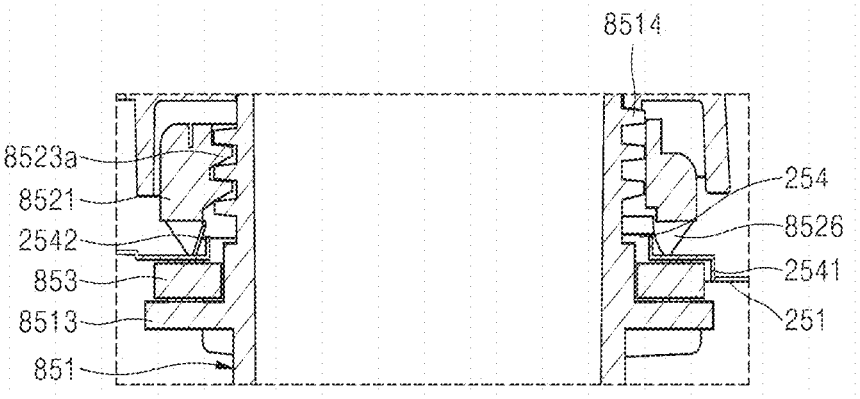
FIG. 36 is a perpendicular cross-sectional view showing a relationship between the fastening nut and the bottom tub in FIG. 35.

Further, as illustrated in FIG. 36, the dry air supply hole 254 through which the upper end 8511 of the duct main body 851 passes, is formed on a convergence surface 251 for guiding wash water to the sump hole 252.

The convergence surface 251 has a predetermined convergence inclination angle with respect to the horizontal direction to allow wash water to be moved by gravity.

Accordingly, the pressurizing force of the fastening nut 852 that moves perpendicularly at a time of screw-coupling the fastening nut 852 to the male screw part 8514 of the duct main body 851 may not be applied uniformly through the contact projection 8526.

For the pressurizing force of the contact projection 8526 of the fastening nut 852 to be uniformly distributed and applied to the bottom tub 20*c*, a ring-type coupling surface 2541 may be formed around the dry air supply hole 254 and be pressurized by the contact end portion 8526*a* of the lower end of the contact projection 8526.

At this time, the ring-type coupling surface 2541 may have directionality that extends in the horizontal direction perpendicular to the perpendicular direction where the fastening nut 852 is moved while being screw-coupled.

For example, the ring-type coupling surface 2541 may be a ring-type bead surface that is formed in a way that the surrounding area of the dry air supply hole 254 is pressed and plastic-deformed.

As described above, since the coupling surface 2541 extending horizontally is additionally formed in the portion of the bottom tub 20*c*, where the pressuring force of the fastening nut 852 is directly applied, each contact projection 8526 may apply its pressurizing force to the bottom tub 20*c* uniformly or evenly.

Further, the bottom tub 20*c*, as illustrated, may be further provided with a cylindrical part 2542 that extends circumferentially along the dry air supply hole 254 and protrudes upward toward the lower end surface 8525 of the fastening nut 852.

The cylindrical part 2542 intends to extend upward the height of a flooding water surface of wash water filling the lower surface 25 of the bottom tub 20*c*.

As illustrated, to prevent interference with the fastening nut 852, the height at which the cylindrical part 2542 protrudes from the lower surface 25 of the bottom tub 20*c* may be less than the height at which the contact projection 8526 protrudes from the lower end surface 8525 of the fastening nut 852.

Additionally, the height at which the cylindrical part 2542 protrudes from the lower surface 25 of the bottom tub 20*c* may remain constant along the circumferential direction.

Thus, it is less likely that wash water flows into the dry air supply hole 254 directly and that the dry air supply hole 254 and the cylindrical part 2542 are corroded by wash water.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

The invention claimed is:

1. A dishwasher, comprising:

a tub that defines a wash space configured to accommodate a wash target, the tub having a front surface that is open;

a dry air supply disposed below the tub and configured to generate dry air for drying the wash target and to supply the dry air into the wash space;

a rack disposed in the wash space and configured to be inserted into and withdrawn from the wash space, the rack being configured to support the wash target;

an airflow guide disposed between the rack and a lower surface of the tub and configured to guide the dry air; and a spray arm disposed between the lower surface of the tub and the rack, the spray arm comprising at least one nozzle configured to spray wash water for washing the wash target, wherein the airflow guide is disposed radially outside a rotation range of the spray arm, and wherein the airflow guide defines:

an inner flow space configured to guide the dry air, and a discharge opening disposed at a position below the nozzle, the discharge opening being configured to discharge the dry air to the wash space.

2. The dishwasher of claim 1, wherein the rotation range of the spray arm is a radius of rotation of the spray arm.

3. The dishwasher of claim 1, wherein a height of the discharge opening in an up-down direction is constant along a horizontal direction crossing the up-down direction.

4. The dishwasher of claim 1, wherein an upper end edge of the discharge opening is disposed at a position lower than the nozzle, and wherein a height of the upper end edge of the discharge opening in an up-down direction is constant.

5. The dishwasher of claim 1, wherein the airflow guide comprises a blocking rib configured to block wash water from entering the inner flow space of the airflow guide through the discharge opening.

6. The dishwasher of claim 5, wherein the blocking rib comprises a first rib that extends along an upper end edge of the discharge opening and protrudes outward from the upper end edge of the discharge opening, and wherein the discharge opening has a first side edge and a second side edge spaced apart from the first side edge, the upper end edge of the discharge opening extending between the first side edge and the second side edge.

7. The dishwasher of claim 6, wherein the first rib has (i) a first end portion disposed on the first side edge of the discharge opening and (ii) a second end portion disposed on the second side edge of the discharge opening, the first rib extending between the first end portion and the second end portion thereof.

8. The dishwasher of claim 7, wherein the first rib comprises a horizontal rib that extends along the upper end edge of the discharge opening, and wherein the horizontal rib protrudes outward over a bottom surface of the airflow guide.

9. The dishwasher of claim 5, wherein the blocking rib further comprises a second rib that extends across the discharge opening.

10. The dishwasher of claim 9, wherein the second rib has (i) a first end portion that connects to a first side edge of the discharge opening and (ii) a second end portion that connects to a second side edge of the discharge opening.

11. The dishwasher of claim 10, wherein a cross-sectional shape of the second rib is constant from the first end portion of the second rib to the second end portion of the second rib.

12. The dishwasher of claim 10, wherein a width of the second rib decreases from an inside of the airflow guide toward an outside of the airflow guide.

13. The dishwasher of claim 5, wherein the airflow guide comprises a duct coupling part configured to guide the dry air from the dry air supply, the duct coupling part comprising (i) an upper end that is exposed to the inner flow space and (ii) a lower end that connects to the dry air supply, and wherein the upper end of the duct coupling part is disposed at a position higher than a lowest point of the discharge opening in an up-down direction.

14. The dishwasher of claim 13, wherein a central axis of the duct coupling part is spaced apart from the discharge opening in a horizontal direction crossing the up-down direction.

15. The dishwasher of claim 13, wherein the airflow guide comprises a channel guide surface, the channel guide surface having:

an upper end that is disposed at a position higher than an upper end edge of the discharge opening in the up-down direction; and a lower end that connects to a bottom surface of the airflow guide.

16. The dishwasher of claim 15, wherein a height of the upper end of the channel guide surface is equal to a height of the upper end of the duct coupling part in the up-down direction.

17. The dishwasher of claim 15, wherein the airflow guide further comprises a division wall disposed between the duct coupling part and the channel guide surface.

18. The dishwasher of claim 1, wherein the airflow guide further comprises a blocking wall that is disposed in the inner flow space and blocks at least a portion of an upper side of the discharge opening.

19. The dishwasher of claim 18, wherein a lower end of the blocking wall is disposed between an upper end edge of the discharge opening and a bottom surface of the airflow guide.

20. The dishwasher of claim 18, wherein the blocking wall comprises:

a curved surface that is convex in a direction away from the discharge opening and extends from a first end edge of the blocking wall toward a second end edge of the blocking wall.

* * * * *